US009181722B2

(12) United States Patent
Rathbun et al.

(10) Patent No.: US 9,181,722 B2
(45) Date of Patent: Nov. 10, 2015

(54) AUTOMATIC STORAGE SYSTEM FOR VEHICLES

(75) Inventors: Thomas Rathbun, Grand Rapids, MI (US); Jonathan Ertle, Belmont, MI (US); Michael Andrew McGovern, Grand Rapids, MI (US); Jonathan Mark Rathbun, Belmont, MI (US); Michael William Timmer, Grandville, MI (US); David Jon Schroeder, Zeeland, MI (US); Randall David Miller, Los Angeles, CA (US)

(73) Assignee: Criterion Manufacturing Solutions, Inc., Comstock Park, MI (US)

( * ) Notice: Subject to any disclaimer, the term of this patent is extended or adjusted under 35 U.S.C. 154(b) by 829 days.

(21) Appl. No.: 13/432,644

(22) Filed: Mar. 28, 2012

(65) Prior Publication Data

US 2012/0251276 A1 Oct. 4, 2012

Related U.S. Application Data

(60) Provisional application No. 61/470,019, filed on Mar. 31, 2011.

(51) Int. Cl.

| | |
|---|---|
| ***E04H 6/22*** | (2006.01) |
| ***E04H 6/42*** | (2006.01) |
| ***B66F 9/07*** | (2006.01) |

(52) U.S. Cl.
CPC *E04H 6/422* (2013.01); *B66F 9/07* (2013.01); *E04H 6/22* (2013.01)

(58) Field of Classification Search
CPC ..... B66F 9/07; B66F 9/065; B66F 9/072; B66F 9/07513; B66F 9/07522; B66F 9/12; B66F 9/122; B66F 9/14; B66F 9/141; E04H 6/422; E04H 6/22; E04H 6/282; E04H 6/12; E04H 6/14; E04H 6/182; E04H 6/24
See application file for complete search history.

(56) References Cited

U.S. PATENT DOCUMENTS

| | | | | |
|---|---|---|---|---|
| 2,994,445 | A * | 8/1961 | Roth | 414/249 |
| 3,765,251 | A * | 10/1973 | Whitenack, Jr. | 74/29 |
| 3,779,403 | A * | 12/1973 | Young | 414/279 |
| 5,024,571 | A | 6/1991 | Shahar et al. | |
| 5,173,027 | A | 12/1992 | Trevisani | |
| 5,314,284 | A * | 5/1994 | Tsai | 414/234 |

(Continued)

FOREIGN PATENT DOCUMENTS

| | | | |
|---|---|---|---|
| DE | 19609090 | A1 * | 7/1997 |
| DE | 102009046729 | A1 * | 5/2011 |

(Continued)

*Primary Examiner* — Glenn Myers
(74) *Attorney, Agent, or Firm* — Gardner, Linn, Burkhart & Flory, LLP

(57) ABSTRACT

An automatic vehicle storage system includes an adjustable, self-guided vehicle satellite for moving a vehicle between a pick-up and drop-off bay, a vehicle carriage, and a storage bay. The vehicle carriage is typically movable along and by a vehicle crane, which carries the vehicle to a desired storage bay, where the vehicle satellite then moves the vehicle. Once the vehicle is in the storage bay, the satellite and returns back to the carriage at the vehicle crane. The vehicle storage system is also capable of rotating the vehicle, such that the vehicle is forward-facing in the pick-up and drop-off bay when it is retrieved by the user, and to facilitate the simultaneous operation of side-by-side cranes within a storage facility.

22 Claims, 41 Drawing Sheets

(56) References Cited

U.S. PATENT DOCUMENTS

| | | | |
|---|---|---|---|
| 5,320,473 | A | 6/1994 | Arnold et al. |
| 5,338,145 | A | 8/1994 | Beretta |
| 5,437,536 | A | 8/1995 | Bianca |
| 5,618,149 | A | 4/1997 | Beaumont et al. |
| 5,980,185 | A | 11/1999 | Vita |
| 6,104,314 | A | 8/2000 | Jiang |
| 7,736,113 | B2 | 6/2010 | Yook et al. |
| 2008/0031711 | A1 | 2/2008 | Yook et al. |
| 2011/0182703 | A1* | 7/2011 | Alan ..... 414/231 |

FOREIGN PATENT DOCUMENTS

| | | | | |
|---|---|---|---|---|
| JP | 08128220 | A | * | 5/1996 |
| JP | 08158686 | A | * | 6/1996 |
| JP | 09302977 | A | * | 11/1997 |
| WO | 2008045606 | A1 | | 4/2008 |

* cited by examiner

AUTOMATIC STORAGE SYSTEM FOR VEHICLES

CROSS REFERENCE TO RELATED APPLICATION

The present application claims the priority benefit of U.S. provisional application Ser. No. 61/470,019, filed Mar. 31, 2011, which is hereby incorporated herein by reference in its entirety.

FIELD OF THE INVENTION

The present invention generally relates to an automatic parking system wherein a car retrieval and transportation assembly is capable of taking a car from a user, transporting the car to a designated parking space, and identifying and retrieving the car based on user demand.

BACKGROUND OF THE INVENTION

Automatic parking systems are used as alternatives to more conventional parking ramps, lots, structures, or the like, and facilitate more condensed parking of vehicles in a given area or volume, since there is little or no need for driving areas or pedestrian spaces within the parking area. Automatic parking systems typically utilize robotics to move each vehicle from a drop-off zone to a storage space, and to retrieve each vehicle on-demand and deposit it in a pick-up zone.

SUMMARY OF THE INVENTION

The present invention provides an automatic vehicle storage system comprising an adjustable, self-guided vehicle satellite and a pick-up and drop-off bay. The vehicle satellite is capable of lifting and moving a car from the pick-up and drop-off bay to a vehicle crane which carries a vehicle to a desired storage location where the vehicle satellite then moves the vehicle into the storage location and returns back to the vehicle crane. The vehicle storage system is also capable of rotating the vehicle, such that the vehicle is forward facing in the pick-up and drop-off bay when it is retrieved by the user.

According to an aspect of the present invention, an automatic vehicle storage system includes a crane assembly, a carriage assembly, a platform associated with the carriage assembly, and a self-driven vehicle retrieval satellite. The crane assembly is configured to move longitudinally within a vehicle storage facility, while the carriage assembly is capable of moving vertically along the crane assembly. The platform is movable on the carriage assembly, and supports the satellite and a vehicle during vehicle storage and retrieval operations. The satellite is operable to selectively raise and lower the vehicle, and is movable onto and off of the platform during vehicle storage and retrieval. The satellite includes a plurality of sensors for guiding the satellite under the vehicle, and further includes adjustable sections that permit the dimensions of the satellite to be adjusted or changed according to the dimensions of the vehicle.

Optionally, two or more crane assemblies, with respective carriage assemblies, platforms, and vehicle retrieval satellites, may be operated simultaneously in a single vehicle storage facility.

Optionally, the sensors of the satellite may include an upwardly-directed sensor for detecting at least the locations of front and rear ends of the vehicle, and two side-facing sensors for detecting the locations of tires of the vehicle.

Optionally, the satellite may include a primary section and a secondary section for selectively engaging front and rear tires of the vehicle, respectively. The satellite may further include an extendable and retractable spine coupled between the primary and secondary sections. The spine is operable to change the spacing between the primary and secondary sections according to the vehicle wheelbase, as detected by the sensors. Either of the primary and secondary sections may be capable of engaging either the front or rear wheels of the vehicle.

Optionally, the carriage assembly may include a carriage base frame, a first translatable skate, and a rotatable slewing drive. The skate is movable relative to the carriage base frame, and the slewing drive is coupled to the skate. The platform is translatably and rotatably coupled to the base frame via the first translatable skate and the rotatable slewing drive. Optionally, the carriage assembly may further include a second translatable skate coupled between the platform and the carriage base frame. In this arrangement, the first translatable skate is operable to move the platform substantially horizontally along a first axis, the second translatable skate is operable to move the platform substantially horizontally along a second axis that is substantially perpendicular to the first axis, and the rotatably slewing drive is operable to rotate the platform about a substantially vertical third axis that is generally perpendicular to the first and second axes.

Optionally, the second translatable skate may be operable to extend a front end portion of the platform out from the carriage assembly in a cantilever manner in a lateral direction, substantially perpendicular to the longitudinal direction of the first translatable skate, for contacting an edge portion of a vehicle pick-up and drop-off bay or a storage bay of the vehicle storage facility with the front end portion of the platform.

Optionally, a front end portion of the platform may include a pivotable nose that is configured to engage the edge portion of the vehicle pick-up and drop-off bay (or the storage bay) of the vehicle storage facility. The pivotable nose is operable to pivot as it contacts the edge portion when the platform is urged toward the edge portion with a longitudinal axis of the platform misaligned with the second axis. This allows the platform to align itself with a misaligned vehicle, so that the satellite is substantially aligned with the vehicle when the satellite leaves the platform to retrieve the vehicle.

Optionally, the vehicle retrieval satellite may include a steerable wheel and a rear sensor, while the platform includes a laser emitter or other homing signal transmitter for selectively generating a laser beam or other homing signal along a longitudinal axis of the platform. The rear sensor of the satellite can detect the homing signal, and the steerable wheel can steer the satellite as the satellite returns onto the platform, in response to the detected location of the homing signal by the rear sensor. Optionally, the homing signal transmitter is a pop-up laser that retracts into an upper surface of the platform as the satellite moves along the platform.

Optionally, the satellite includes tire-engaging grippers at each of the primary and secondary satellite sections. The tire-engaging grippers are extendable to engage and lift a tire of the vehicle, and are retractable to disengage and lower the tire of the vehicle.

Optionally, the satellite includes a power cable for supplying power to at least the power drive system and the steering system. The power cable is stored on a wire reel, which has a motorized hub for winding and unwinding the power cable on the wire reel. The wire reel is thus operable to wind and unwind a power cable as the satellite moves in the opposite directions. Optionally, an on-board battery pack may be used in place of a power cable, with the battery pack being recharged when the satellite is positioned on the platform.

According to another aspect of the present invention, a method is provided for moving a vehicle within a vehicle storage facility. The method includes the steps of (i) positioning a movable platform at an edge portion of a vehicle pick-up bay, (ii) moving a vehicle retrieval satellite from the movable platform toward a vehicle positioned at the floor surface of the pick-up bay; (iii) detecting a location of a front tire of the vehicle with a sideways-directed sensor on the satellite as the satellite moves beneath the vehicle; (iv) detecting a location of a rear tire of the vehicle with the sideways-directed sensor on the satellite as the satellite moves beneath the vehicle; (v) stopping a primary portion of the satellite at the front tire of the vehicle when the primary portion is aligned therewith; (vi) extending a spine portion of the satellite, which joins the secondary portion to the primary portion, to move the secondary portion of the satellite beneath the vehicle after the primary portion is stopped; (vii) stopping the secondary portion of the satellite at the rear tire of the vehicle when the secondary portion is aligned therewith; (viii) extending a plurality of tire-engaging grippers to engage and lift the front and rear tires with the primary and secondary portions of the satellite, respectively; and (ix) moving the satellite along the floor surface of the pick-up bay to convey the vehicle out of the pick-up bay and onto a vehicle carriage.

Optionally, the method further includes retracting the platform away from the edge portion of the pick-up bay; moving the vehicle carriage with the satellite and the vehicle toward a selected storage bay within the vehicle storage facility; extending the platform toward an edge portion of the storage bay; and moving the satellite and the vehicle into the selected storage bay.

Therefore, the automatic parking system of the present invention provides a substantially self-contained vehicle satellite or shuttle that is capable of picking up and dropping off different sizes of vehicles along substantially conventional floor surfaces in a vehicle storage facility. The system includes an articulating vehicle platform mounted in a vehicle carriage on a crane assembly, which permits the system to retrieve even misaligned vehicles, carry them to an appropriate storage bay, and store the vehicles in closely-spaced arrangement for space efficiency until the vehicle is to be retrieved by a vehicle operator. The platform is translatable and rotatable to improve storage efficiency, to facilitate the simultaneous operation of multiple cranes in the same facility, and to safely and efficiently move and store vehicles within the facility, all with little difference from a standard parking facility from the viewpoint of a vehicle operator.

These and other objects, advantages, purposes, and features of the present invention will become more apparent upon review of the following specification in conjunction with the drawings.

DETAILED DESCRIPTION OF THE PREFERRED EMBODIMENTS

Figure 1:
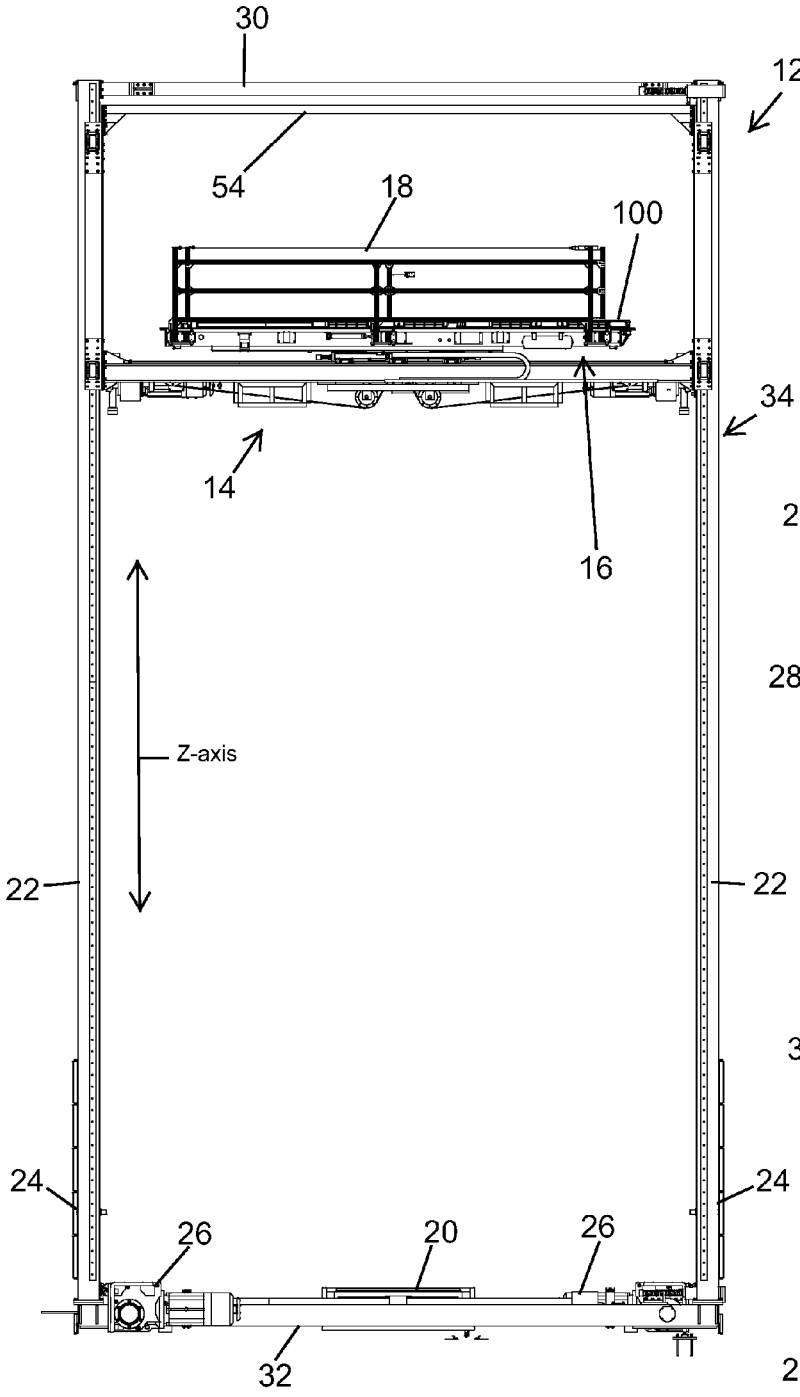
FIG. 1 is a side elevation of a vehicle carriage assembly and vehicle crane in accordance with the present invention.

The present invention is directed to an automated parking system that is capable of quickly and safely receiving vehicles of different shapes and sizes, storing the vehicles in high-density storage bays, and retrieving the vehicles on-demand. The parking system can store vehicles at about double or triple the normal vehicle storage density (that is, the number of vehicles that will fit in a given volume of parking space) of a conventional multi-level parking garage that must include extra non-storage spaces for driving areas and for providing persons with access to the parked vehicles, for example. The parking system is fully automated, and permits drivers and passengers to leave a vehicle in a pick-up and drop-off zone or bay (hereinafter "P&D Bay") that is simply a generally flat concrete (or other material) parking surface. That is, the vehicle need not be parked on a vehicle carriage or in an area with obstructions or other components that would require the driver to park the vehicle in an unconventional manner.

Not only does this facilitate use of the parking system and facility by persons who are unfamiliar with the system, or who are uncomfortable with parking a vehicle in a precise location or in close proximity to obstructions or mechanical components'in or near the roadway, but it also facilitates use of the system by handicapped persons or others requiring or desiring the extra space of oversized and unobstructed parking zones (e.g., for access by wheelchairs, lifts, and the like), since the parking surface of the P&D Bay is typically a substantially conventional flat floor or surface that meets or exceeds the minimum dimensions required to be fully ADA-compliant, Once a vehicle has been left in an acceptable position and orientation in the P&D Bay and the system has confirmed that no persons or objects are in an unsafe area of the P&D Bay, the system moves or delivers a shuttle or satellite unit into the P&D Bay and under the vehicle to begin the vehicle-retrieval process. The satellite is capable of sensing the dimensions of the vehicle and location the vehicle's tires (either with on-board sensors, remote sensors in the P&D Bay, or a combination of on-board and remote sensors), and adjusts its geometry or configuration and/or determines an appropriate parking space according to the vehicle dimensions and/or tire locations. The satellite then deploys tire-engaging grippers that lift the vehicle slightly so that its weight is fully supported by the satellite, which then returns itself (with the vehicle) to a vehicle carriage located on a crane positioned outside of the P&D Bay.

Once the vehicle is supported on the vehicle carriage assembly, the vehicle is rotated on the assembly for transport by the crane, and the vehicle is moved by the crane to a selected storage bay (which may be selected according to vehicle size and/or typical storage time for that vehicle, for example) within the parking facility. The vehicle is then moved into the storage bay and left there, at which point the crane and vehicle carriage assembly is free to retrieve another vehicle from the P&D Bay or from a different storage bay. When the vehicle owner or operator returns for his or her vehicle, the crane retrieves the vehicle and returns it to the P&D Bay. Optionally, a given vehicle may be moved to different storage bays within the parking facility during the vehicle's storage period, such as to re-organize the vehicles in the facility for more efficient space usage, or to retrieve one vehicle that is blocked by another.

Referring now to the drawings and the illustrative embodiments depicted therein, a vehicle storage assembly 10 includes a crane assembly 12 having a vehicle carriage assembly 14 with a vehicle platform 16 (FIGS. 1 and 3), which includes a safety rail 18 to enhance the safety of maintenance personnel who may be located on the platform while servicing it, for example. The crane 12 is designed to lift a vehicle on the vehicle carriage 14 from the pick-up and drop-off bay (P&D Bay) to a desired storage location, such as shown in FIGS. 37A-38H, and as will be described in greater detail below. As shown in FIG. 2, the crane 12 further includes four masts 22, which are generally disposed in an upright parallel relationship, and are generally spaced apart from one another and arranged at the four corners of carriage assembly 14. Masts 22 cooperate with (and are coupled to) a pair of upper braces 30 and a pair of lower braces 32 to form a crane frame 34 that supports carriage assembly 14 in a manner that permits the assembly to move vertically up and down along masts 22, such as shown in FIGS. 3 and 4.

Figure 2:
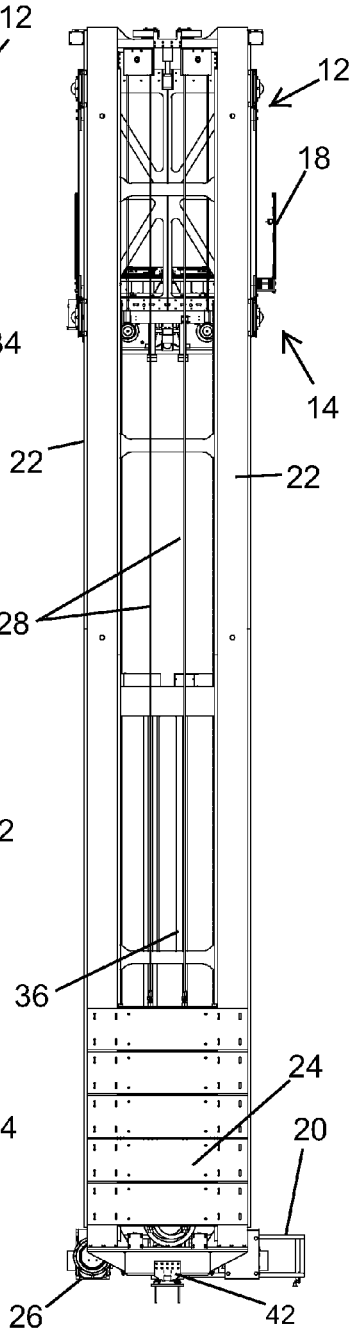
FIG. 2 is an end elevation of the vehicle crane and carriage assembly of FIG. 1.

For the purposes of description herein, the terms "upper," "lower," "right," "left," "rear," "front," "vertical," "horizontal," and derivatives thereof shall relate to the invention as oriented in FIG. 1. However, it should be understood that the invention may assume various alternative orientations, except where expressly specified to the contrary. It also should be understood that the specific devices and processes illustrated in the appended drawings, and described in following specification, are simply exemplary embodiments. Hence, specific dimensions and other physical characteristics relating to the embodiments disclosed herein are not to be construed as limiting, unless expressly stated otherwise.

Figure 3:
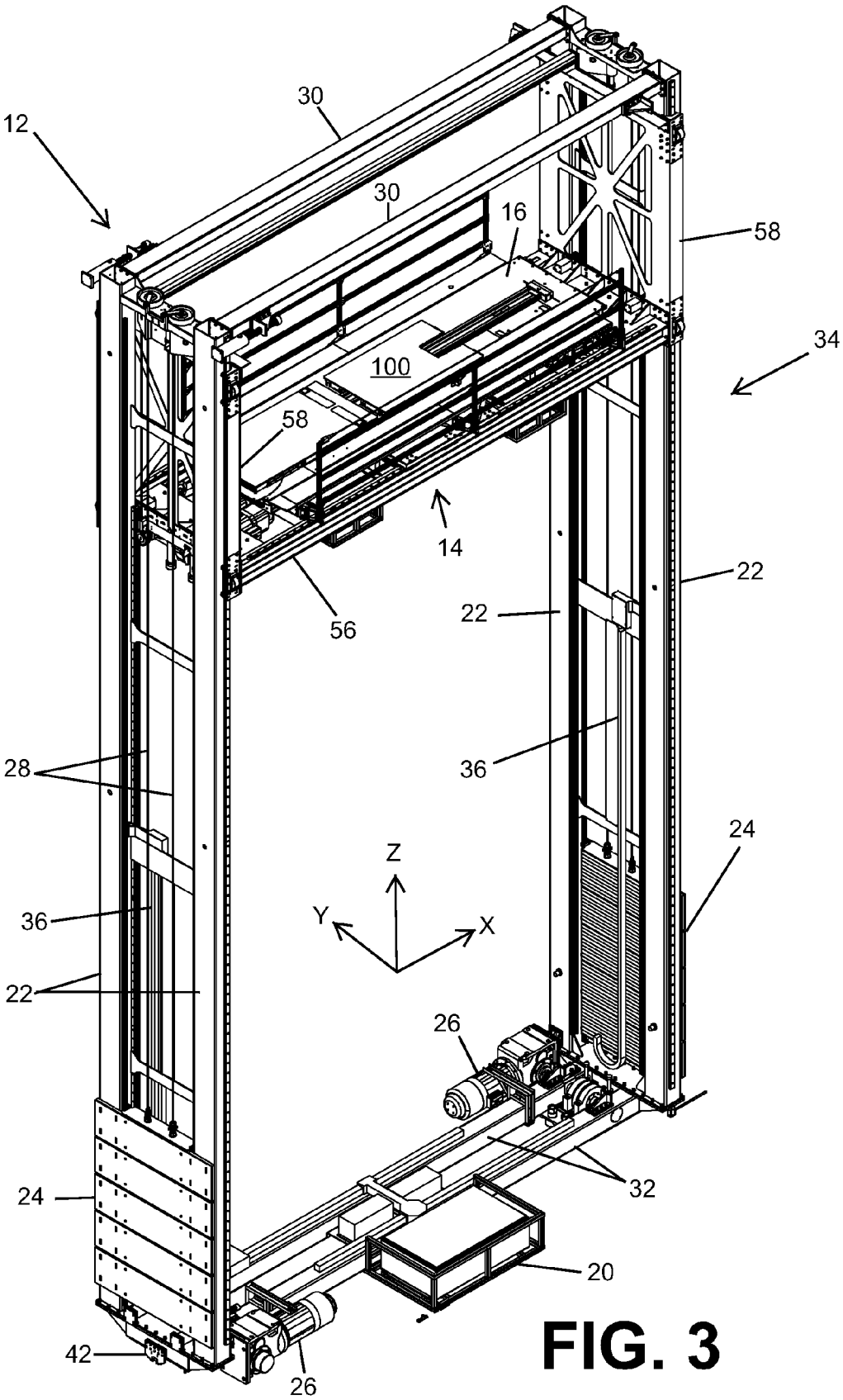
FIG. 3 is a top perspective view of the vehicle crane and carriage assembly of FIG. 1.
Figure 4:
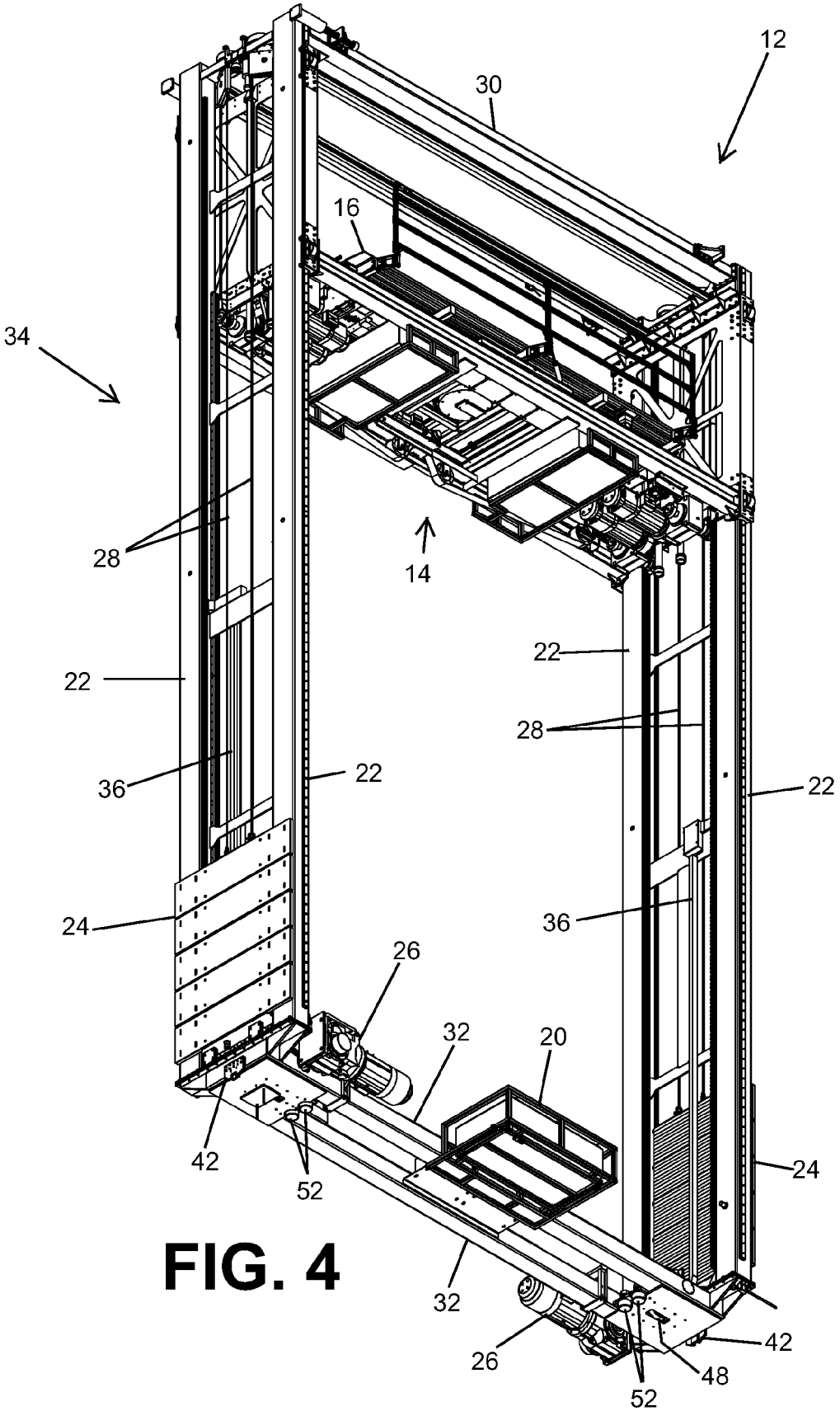
FIG. 4 is a bottom perspective view of the vehicle crane and carriage assembly of FIG. 1.
Figure 5:
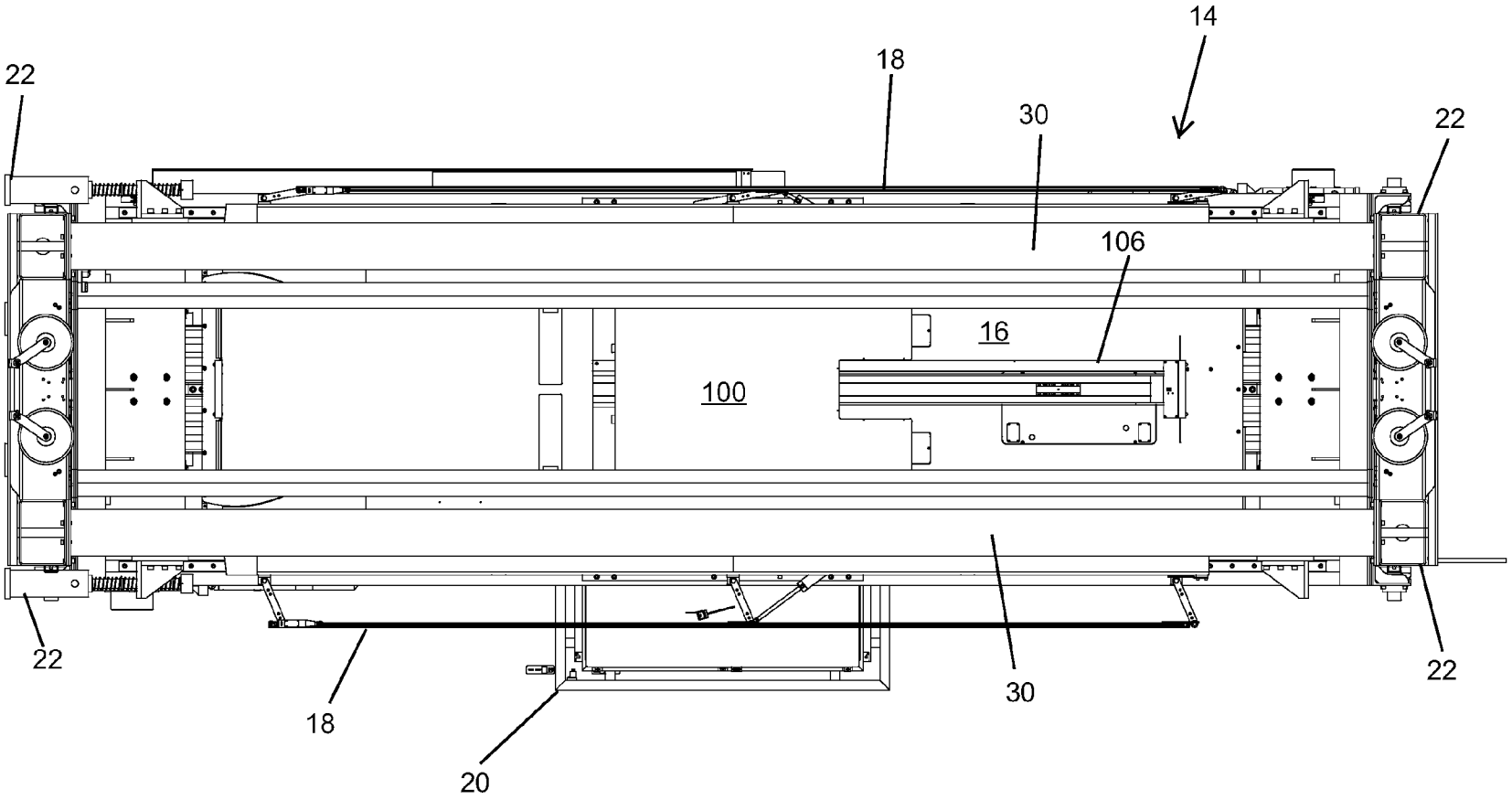
FIG. 5 is a top plan view of the vehicle crane and vehicle carriage assembly of FIG. 1.

As shown in FIGS. 1-8, a control unit 20 is disposed on lower brace 32 and counterbalance weights 24 are movably coupled to respective pairs of masts 22. As best shown in FIG. 3, drive motors 26 are disposed on respective lower braces 32, and are used to power the vertical movement of the carriage 14, as will be further described below. As shown in FIGS. 2-4, electrical conduits 36 are disposed between respective end pairs of masts 22, the conduits 36 including cables for transmitting data, power, and other electrical communications to the carriage 14, such that the carriage 14 can move vertically along the crane masts 22 without losing power or communication with the system controls (e.g., at control unit 20).

Figure 6:
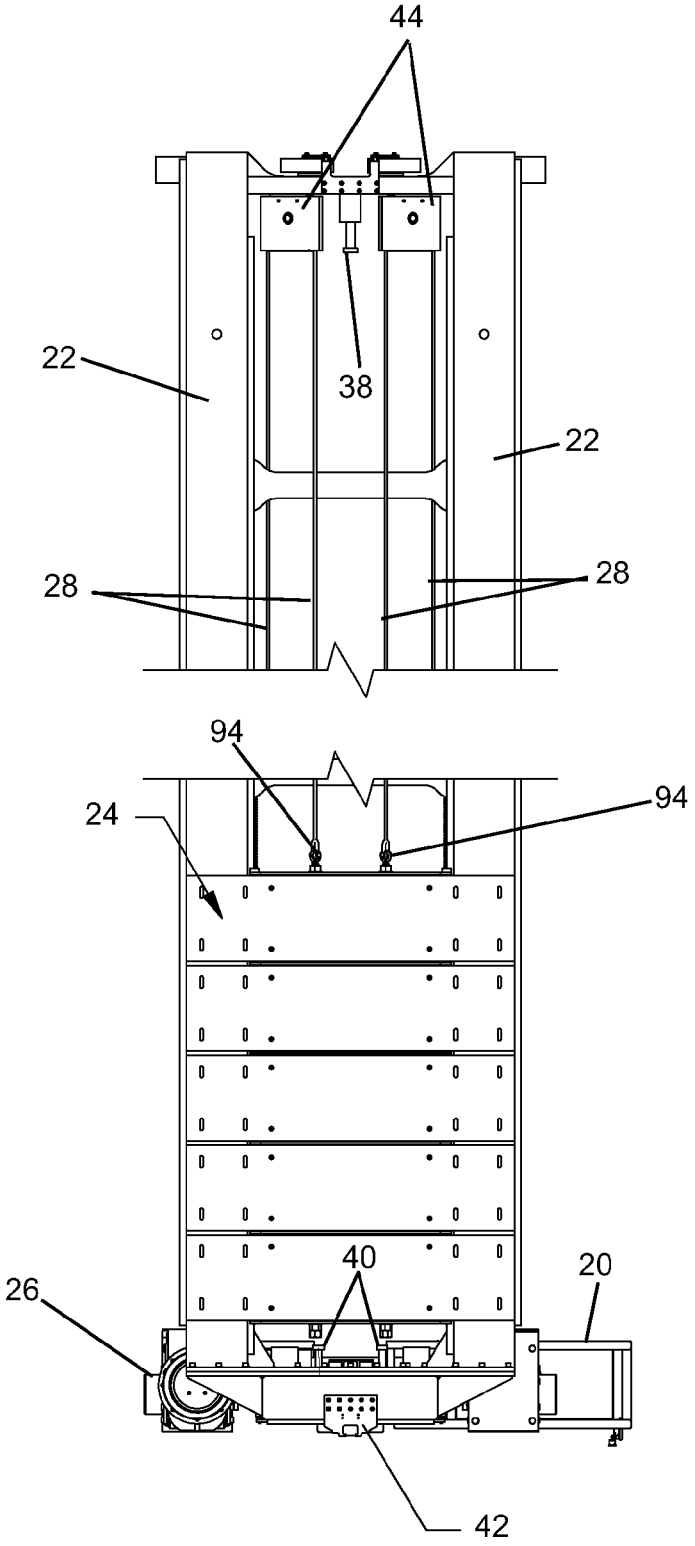
FIG. 6 is a fragmented end elevation of the vehicle crane of FIG. 1, shown with carriage assembly removed therefrom.
Figure 7:
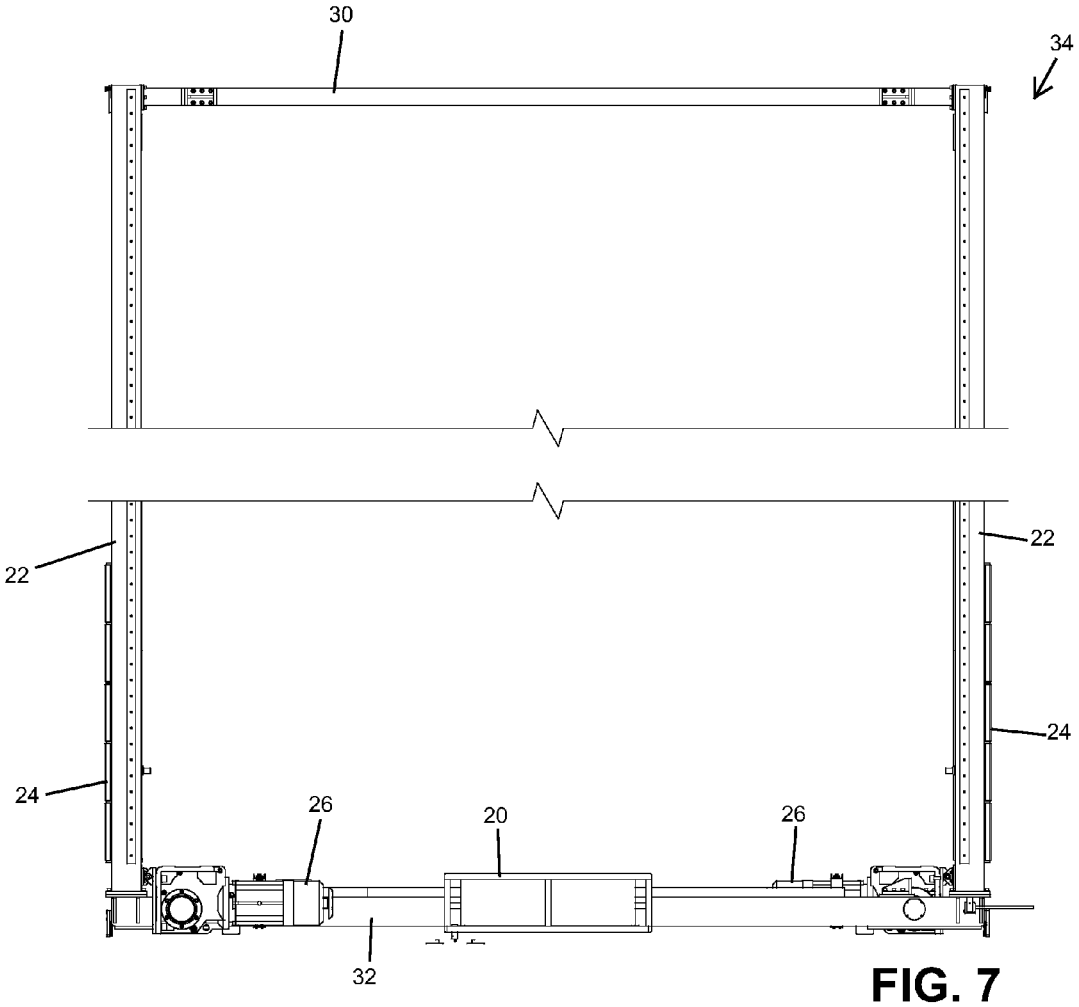
FIG. 7 is a fragmented side elevation of the vehicle crane of FIG. 6.
Figure 8:
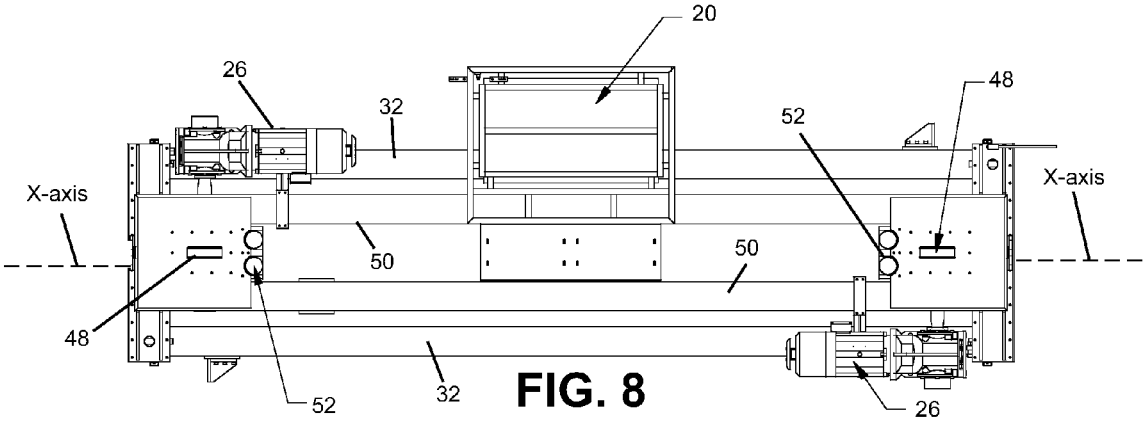
FIG. 8 is a top plan view of the vehicle crane of FIG. 6.

Crane assembly 12 includes an upper carriage shock 38 and a lower carriage shock 40 (FIG. 6), which absorb any impact of vehicle carriage assembly 14 with upper and lower portions of the crane assembly 12 in case of an inadvertent overrun, without damage to the system. An emergency rail grabber 42 is provided for halting the travel of carriage assembly 14 in the event of an inadvertent loss of control, as will be further described below. Counterbalance sheaves 44 are provided at the top of crane assembly 12 for routing a cable or wire rope 28 from the counterbalance weights 24 to the carriage assembly 14 (FIG. 6).

Drive motors 26 (also referred to as "X-drive motors") are operable to rotatably drive respective crane drive wheels 48 that are disposed on either side of a lower portion of the crane (FIG. 8), in order to move the crane 12 in a longitudinal direction along a rail 46 (FIGS. 25, 27, 28, 30 and 38F-38H), which may be a standard railroad-type rail, as is known in the art. Crane drive wheels 48 are supported by parallel braces 50, each of which further supports a pair of laterally-centering wheels 52 (FIGS. 4 and 8), which in the illustrated embodiment are rollers that ride on opposing sides of the rail 46 and are disposed near the crane'drive wheels 48, and which engage rail 46 to help guide the crane's longitudinal movement along the rail. In operation, the crane drive wheels 48 support substantially the full weight of the crane 12. Emergency rail grabber 42 includes a plate that is configured to substantially match the profile of rail 46, and is operable to capture or engage the rail 46 to halt the travel of crane assembly 12 and keep it generally centered along rail 46 in the event of a failure with the crane base drive wheels 48, for example.

Figure 9:
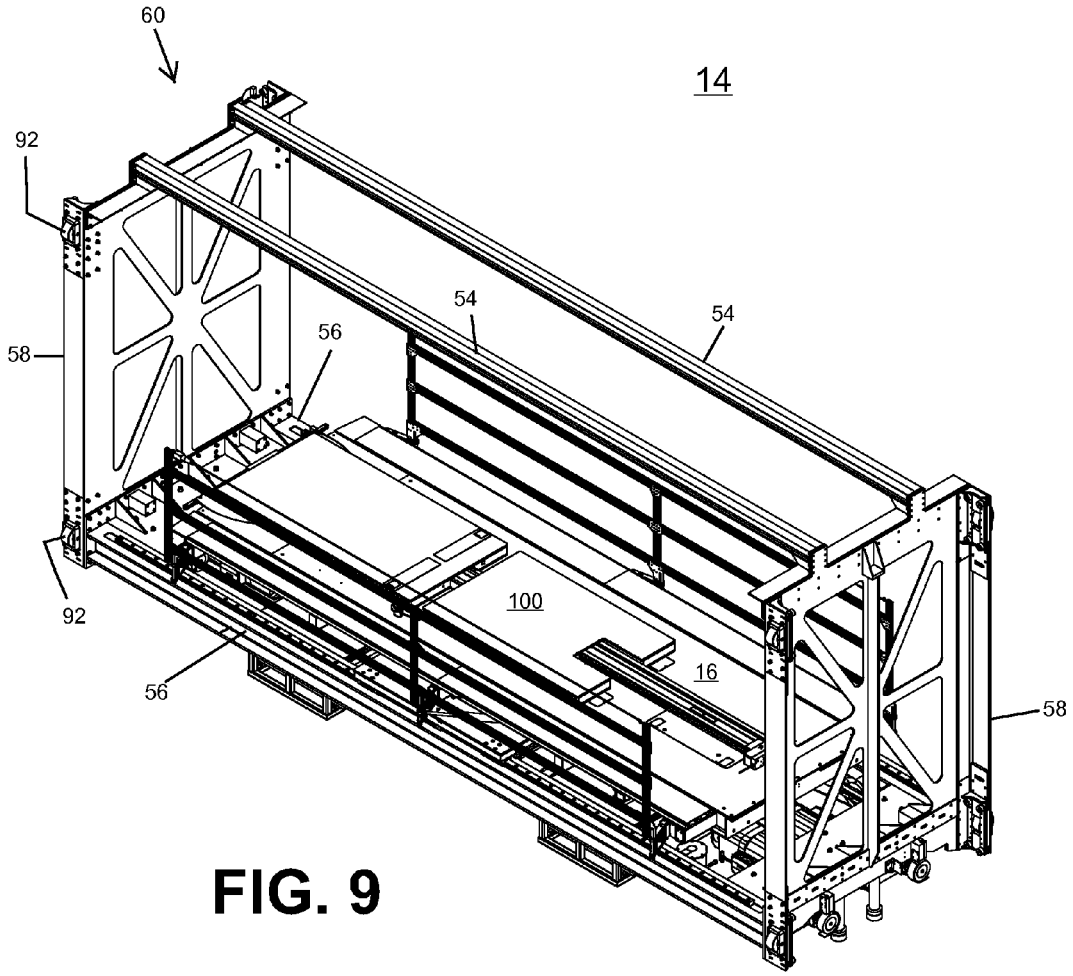
FIG. 9 is a perspective view of the vehicle carriage assembly of FIG. 1, shown without the vehicle crane.
Figure 11:
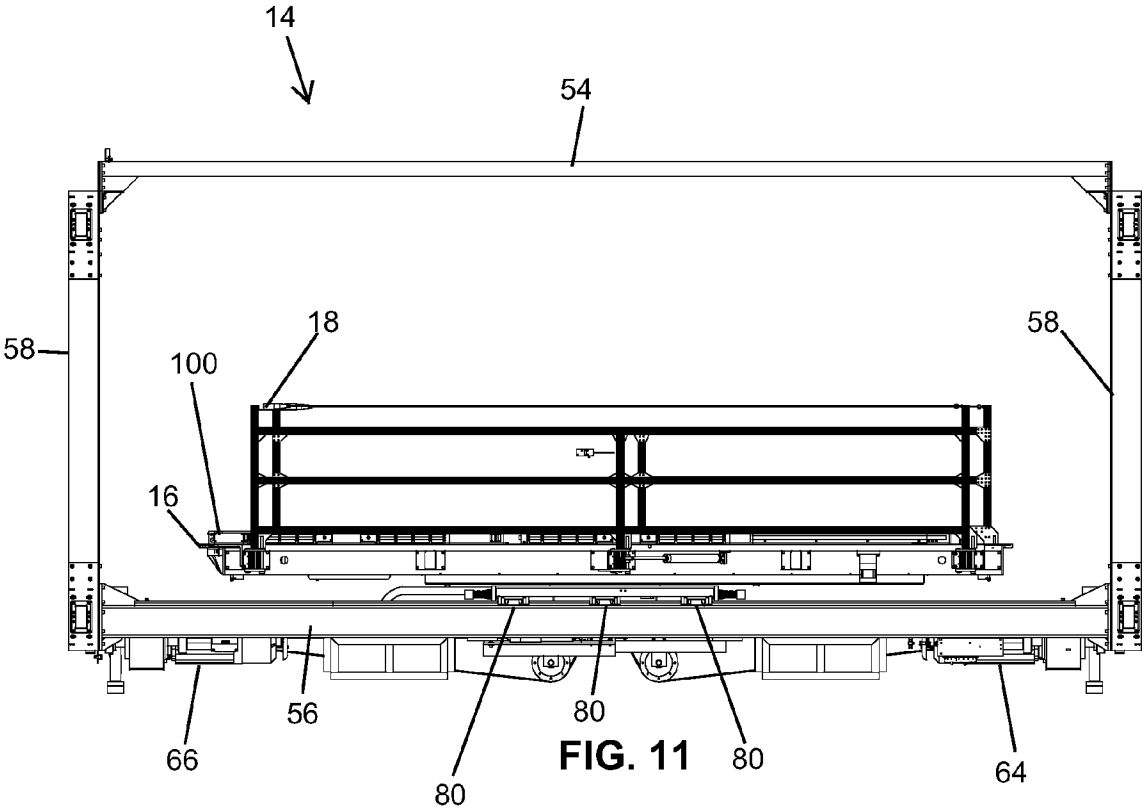
FIG. 11 is a side elevation of the vehicle carriage assembly of FIG. 9.
Figure 10:
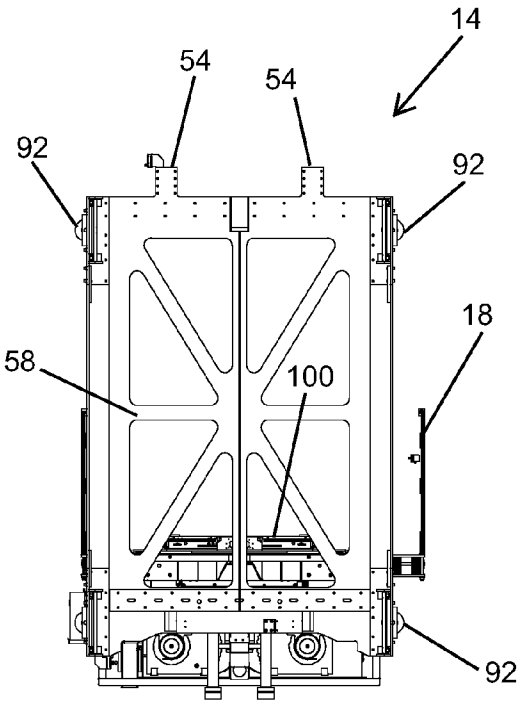
FIG. 10 is an end elevation of the vehicle carriage assembly of FIG. 9.
Figure 12:
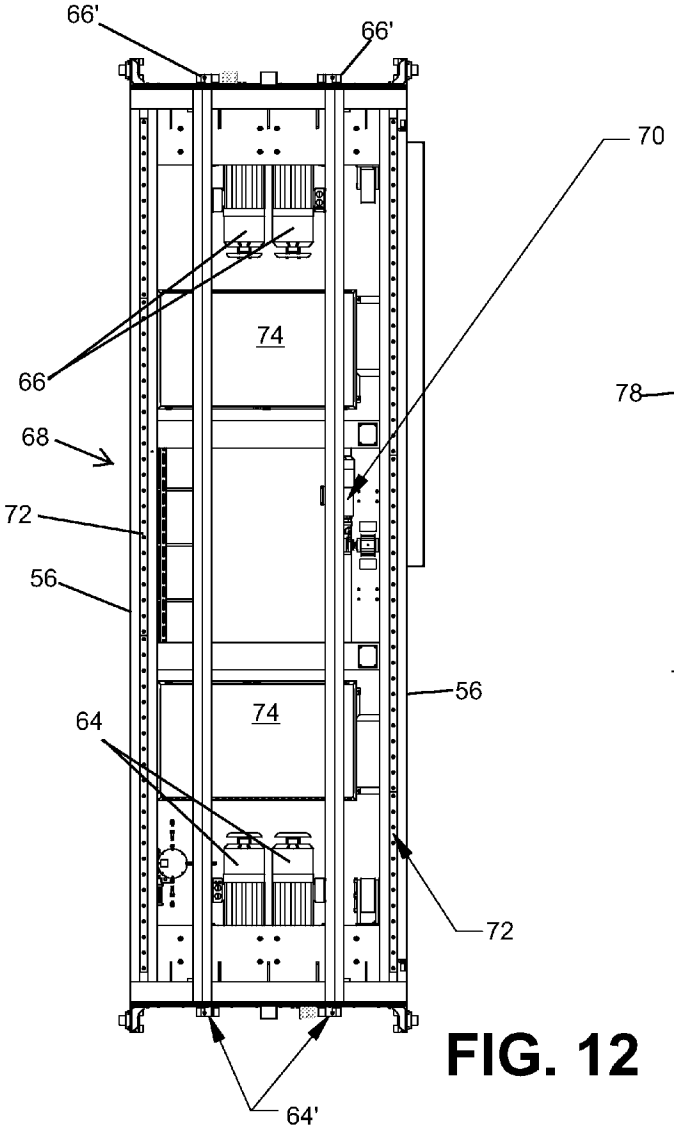
FIG. 12 is a top plan view of a vehicle carriage assembly base from the vehicle carriage assembly of FIG. 9, shown with the vehicle satellite removed for clarity.
Figure 15:
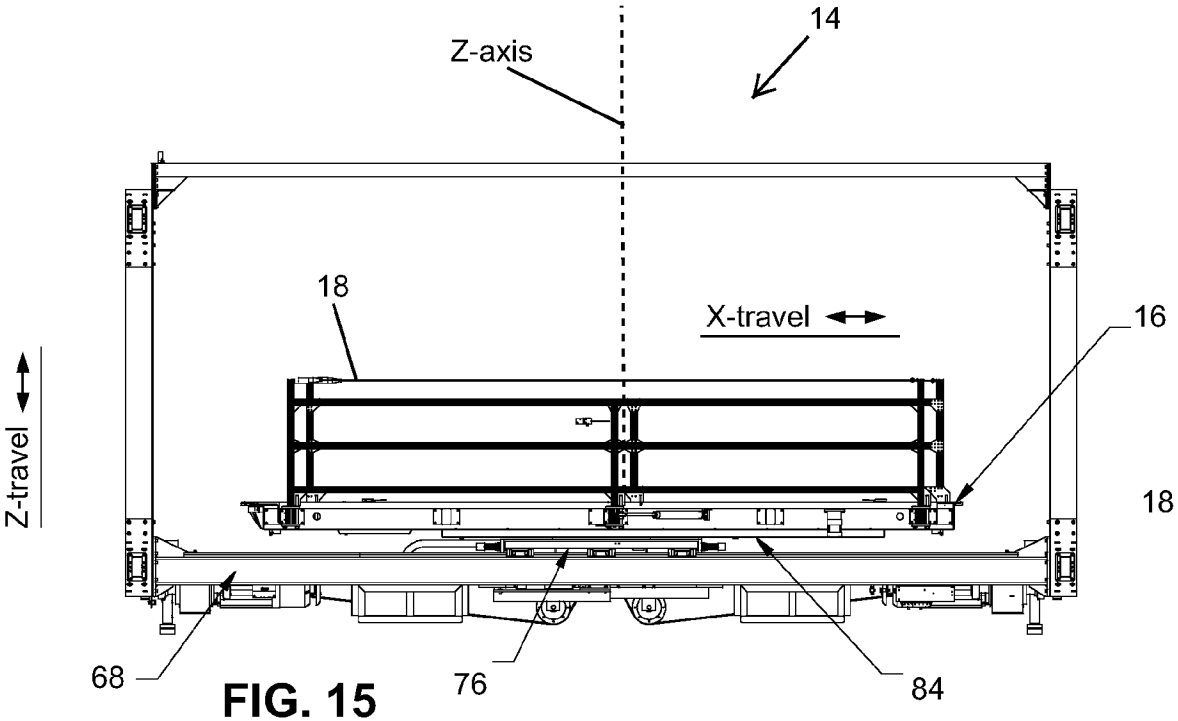
FIG. 15 is another side elevation of the vehicle carriage assembly, similar to that of FIG. 11 and showing two of the directions of travel.
Figure 18:
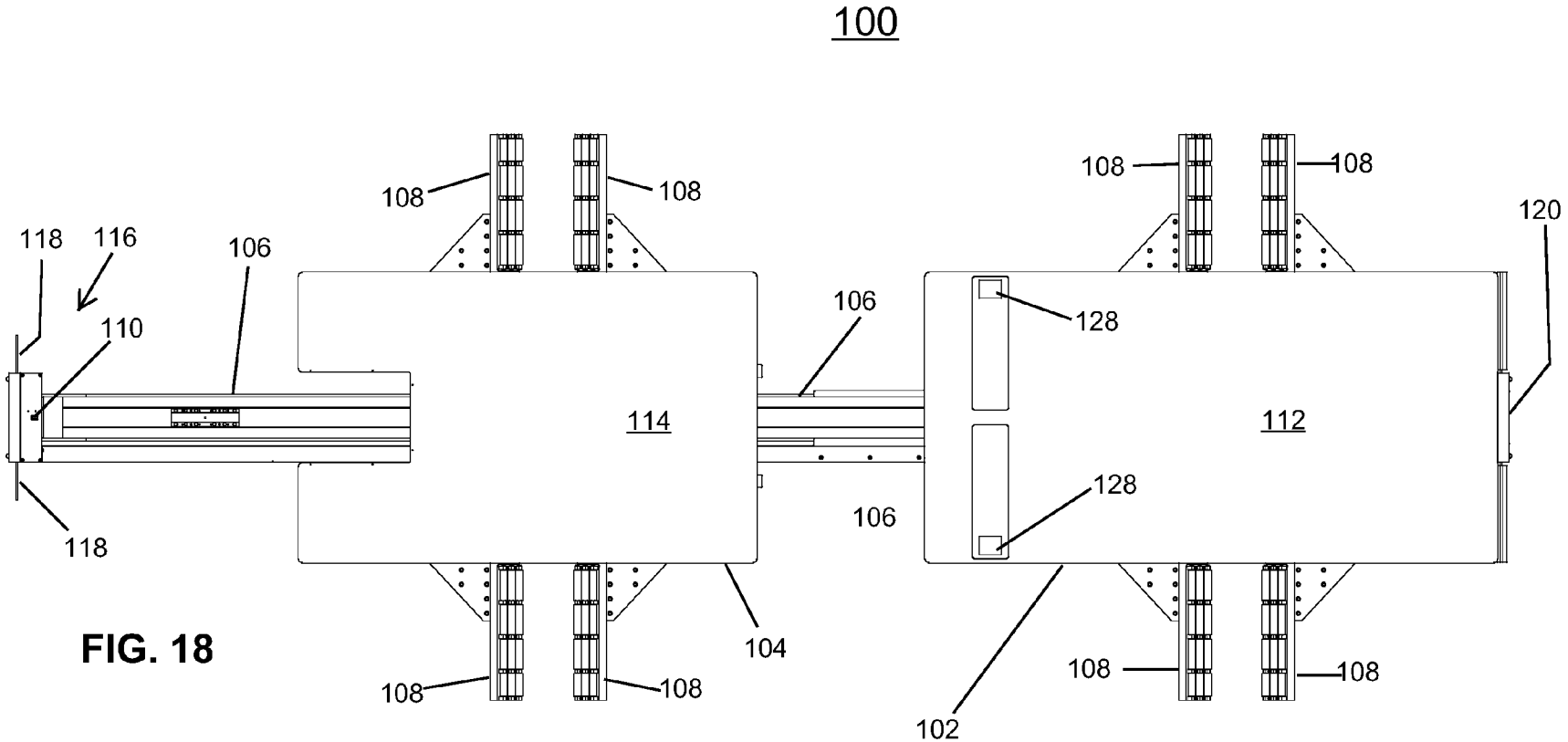
FIG. 18 is a top plan view of a vehicle satellite shown with its grippers in an extended configuration.
Figure 30:
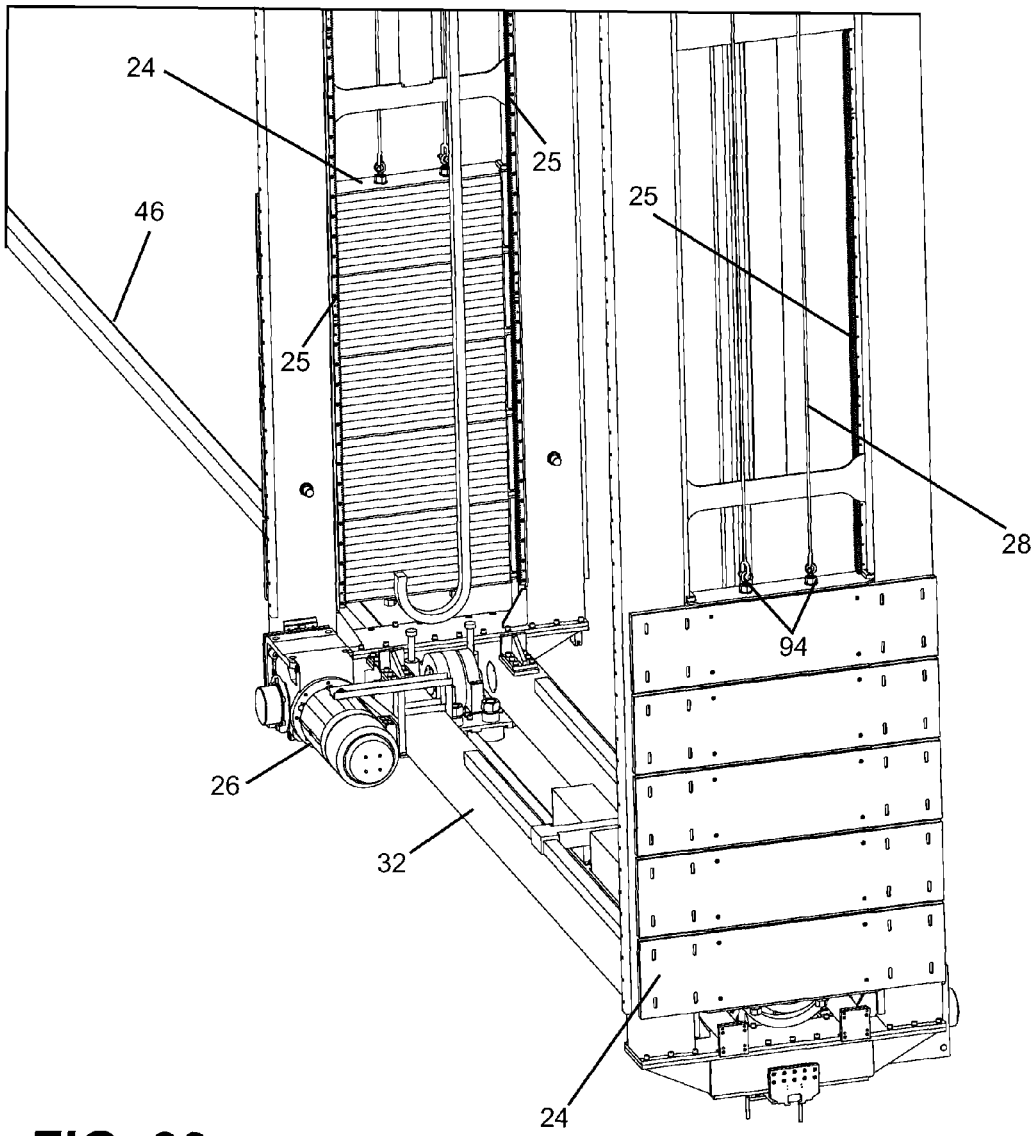
FIG. 30 is a perspective view of a lower portion of the vehicle crane of FIG. 1.
Figure 31:
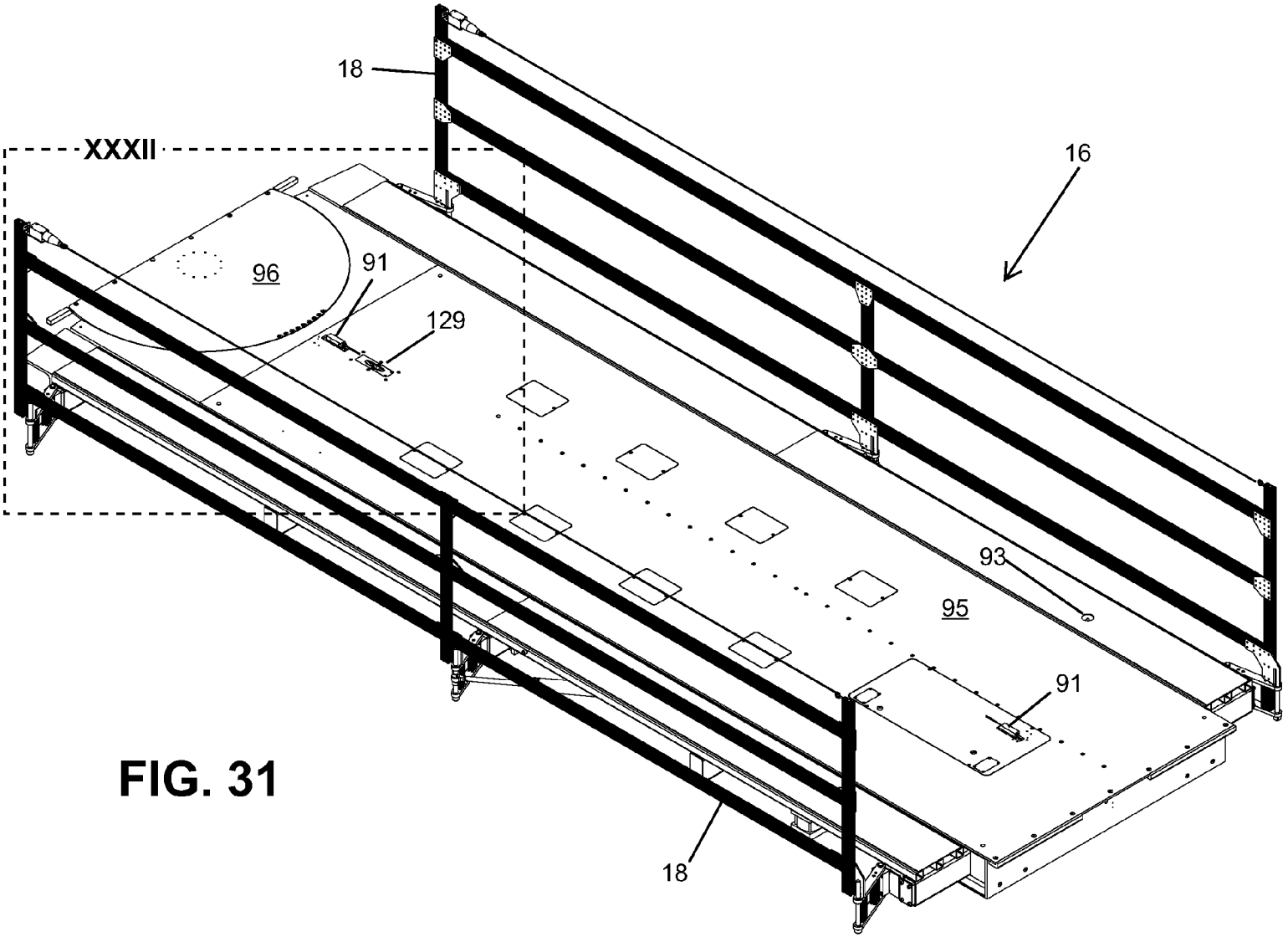
FIG. 31 is a perspective view of a vehicle carriage platform of one of the vehicle carriage assemblies of FIG. 25, and similar to the carriage platform of FIG. 17.
Figure 32:
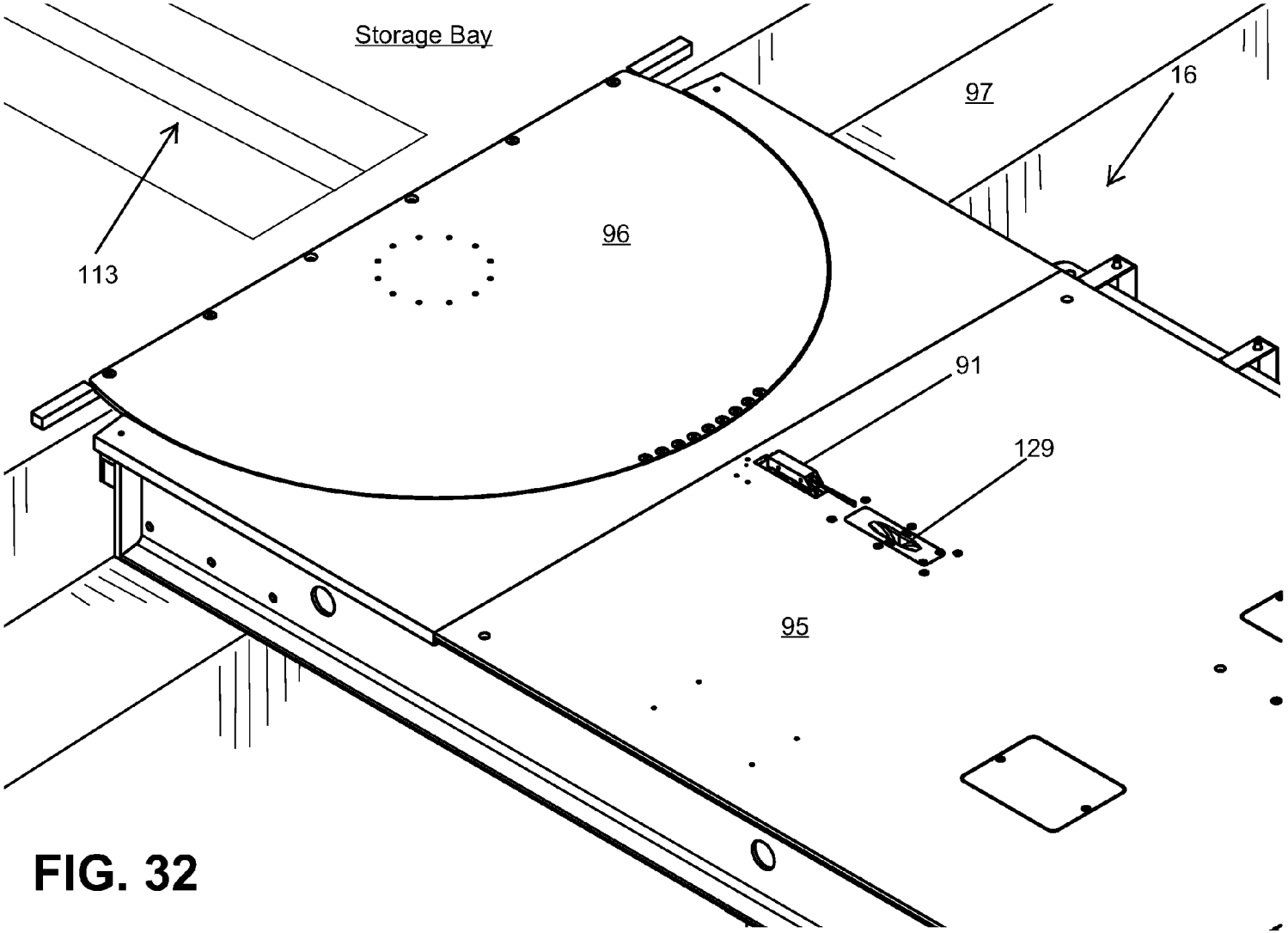
FIG. 32 is an enlarged view of the region designated XXXII in FIG. 31, shown with the rails and edge portions of the carriage platform removed for clarity, and with the platform positioned at the edge of a vehicle storage area.
Figure 33:
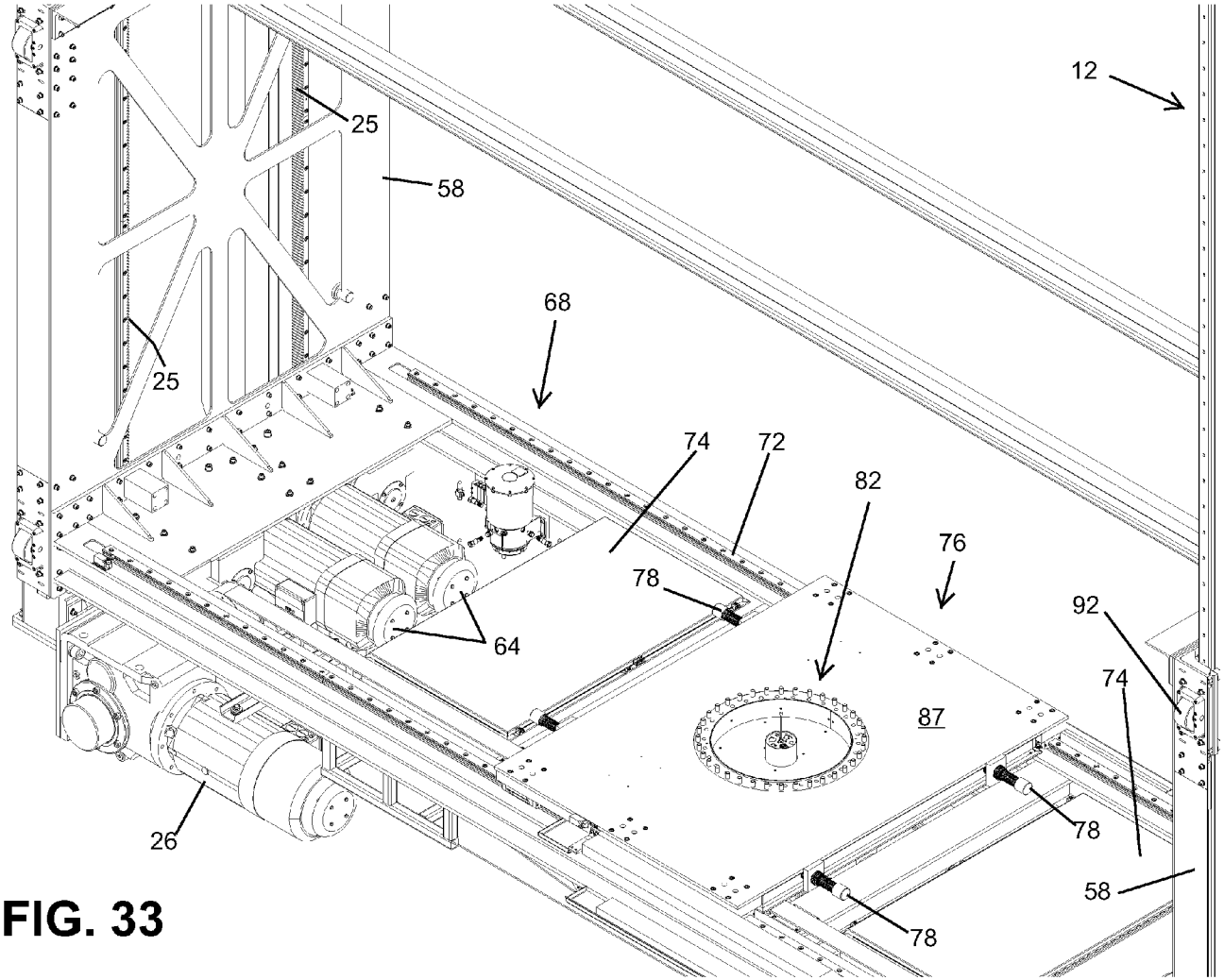
FIG. 33 is a perspective view of a portion of the vehicle carriage base and vehicle crane, shown with the vehicle carriage platform removed.

Vehicle carriage assembly 14 includes a pair of upper braces 54 and a pair of lower braces 56 that are parallel to each other and which cooperate with upstanding side members 58 to form a generally box-like carriage frame 60 (FIGS. 9-11). Two pair of motors 64, 66 are disposed at respective outboard end portions of lower braces 56, which cooperate to form a carriage base 68. The drive motor pairs 64, 66 are each individually associated with respective pinions 64', 66' (FIG. 12), which engage vertical toothed tracks 25 (in a rack-and-pinion arrangement) that are disposed along respective end pairs of masts 22 of crane assembly 12 (FIGS. 30 and 33). Thus, drive motors 64, 66 are operable drive carriage assembly 14 up and down along crane 12 via engagement of pinions 64', 66' with respective toothed tracks 25. Thus, motors 64, 66 (also referred to as "Z-drive motors") are used to move the carriage assembly 14 in a vertical direction along a Z-axis, such as shown in FIG. 15.

Figure 16:
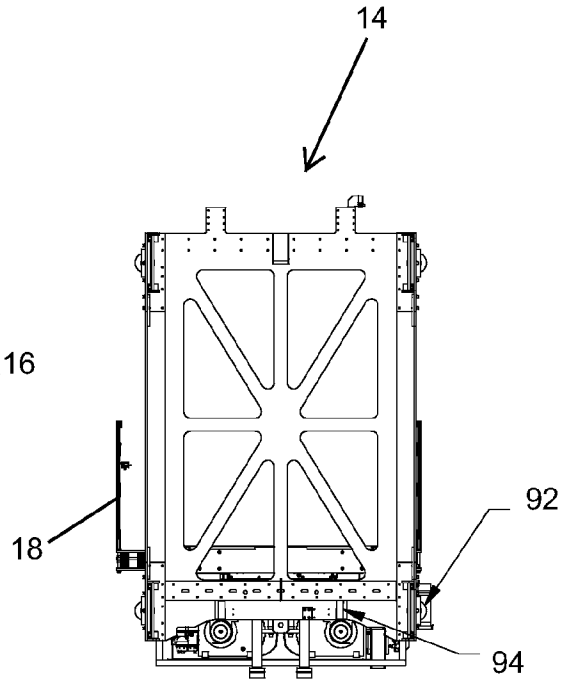
FIG. 16 is an end elevation of the vehicle carriage assembly, opposite that of FIG. 10.

Carriage assembly 14 further includes Z-guide wheels 92 (FIG. 16) for contacting masts 22 to thereby guide the carriage assembly 14 as it moves up and down along crane assembly 12. Counterbalance cable mounts 94 (FIGS. 6 and 16) receive cables 28, which enables counterweights 24 to substantially offset the weight of carriage assembly 14 and a vehicle positioned thereon. This reduces the power required of Z-drive motors 64, 66 to raise the carriage assembly 14. Two carriage control panels 74 (FIGS. 12, 27, 28 and 33) are also disposed within the carriage base 68, between lower braces 56, such that the carriage controls (located below panels 74) travel with the carriage 14 as it moves along crane assembly 12.

Figure 14:
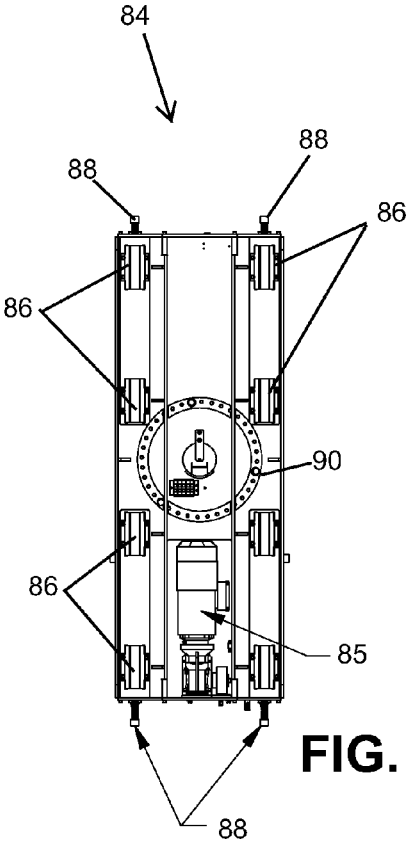
FIG. 14 is a top plan view of a second vehicle carriage skate for moving the vehicle platform of the vehicle carriage assembly in a lateral direction along the vehicle carriage assembly base.

Vehicle support platform 16 is movably mounted to the carriage frame 60 via a first vehicle carriage skate or "X-skate" 76 (FIG. 13), which is capable of traveling the full length of carriage base 68 along the X-axis, and a second vehicle carriage skate or "Y-skate" 84 (FIG. 14), which is coupled between X-skate 76 and the underside of platform 16 and is capable of moving platform along the Y-axis, relative to X-skate 76 and carriage frame 60, as will be described in more detail below. A belt drive motor or "X-belt drive motor" 70 (FIG. 12) is provided for moving the platform 16 in the longitudinal (X-axis) direction by urging X-skate 76 along a pair of rails 72 mounted atop respective lower braces 56 of the carriage 14. X-skate 76 includes four shocks 78 disposed on opposite sides of the X-skate, for absorbing any impact of X-skate 76 with either upstanding side member 58 of vehicle carriage frame 16 in case of an inadvertent overrun of the X-skate, without damage to the carriage 14. X-skate 76 further includes linear bearings 80, which are supported on respective rails 72 of the carriage base 68, such as shown in FIGS. 11, 13, 28 and 33. A slewing drive 82 is coupled to X-skate 76 and is operable to rotate the platform 16 about a substantially vertical rotational axis, also described herein as the Z-axis.

Figure 17:
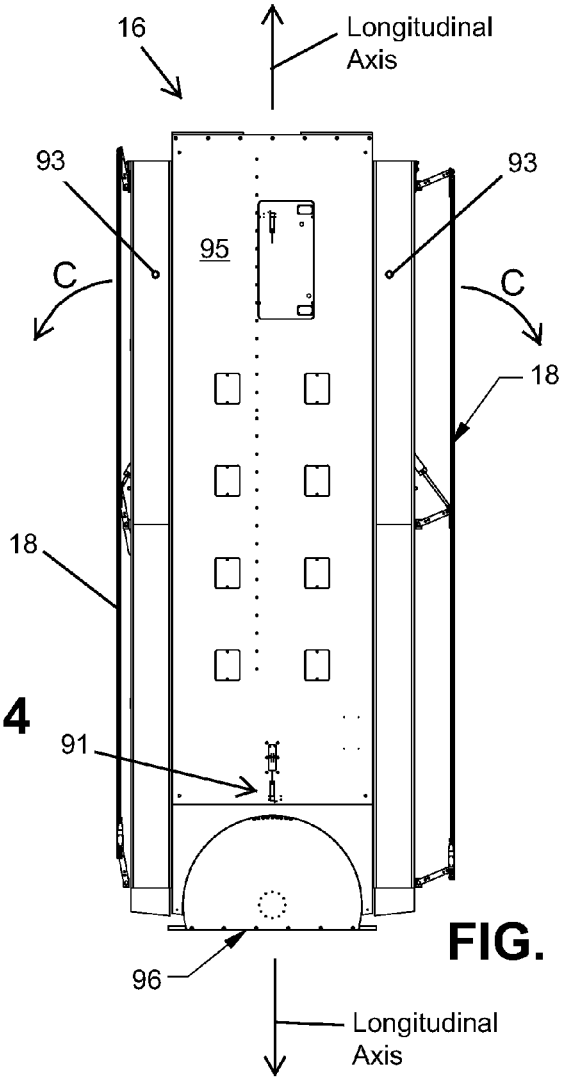
FIG. 17 is a top plan view of a carriage platform of the vehicle carriage assembly, with the carriage platform oriented in the same manner as shown in FIG. 11D.

A drive motor or "Y-travel motor" 85 (FIG. 14) is provided for moving platform 16 in the lateral (Y-axis) direction by driving Y-skate 84 relative to X-skate 76. Y-skate 84 has linear bearings 86 that engage and move along an upper surface 87 of X-skate 76, and is equipped with shocks 88 in case of inadvertent overrun of Y-skate 84. The Y-skate 84 further includes a mount 90 that couples the Y-skate 84 to the slewing drive 82 of the X-skate 76. The linear bearings 86 and shocks 88 of the Y-skate 84 are oriented in the same manner as identified on the X-skate 76, but for use along the Y-axis lateral direction of travel (FIG. 17). Because Y-travel motor 85 is capable of moving platform 16 along the Y-axis when the longitudinal axis of the platform 16 is oriented parallel to the Y-axis, Y-travel motor 85 is also capable of moving platform in the longitudinal direction (along the X-axis) when the platform 16 is oriented parallel to the X-axis. It may be advantageous to use Y-travel motor 85 for shifting or moving platform 16 relative to X-skate when the platform is in-line or parallel with the X-axis, for example, such as to more evenly balance the load of the vehicle on X-skate and on carriage base 68 when the crane assembly 12 is in motion.

Figure 11A:
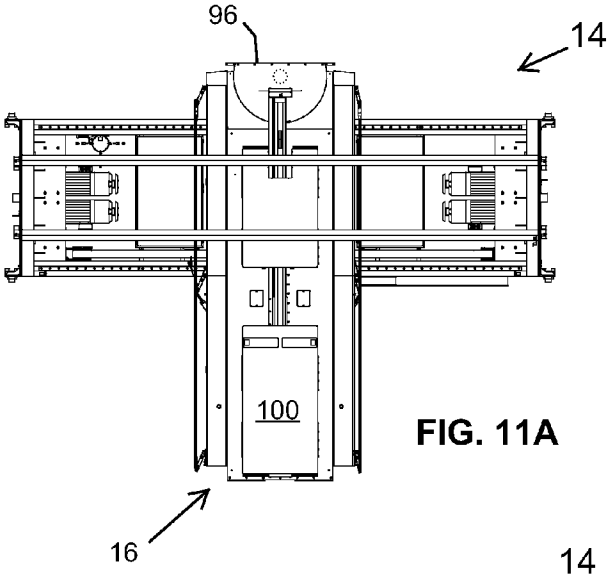
FIG. 11A is a top plan view of the vehicle carriage assembly of FIG. 9, with the platform and satellite oriented at 90-degrees relative to the vehicle carriage base for loading or unloading a vehicle at the platform.
Figure 11B:
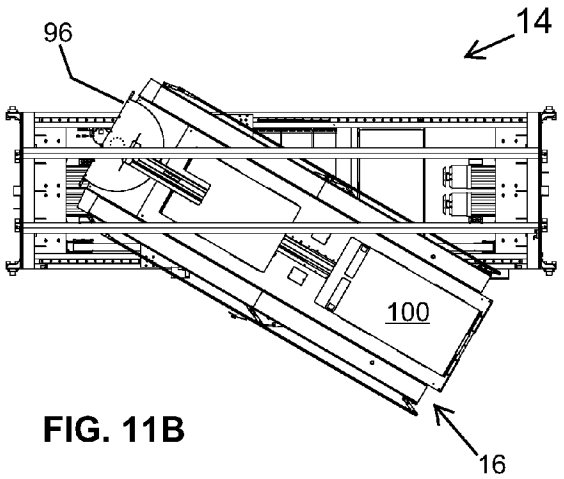
FIG. 11B is another top plan view of the vehicle carriage assembly of FIG. 9, with the platform and satellite rotated counterclockwise from the, orientation of FIG. 11A in preparation for moving a vehicle with the carriage assembly and crane.
Figure 11C:
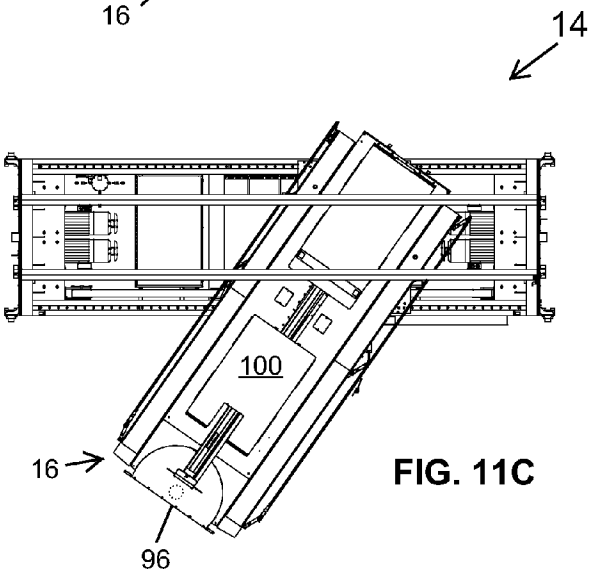
FIG. 11C is another top plan view of the vehicle carriage assembly of FIG. 9, with the platform and satellite rotated further counterclockwise from the orientation of FIG. 11B in preparation for loading or unloading a vehicle on an opposite side of the carriage assembly as shown in FIG. 11A.
Figure 11D:
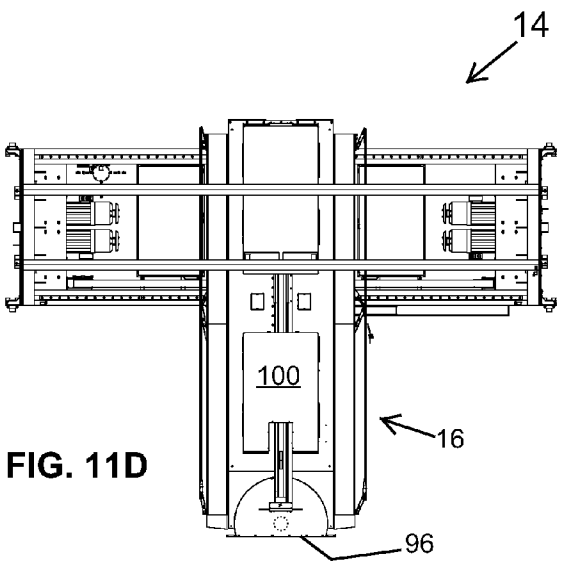
FIG. 11D is another top plan view of the vehicle carriage assembly of FIG. 9, with the platform and satellite rotated further counterclockwise from the orientation of FIG. 11C, and oriented 180 degrees from the orientation of FIG. 11A, in preparation for loading or unloading a vehicle.

Thus, vehicle support platform 16 is mounted to the Y-skate 84, which in turn is translatably and rotatably mounted to X-skate 76 via slewing drive 82 about the Z-axis, with X-skate 76 translatably supported on the carriage base 68, such as shown with reference to FIGS. 11A-11D and FIG. 15. Thus, vehicle support platform 16 is movable along the X-axis by X-skate, and when platform 16 is oriented in-line with the X-axis (as in FIGS. 9-11 and 15), Y-skate 84 is also capable of moving platform 16 along the X-axis, However, when platform 16 is perpendicular to X-axis, or at least non-parallel to X-axis, Y-skate is capable of moving the platform along the Y-axis, or at least with a Y-axis component to the movement of the platform, such as shown in FIGS. 11A-11D. It can now be more fully appreciated that platform 16 can be oriented and repositioned on carriage base 68 in a manner that permits vehicles to be offloaded and onloaded from different sides of the carriage assembly 14 (compare FIG. 11A to FIG. 11D), and that platform 16 may "reach" across an extended distance as needed, in a semi-cantilevered manner (FIG. 11D), such as to accommodate two separate crane assemblies and corresponding carriage assemblies working side-by-side, as will be described in more detail below. To achieve this motion of platform 16, X-skate 76, slew drive 82, and Y-skate 84 work in concert to reposition the platform as appropriate (such as shown in FIGS. 11B and 11C), without contacting the upstanding side members 58 of vehicle carriage frame 16. In addition, the controller 20 can operate the X-skate 76, slew drive 82, and Y-skate 84 of a first carriage assembly 14 in a coordinated manner with a second carriage assembly of an adjacent crane, to ensure that the adjacent crane will not impact (or be impacted by) the platform 16 of the first carriage assembly, and vice versa.

Platform 16 includes a substantially planar upper surface 95, a front end portion of which is formed by a rotatable platform nose 96 that is capable of pivoting about a vertical axis relative to the rest of the platform, such as shown with arrows C in FIG. 17. This movement of platform nose 96 relative to platform 16 occurs when platform is angled to align with a vehicle that is parked at an angle that is non-parallel with the Y-axis, such as shown in FIGS. 11G and 11H. Platform nose 96 is spring-biased to assume a centered alignment when nose 96 is not contacting another surface, such as shown in FIG. 17. In the illustrated embodiment, platform 16 includes a pair of vertically extendable lock pins 93 (FIGS. 17, 26-28 and 31) that are selectively raised at a location between a respective pair of extended tire-engaging grippers 108 when a vehicle-moving shuttle or satellite 100 is positioned and properly aligned on the platform, to substantially limit or prevent satellite 100 from sliding or translating along upper surface 95 of the platform as the crane assembly 12 and platform 16 are moved during vehicle storage and retrieval operations. Lock pins 93 are retracted below surface 95 when satellite 100 is to be moved onto or off of platform 16, such as during vehicle pick-up and drop-off operations. A pair of signal units in the form of pop-up lasers 91 are also extendable and retractable at upper surface 95 (FIGS. 17, 28, 29, 31 and 32), and are positioned substantially along the longitudinal centerline of platform 16, at front and rear portions thereof; to guide satellite 100 back onto the platform from either the P&D Bay or a storage bay, as will be described in more detail below. Pop-up lasers 91 are generally retracted into upper surface 95 except when satellite is off of platform 16, or when satellite is returning onto the platform.

Figure 11E:
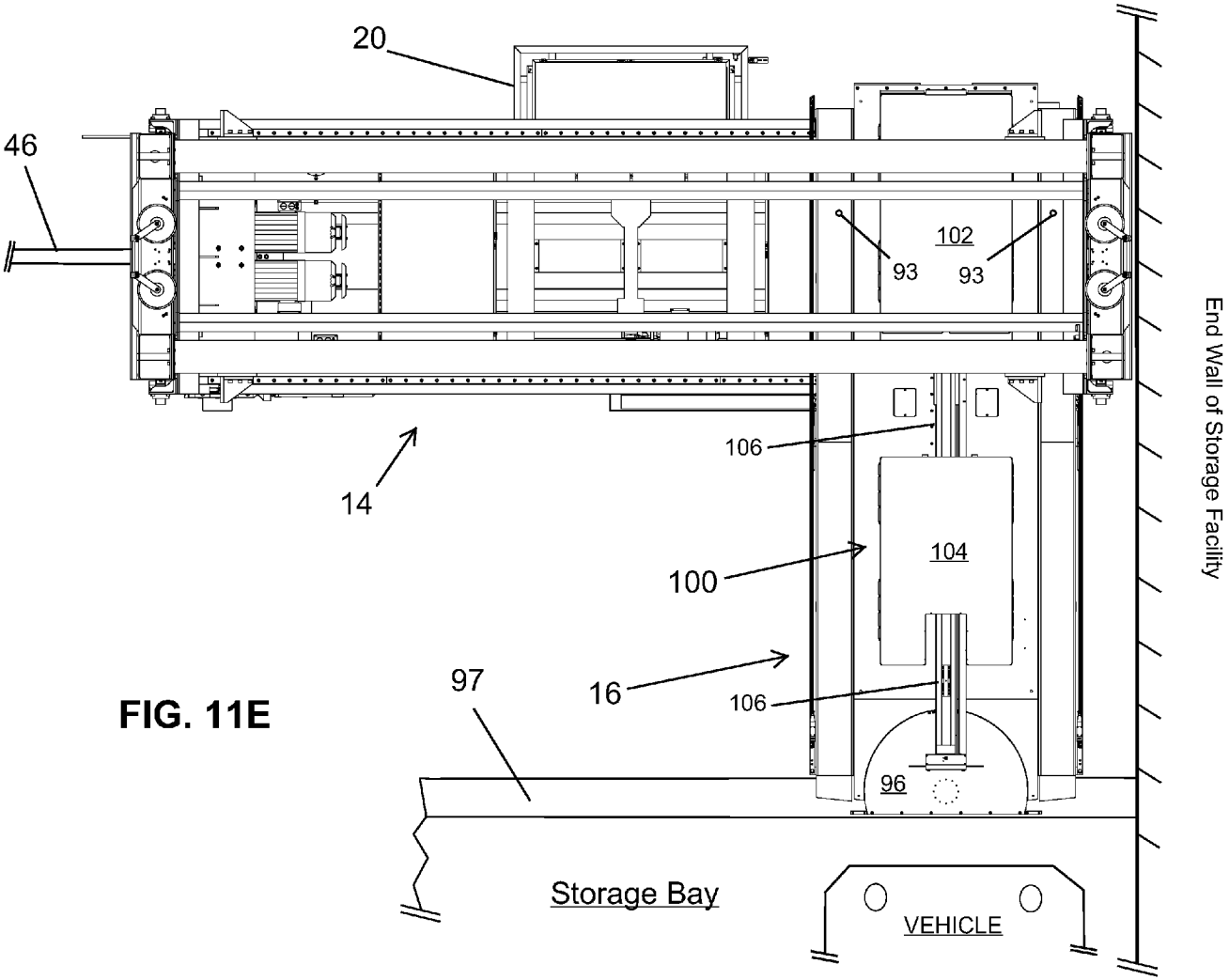
FIG. 11E is another top plan view of the vehicle carriage assembly of FIG. 11D, with the platform positioned at the end of the carriage assembly on a crane at the end of a storage facility.
Figures 11F, 11G, 11H:
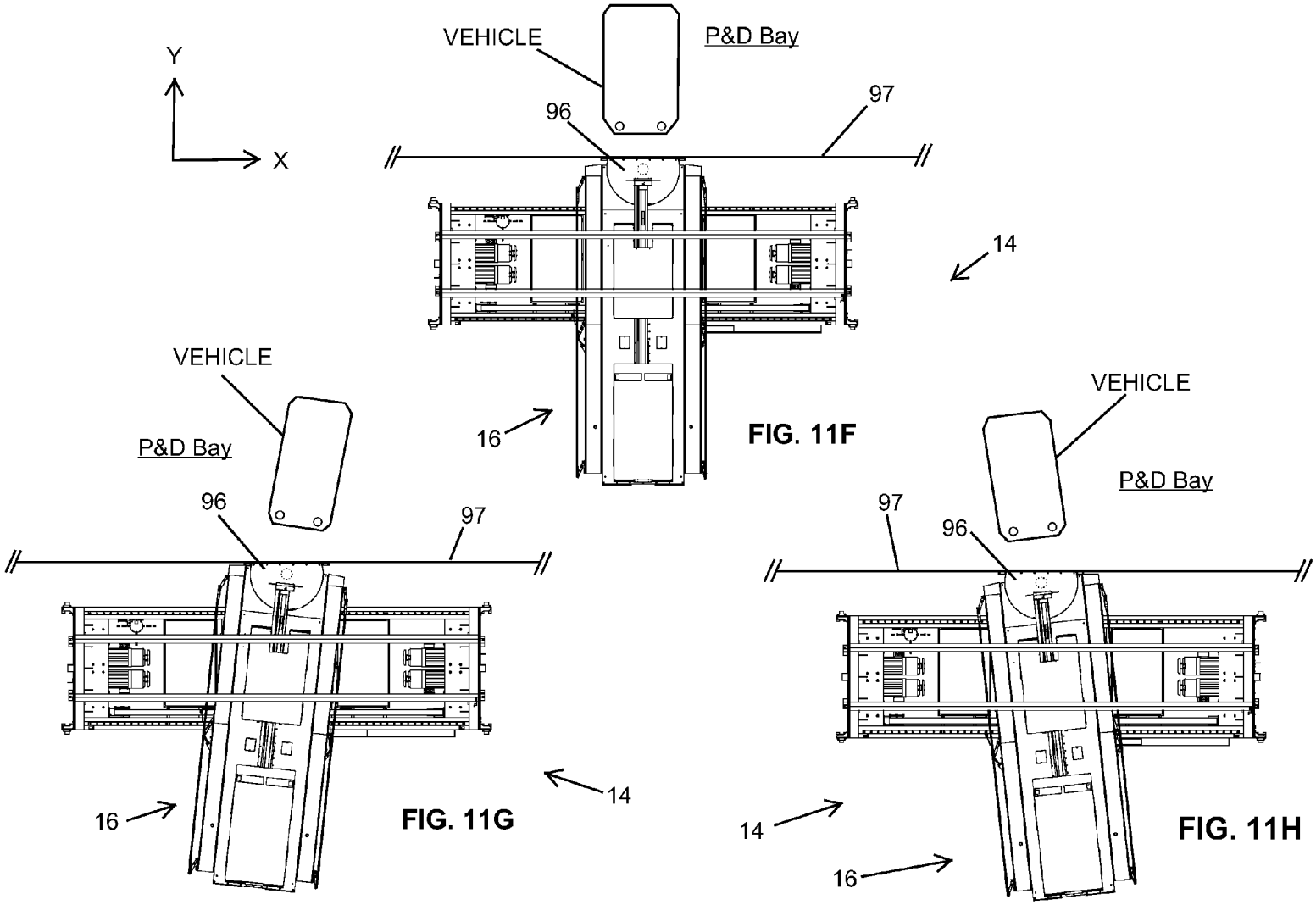
FIG. 11F is another top plan view of the vehicle carriage assembly of FIG. 11A, shown adjacent a vehicle pick-up and drop-off area with a vehicle and the vehicle carriage platform shown oriented perpendicular to the vehicle carriage base.
FIG. 11G is another top plan view similar to that of FIG. 11F, shown with the vehicle angled counterclockwise from perpendicular, with the vehicle carriage platform oriented to match the vehicle orientation.
FIG. 11H is another top plan view similar to that of FIG. 11F, shown with the vehicle angled clockwise from perpendicular, with the vehicle carriage platform oriented to match the vehicle orientation.
Figure 13:
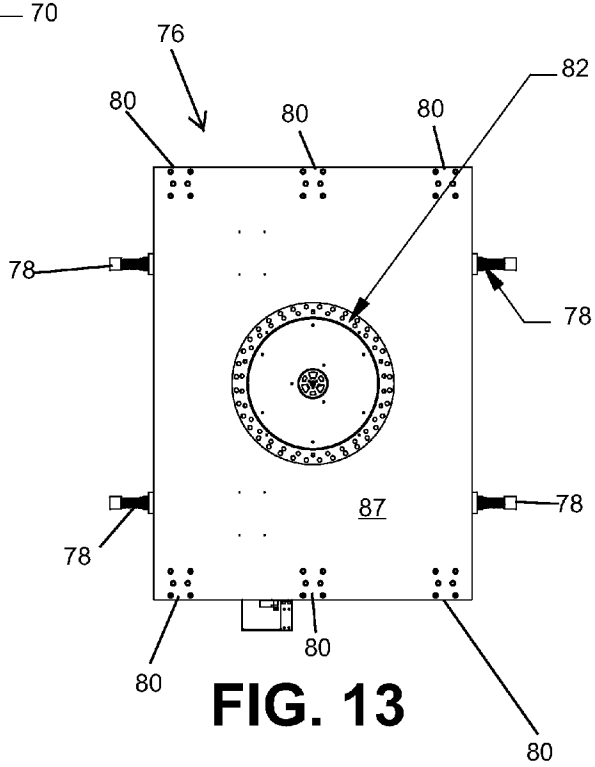
FIG. 13 is a top plan view of a first vehicle carriage skate for moving a vehicle platform of the vehicle carriage assembly in a longitudinal direction along the carriage assembly base.

Platform nose 96 maintains its centered alignment when platform 16 is urged against a surface that is perpendicular to the longitudinal axis of platform 16, such as shown in FIG. 11E. However, when platform 16 is oriented at an angle that is non-parallel with Y-axis, such as for receiving a vehicle that is parked in P&D Bay at a non-parallel angle relative to Y-axis (FIGS. 11G and 11H), platform nose 96 will pivot relative to the main part of platform 16 as it is urged into contact with an edge 97 of P&D Bay. For example, platform nose 96 may be configured to pivot or slew within a range of about six degrees left or right of center, to accommodate vehicles that are parked at up to about six degrees from parallel with the Y-axis. This helps ensure that satellite 100 has a solid and smooth transition from platform 16 to P&D Bay, without gaps (between platform nose 96 and edge 97) that could affect the stability and load-bearing ability of the satellite 100 as it moves onto and off of platform 16, which movement will be describe in more detail below. Of course, it will be appreciated that the platform nose could be designed to rotate more than about six degrees from center, if desired, without departing from the spirit and scope of the present invention.

Referring now to FIGS. 18-20, 23, 24A and 24B, satellite assembly 100 is a substantially self-contained unit with a primary section 102 and a secondary section 104 that are coupled together in an adjustable arrangement via a linearly extendable and retractable satellite spine 106. The primary section 102 and secondary section 104 are adjustable relative to each other along a longitudinal axis of satellite assembly 100. In the illustrated embodiment, satellite assembly 100 is a separate assembly that is expandable, adjustable, and self-guiding, and is coupled to carriage assembly 14 only by a power and/or data cable 105 (FIGS. 38D and 38E) that is attached to platform 16, as will be described in more detail below.

Primary section 102 and secondary section 104 each includes two pair of tire-engaging grippers 108, with two grippers 108 mounted on each side of the primary section 102 and on each side of the secondary section 104. Although satellite 100 is generally shown and described with primary section 102 engaging a vehicle's front wheels and secondary section 104 engaging the vehicle's rear wheels, it will be appreciated that the satellite may be oriented so that either section of the satellite will engage the vehicle's front or rear wheels. Grippers 108 are pivotably coupled to their respective sections, such that the grippers can be opened or extended to a tire-engaging position (FIGS. 18, 22, 23, 24A, 38D and 38H), and can be closed or retracted to a disengaging position (FIGS. 19-21, 24B, 38*a*, 38C and 38E-G). Primary section 102 and secondary section 104 further comprise respective covers 112 and 114, such as shown in FIGS. 18, 19, 24A and 24B, which are removable to provide access to the mechanical components of satellite 100, such as shown in FIG. 23. In the illustrated embodiment, satellite assembly 100 is configured to move generally in a longitudinal direction along its (and the vehicle platform's) longitudinal axis. However, satellite assembly 100 is also configured to also be steerable and/or maneuverable in a lateral direction, as will be described in more detail below.

Figure 19:
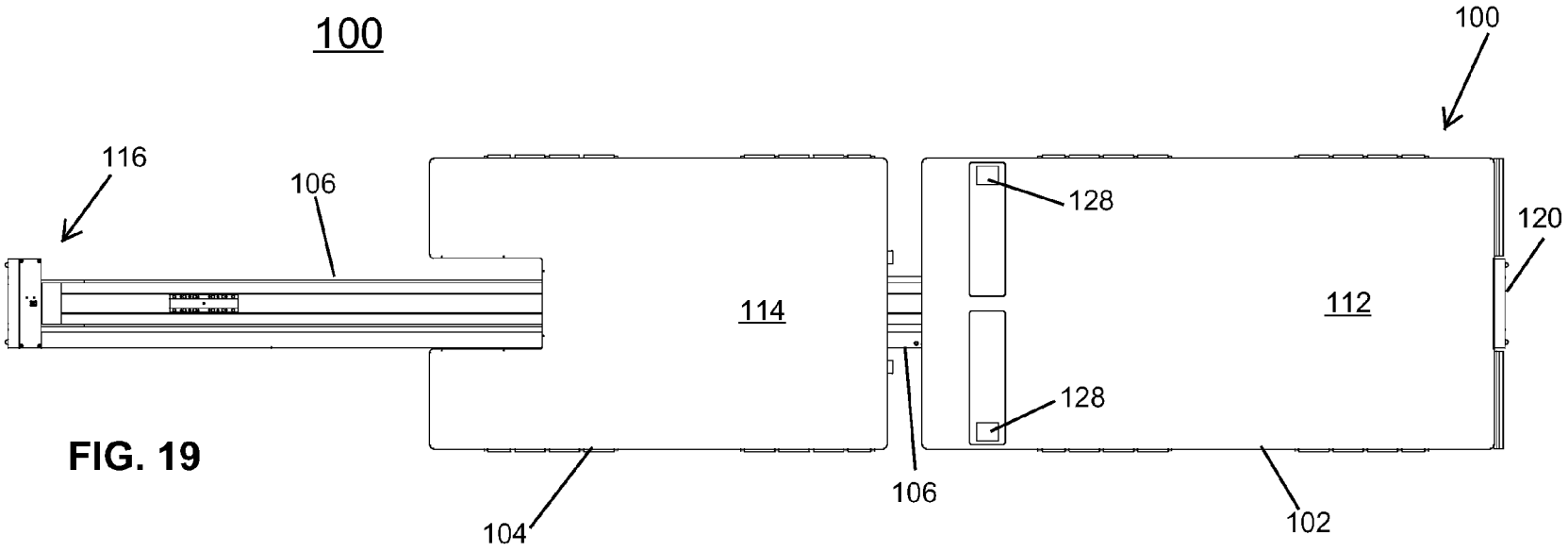
FIG. 19 is another top plan view of the vehicle satellite of FIG. 18, shown with the grippers in a retracted configuration.
Figure 20:
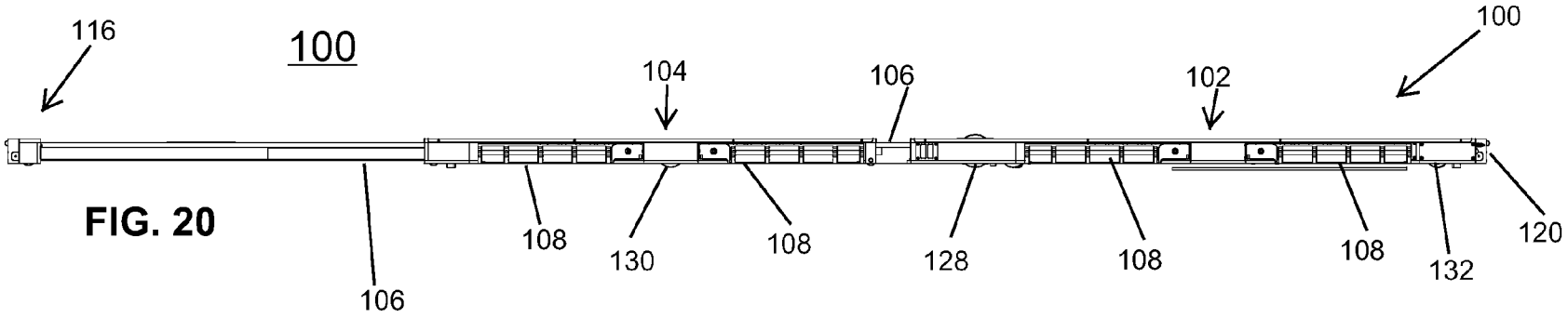
FIG. 20 is a side elevation of the vehicle satellite of FIG. 19.
Figure 21:
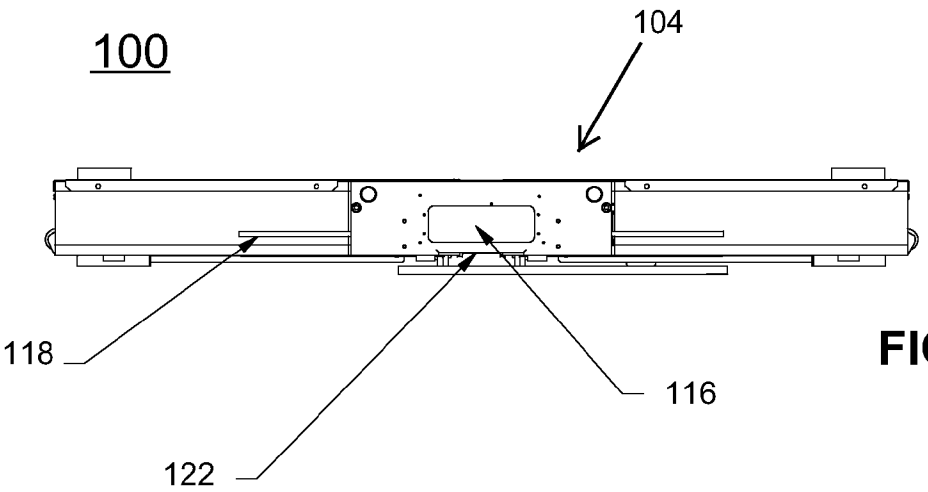
FIG. 21 is a front end elevation of the vehicle satellite of FIG. 19.

Disposed on one end of the spine 106, extending forwardly of secondary section 104, is a front sensor array 116. As shown in FIGS. 19-21, the front sensor array 116 (or "front sensor package") includes an upwardly-directed sensor 110 for detecting the presence and location of a vehicle's front and rear ends as sensor an-ay 116 passes beneath the vehicle. Front sensor array 116 further includes a plurality of side-facing sensors 118 for detecting the locations of the front and rear tires of the vehicle as sensor array 116 passes beneath the vehicle, and includes a downwardly-directed line-scanning sensor (not shown) to help guide satellite assembly 100 back to platform 16 from P&D Bay or a storage bay, as will be described below.

Figure 22:
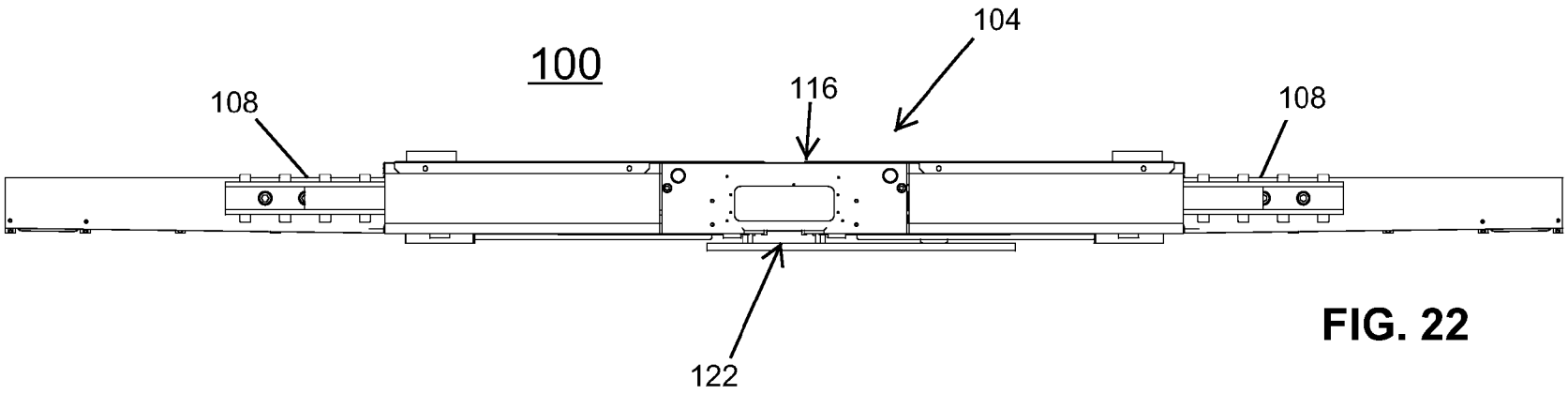
FIG. 22 is another front end elevation of the vehicle satellite of FIG. 18.
Figure 23:
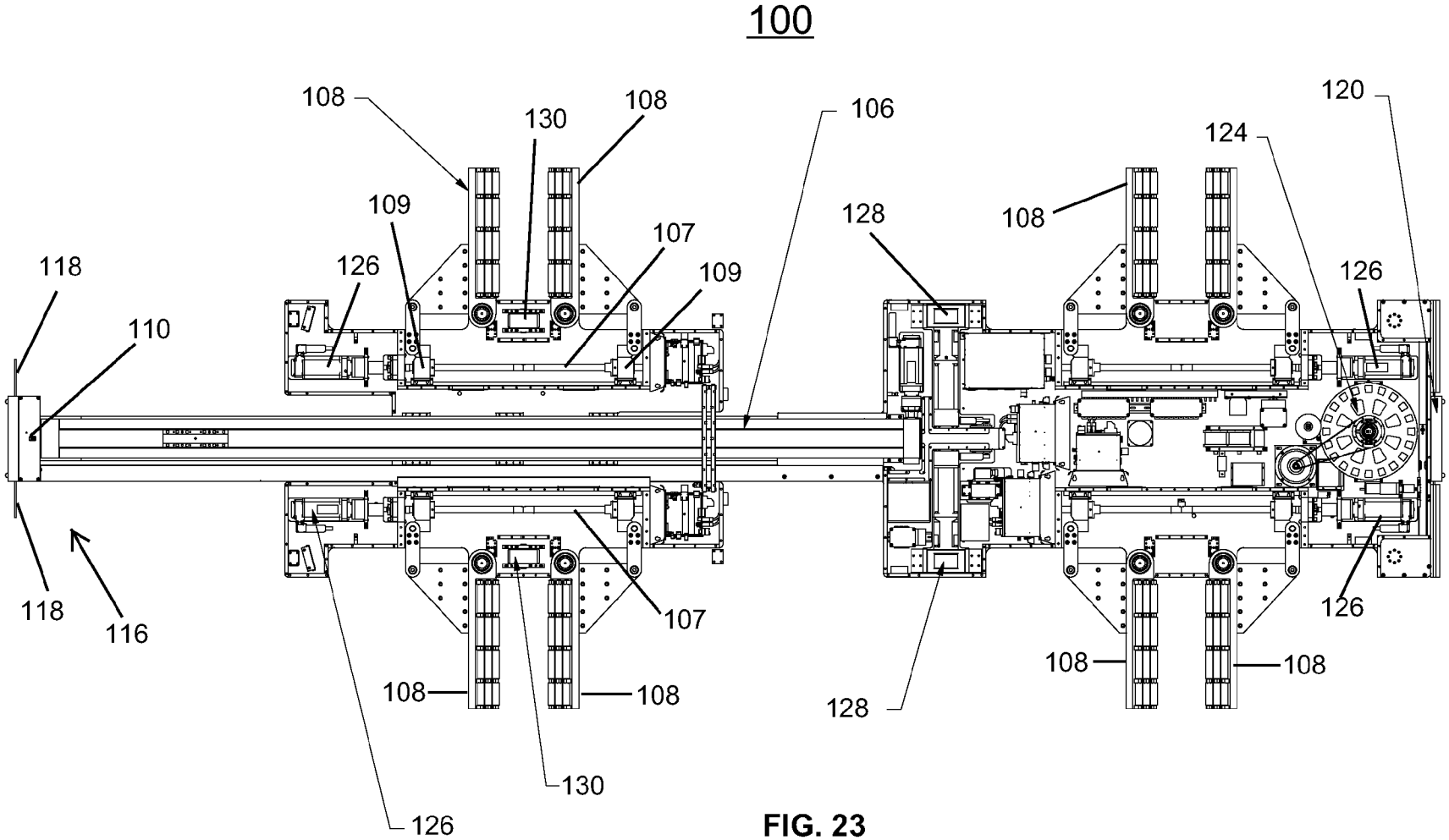
FIG. 23 is another top plan view of the vehicle satellite of FIG. 18, shown with its cover panels removed for clarity.
Figure 38A:
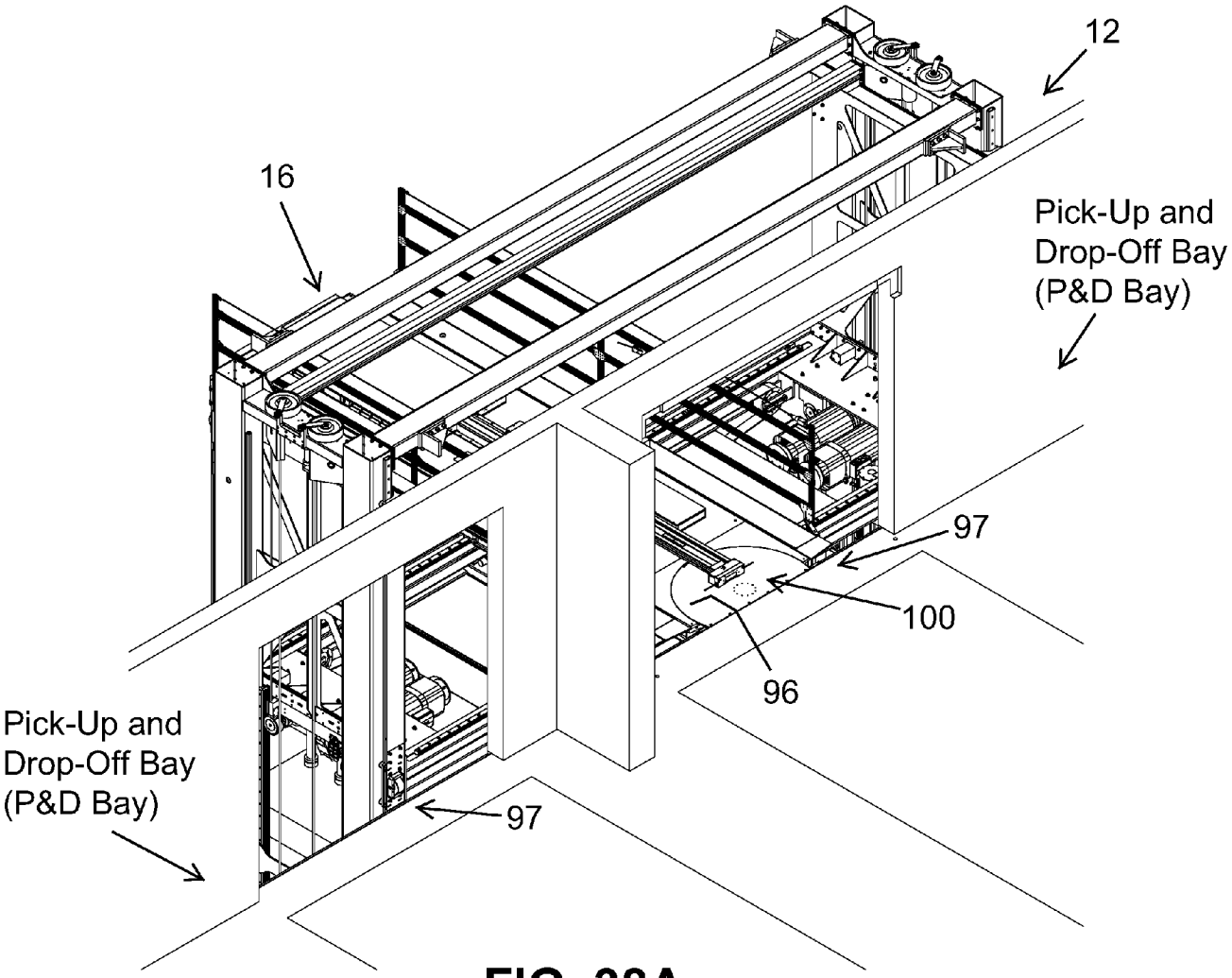
FIG. 38A is a perspective view of a crane and vehicle carriage assembly positioned at one pick-up and drop-off bay of a multi-bay parking facility, shown prior to arrival of a vehicle and with the service doors omitted for clarity.
Figure 38B:
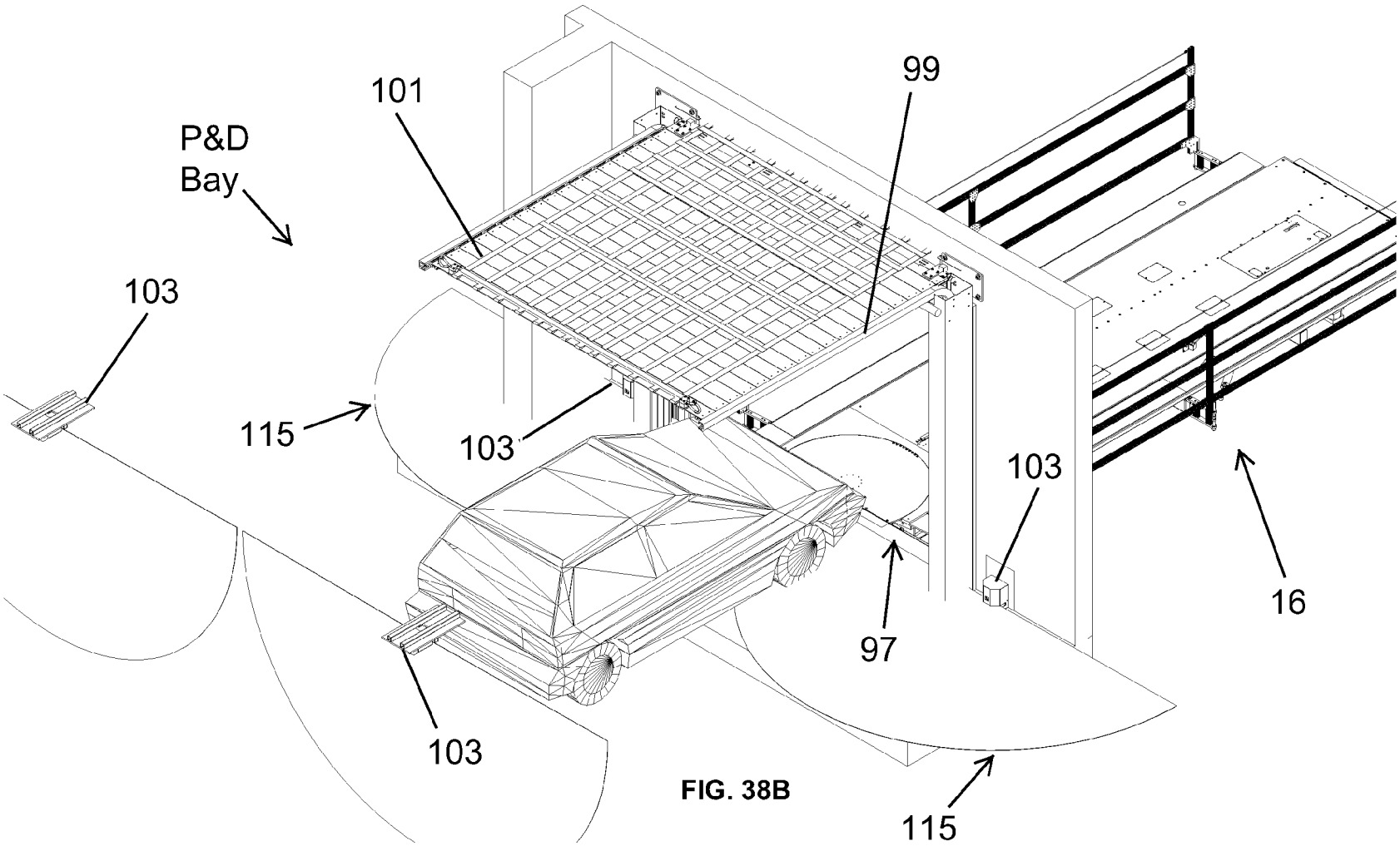
FIG. 38B is another perspective view of the pick-up and drop-off bay having a vehicle positioned therein, shown prior to pick-up of the vehicle by a vehicle carriage assembly, and with sensors in operation to detect the presence and location of the vehicle.
Figure 38C:
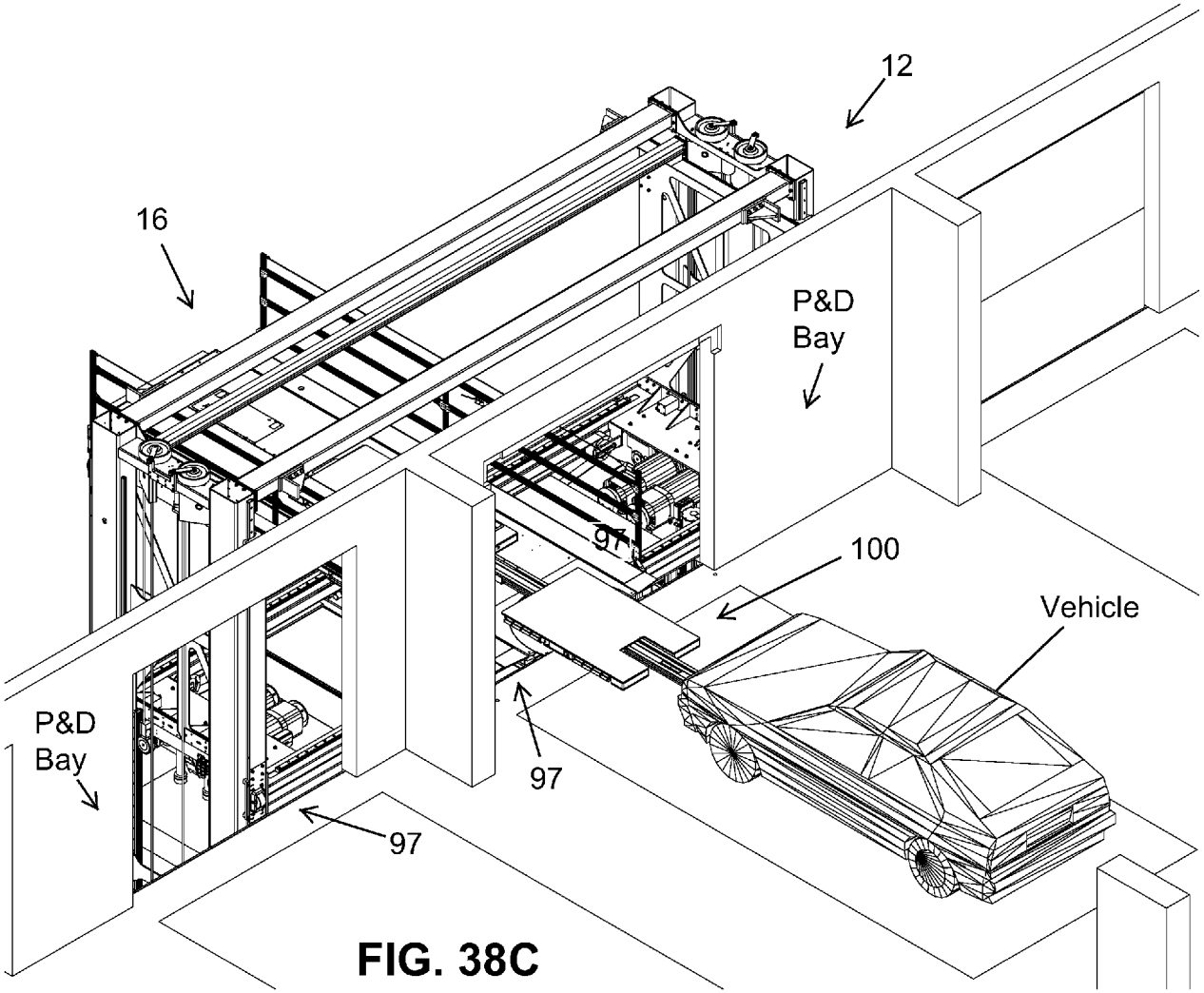
FIG. 38C is another perspective view of the crane and vehicle carriage assembly at the pick-up and drop-off bay, shown with a satellite partially deployed into the pick-up and drop-off bay from the platform of the vehicle carriage assembly.
Figure 38D:
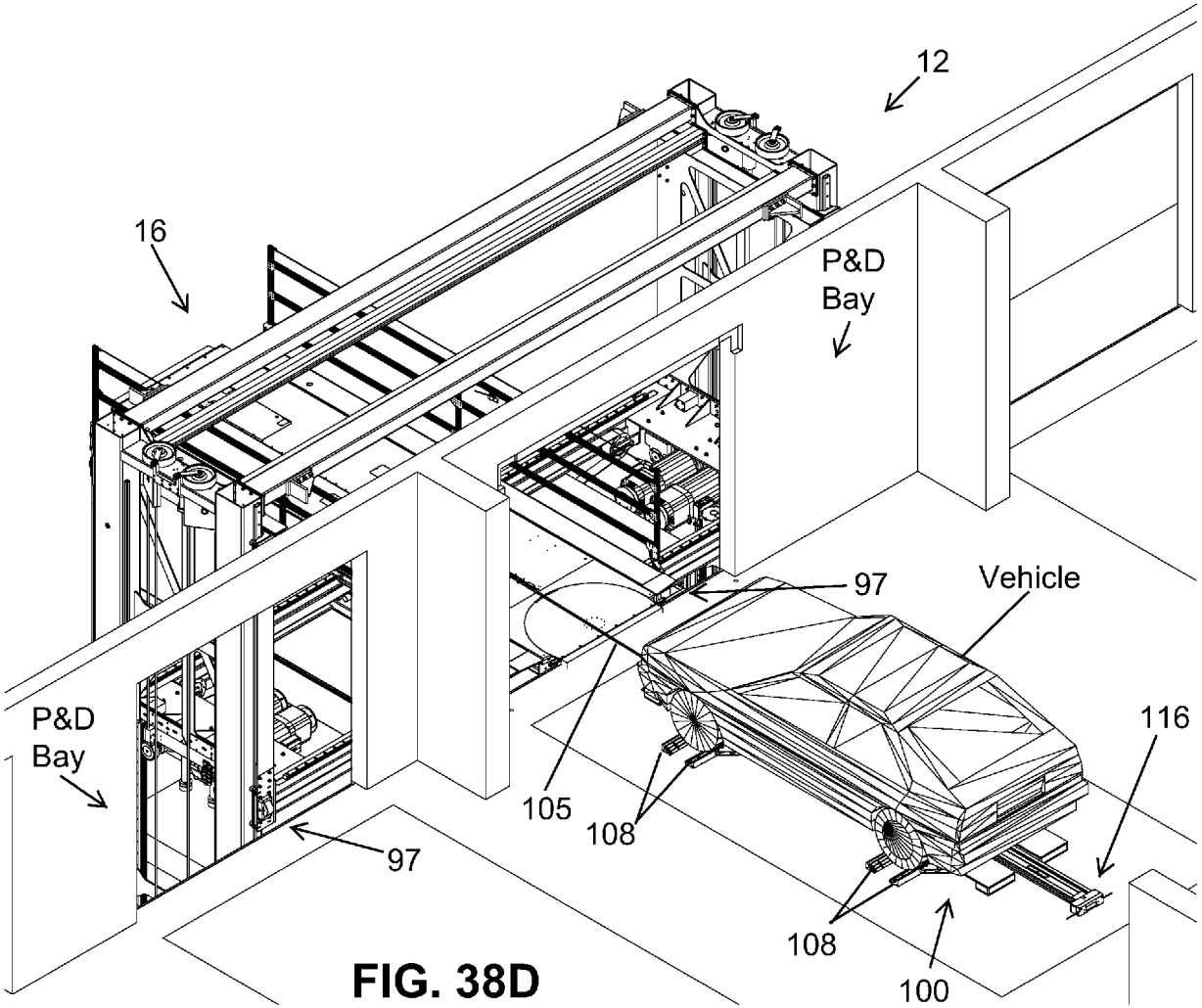
FIG. 38D is another perspective view of the crane and vehicle carriage assembly at the pick-up and drop-off bay, shown with a satellite fully deployed under the vehicle in the pick-up and drop-off bay, prior to moving the vehicle onto the platform of the vehicle carriage assembly.
Figure 38E:
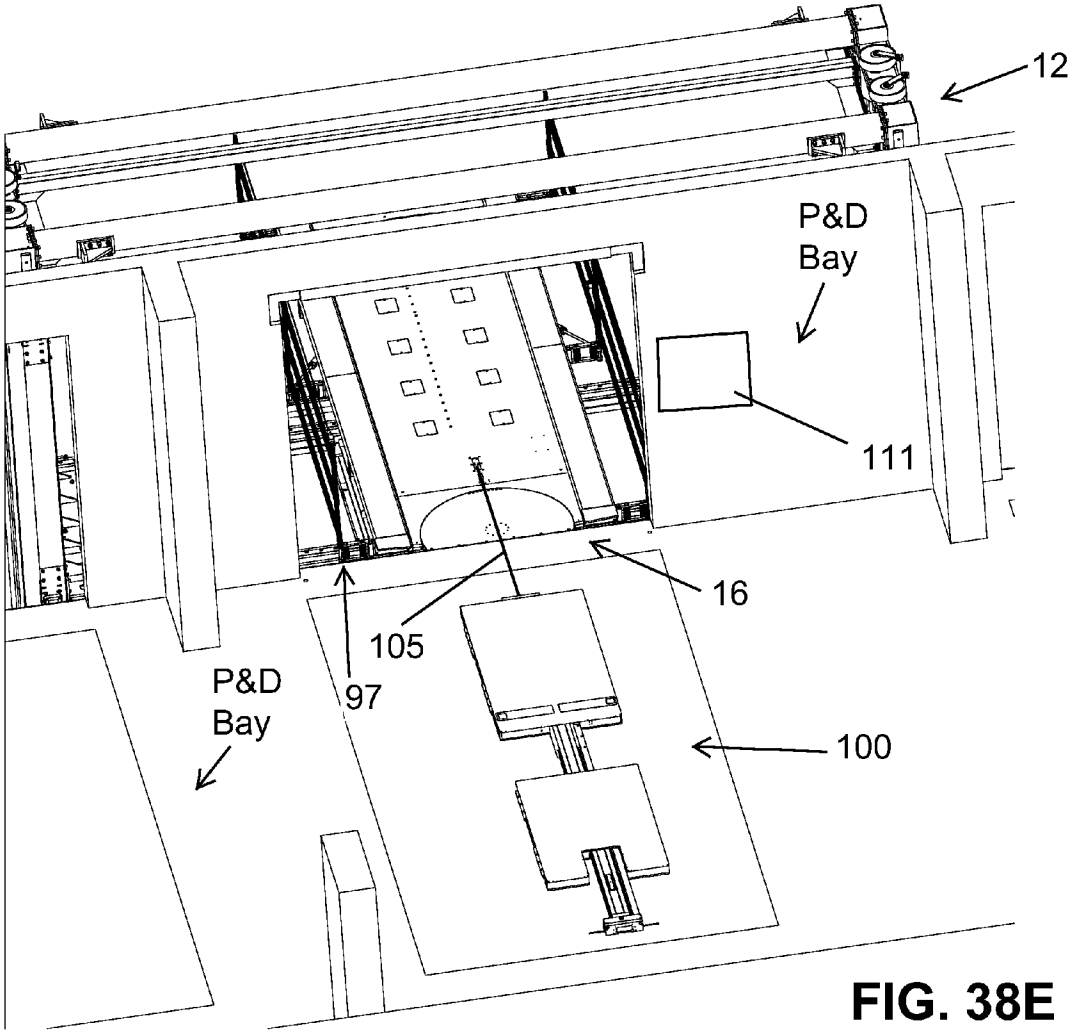
FIG. 38E is another perspective view of the crane and vehicle carriage assembly at the empty pick-up and drop-off bay, shown with the satellite deployed into the pick-up and drop-off bay and prior to extension of the tire-engaging grippers of the satellite.
Figure 38F:
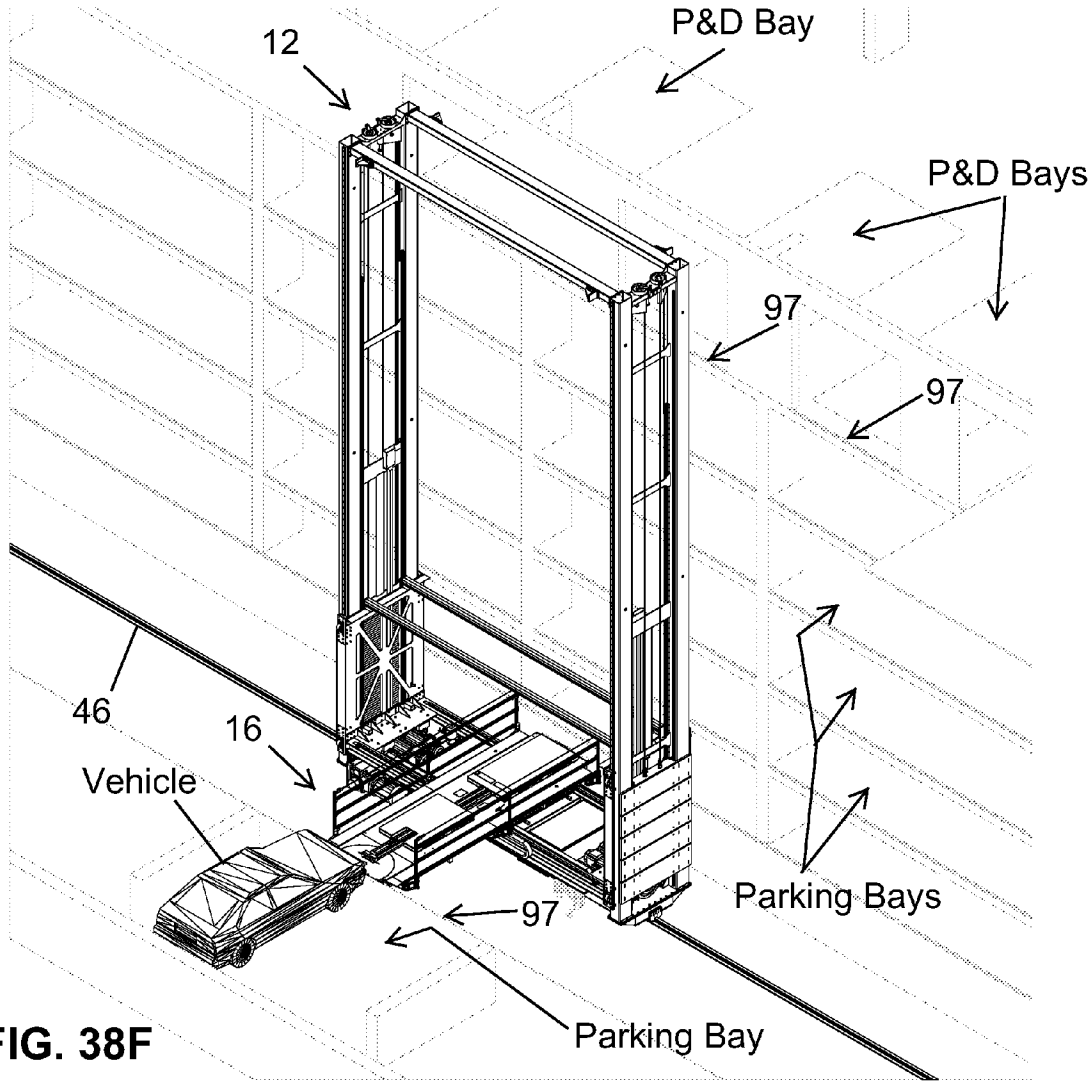
FIG. 38F is a perspective view of the crane and vehicle carriage assembly at a vehicle storage bay, shown with the vehicle carriage platform positioned for pick-up of a vehicle in the storage bay.
Figure 38G:
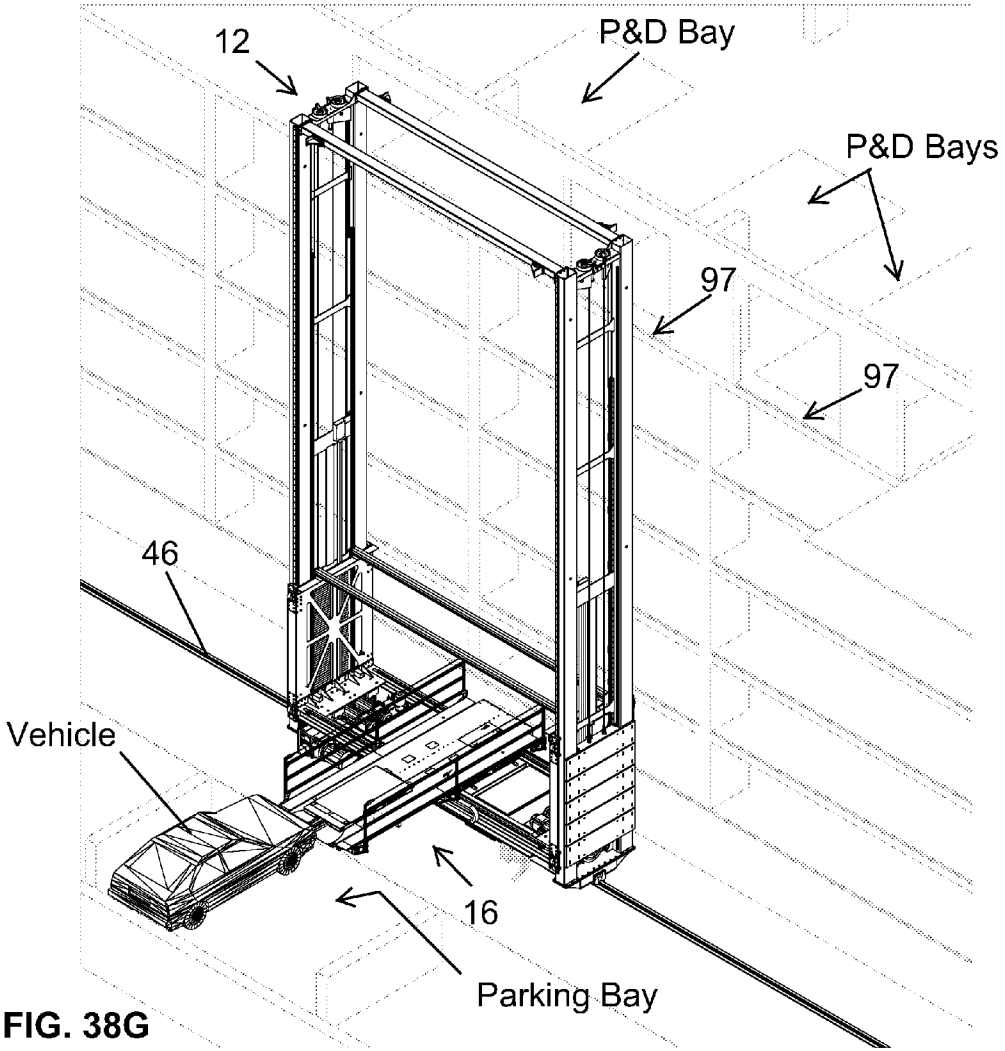
FIG. 38G is another perspective view of the crane and vehicle carriage assembly at the vehicle storage bay as in FIG. 38F, shown with the satellite partially deployed into the storage bay for pick-up of the vehicle.
Figure 38H:
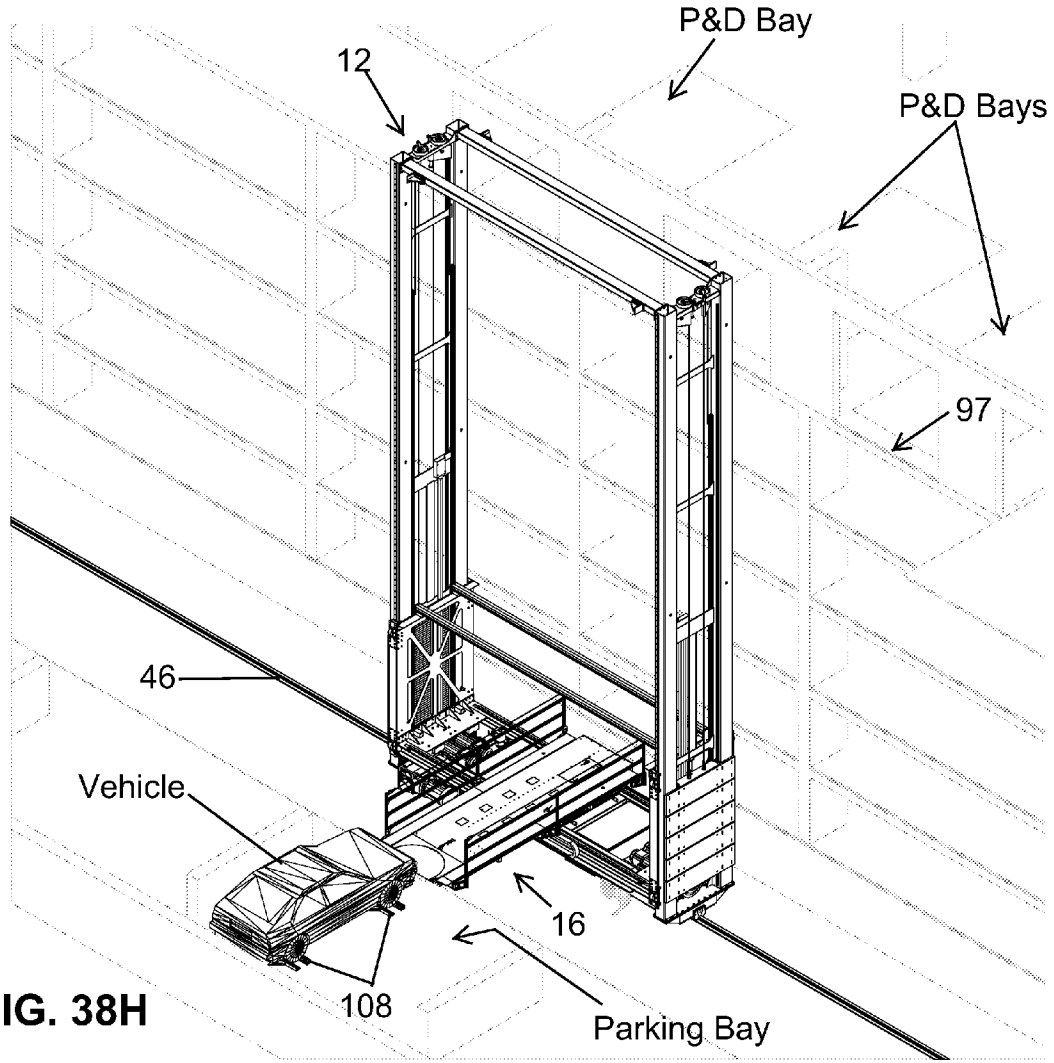
FIG. 38H is another perspective view of the crane and vehicle carriage assembly at the vehicle storage bay as in FIG. 38F, shown with the satellite fully deployed into the storage bay and with the tire-engaging grippers extended for pick-up and subsequent retrieval of the vehicle onto the platform of the vehicle carriage assembly.

A rear sensor package 120 is disposed on an opposite (rear) end of the spine 106, nearest the primary section 102, such as shown in FIGS. 18-24B. As shown in FIGS. 21 and 22, a flat wire trough 122 is provided along the underside of spine 106, which allows space below spine 106 for flat wire 105 to be laid down under the satellite assembly 100 as the satellite 100 moves along its longitudinal axis, such as shown in FIGS. 38D and 38E. The flat wire 105 is further connected to a flat wire reel 124 (FIGS. 23-24B and 34-36), which stores the flat wire cable 105 on a cassette 125 (FIG. 35) and pays out the cable 105 from the satellite assembly 100 as the satellite moves longitudinally off of platform 16 and into a P&D Bay or a storage bay. Thus, flat wire cable 105 is not dragged along platform 16 or the surfaces of P&D Bay or a storage bay, but rather is paid out and reeled in at substantially the same speed of travel as satellite 100. Flat wire reel 124 allows the satellite assembly 100 to travel off the platform 16 in either direction along its longitudinal axis. In the illustrated embodiment, about forty feet of wire or cable 105 may be paid out by reel 124 so that satellite 100 may move about forty feet in either direction off of platform 16, which is generally sufficient to store typical vehicles two-deep, if desired.

Since the system records each vehicle's wheelbase as well as the locations of its front and rear bumpers relative to the wheels, satellite 100 can store different types of vehicles two-deep and at close front-to-back spacing, substantially without risk of causing contact between two vehicles in the same storage bay. In addition, P&D Bay sensors 103 (FIG. 38B) can detect each vehicle's height (as well as the vehicle's width, length, and wheel locations), so that a determination can be made of which storage bays have sufficient overhead clearance, width, and length available to receive a given vehicle.

Figure 34:
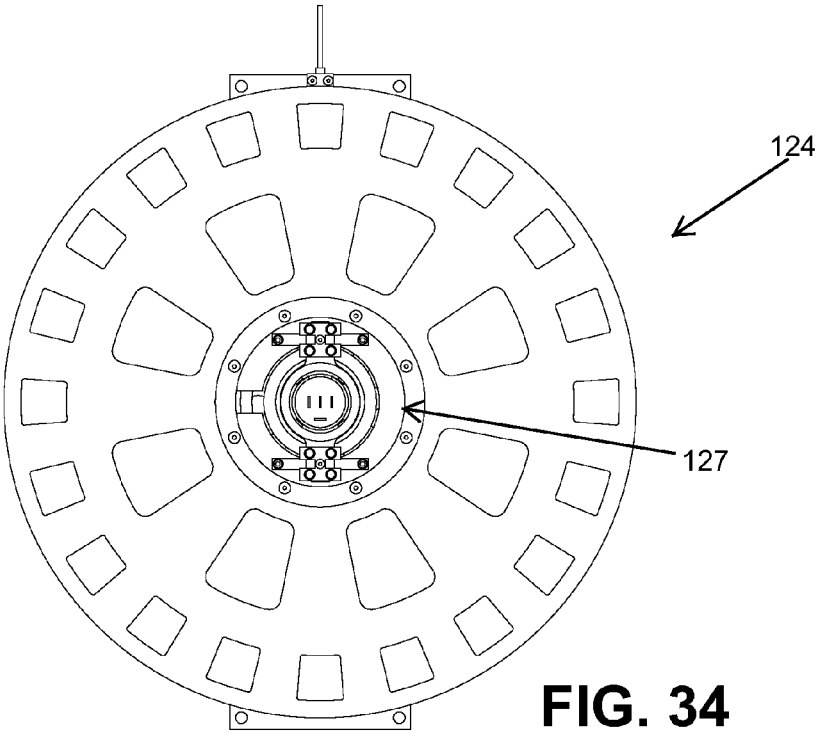
FIG. 34 is a top plan view of a flat wire reel of the vehicle satellite of FIGS. 23 and 24.
Figure 35:
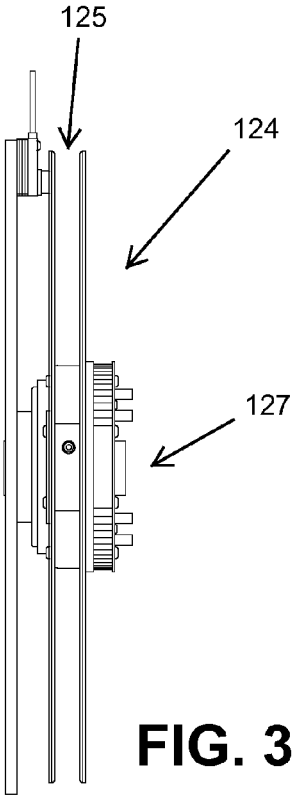
FIG. 35 is a side elevation of the flat wire reel of FIG. 34.
Figure 36:
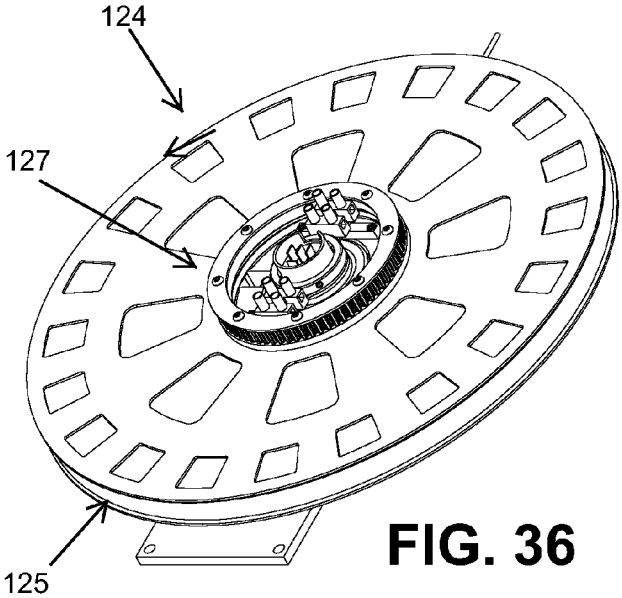
FIG. 36 is a perspective view of the flat wire reel of FIG. 34.
Figure 37A:
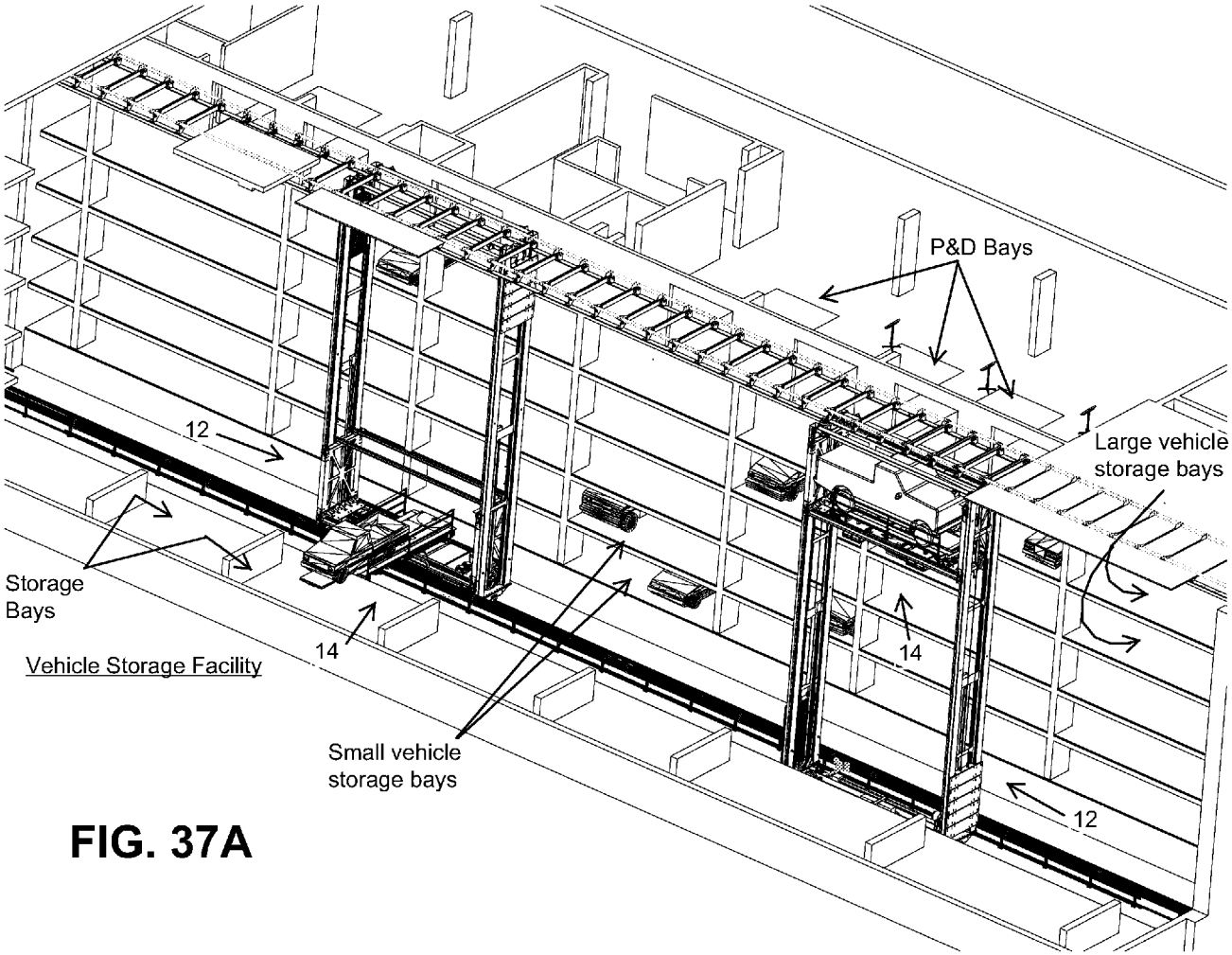
FIGS. 37A-37C are perspective views of a vehicle parking facility serviced by a pair of cranes and respective vehicle carriage assemblies in accordance with the present invention.
Figure 37B:
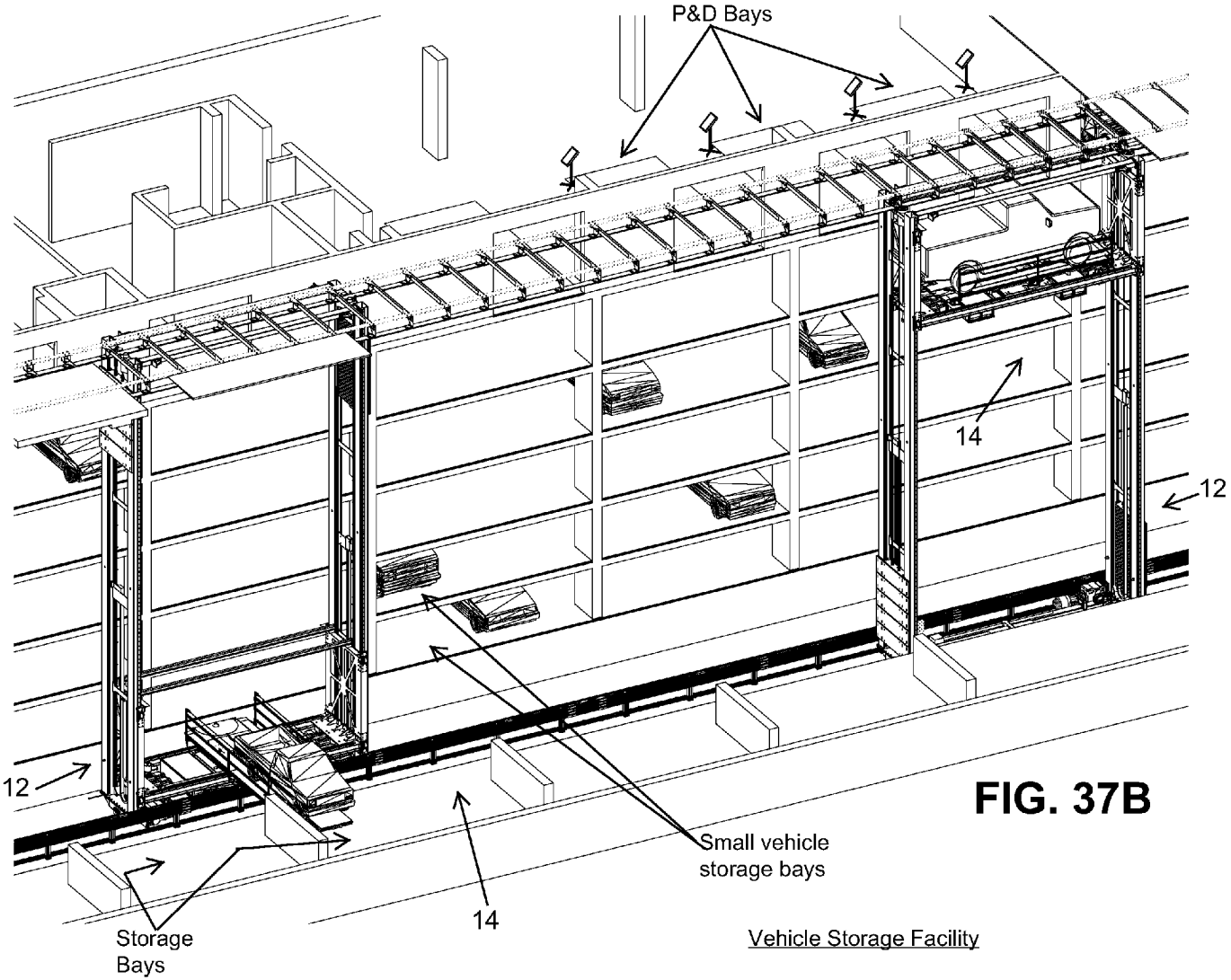
Figure 37C:
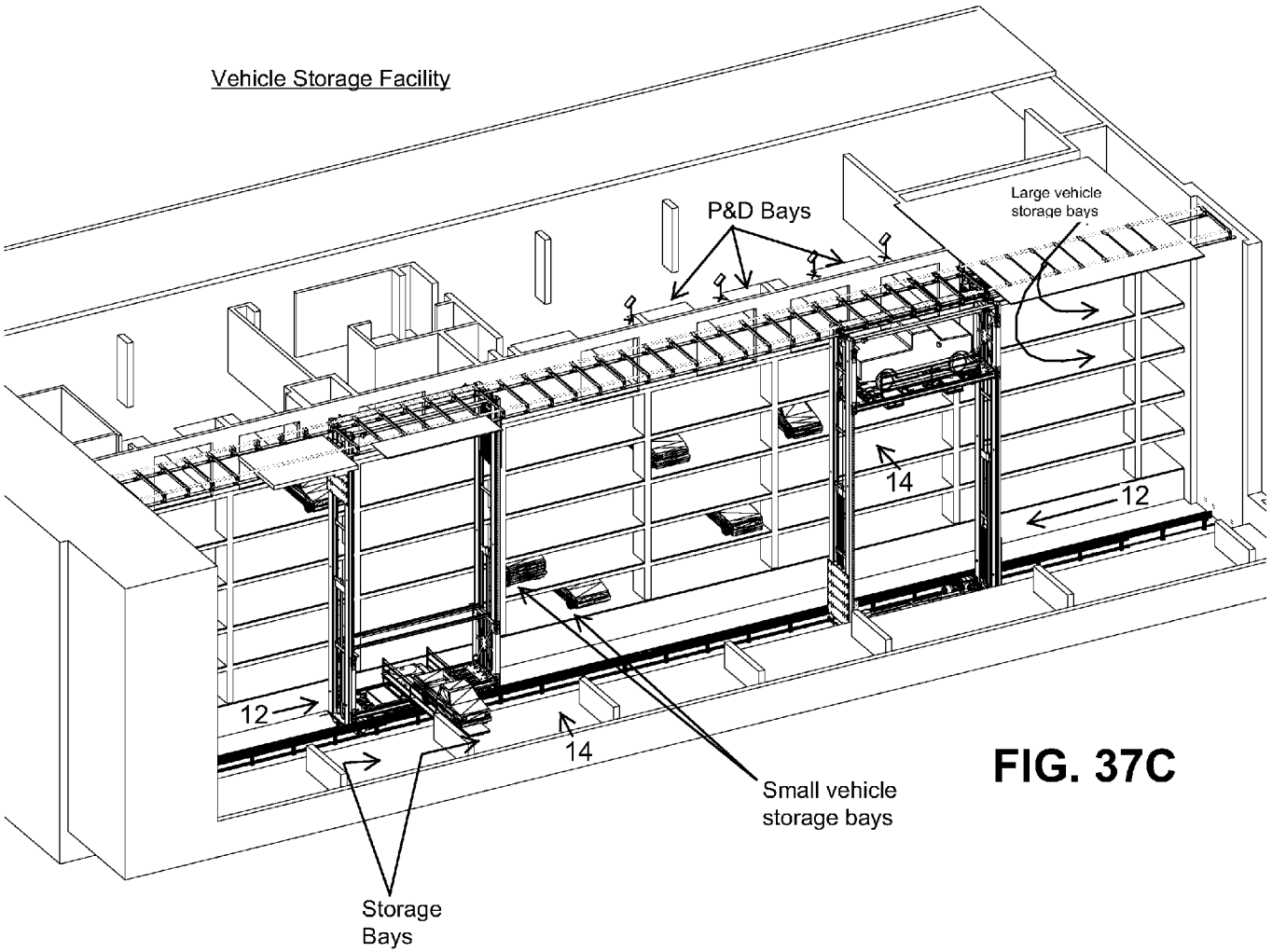

A flat wire connection point 129 on platform 16 (FIG. 32), near the forward pop-up laser 91, incorporates a "flipping" device allowing for flat wire cable 105 to be paid out and reeled in smoothly in either of two directions of travel of the satellite assembly 100. In the illustrated embodiment, wire cable 105 is a power-only cable that is electrically coupled to a three-phase, 480-volt AC power source or connection below upper surface 95 of platform 16. As best shown in FIGS. 34-36, flat wire reel 124 further includes a motorized recoil hub 127, powered by cable 105, which rotatably drives cassette 125 to either pay out cable 105 or take up the cable 105 as satellite 100 moves relative to platform 16, thus maintaining at least slight tension on cable 105 at substantially all times during operation of the satellite.

When cable 105 is configured to supply only power to the satellite 100 , as in the illustrated embodiment, data (such as position data from sensor array 116 or from P&D sensors 103) and command instructions are exchanged between controller 20 (or a crane master controller) and satellite 100 via wireless signal transmissions. However, it will be appreciated that the satellite may be configured to exchange data and receive command instructions through a wired connection, such as through signal conductors associated with the power cable. Optionally, it is envisioned that a vehicle satellite may be operated without any wired connections, without departing from the spirit and scope of the present invention. For example, the satellite may be equipped with an on-board battery pack that has sufficient capacity to power the satellite for a suitable duration (measured in time or number of vehicle storage cycles, for example), and the satellite may automatically receive charging current from a charging interface or connection associated with the platform or vehicle carriage whenever the satellite is positioned on the platform. It is envisioned that range of a wireless satellite would be limited only by the range of wireless signals, and by the energy capacity of its on-board batteries.

Figure 24A:
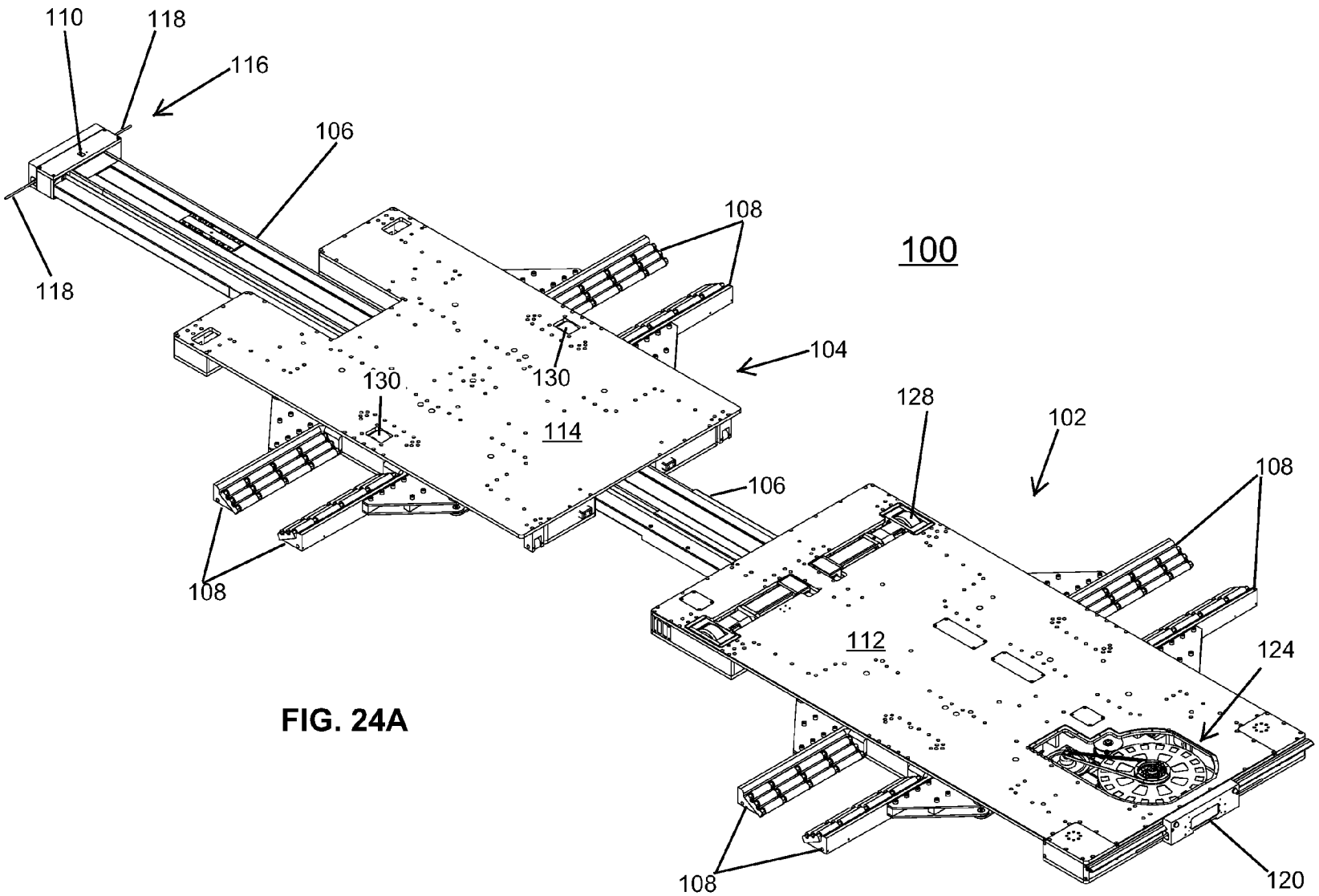
FIG. 24A is a perspective view of the vehicle satellite of FIG. 18.
Figure 24B:
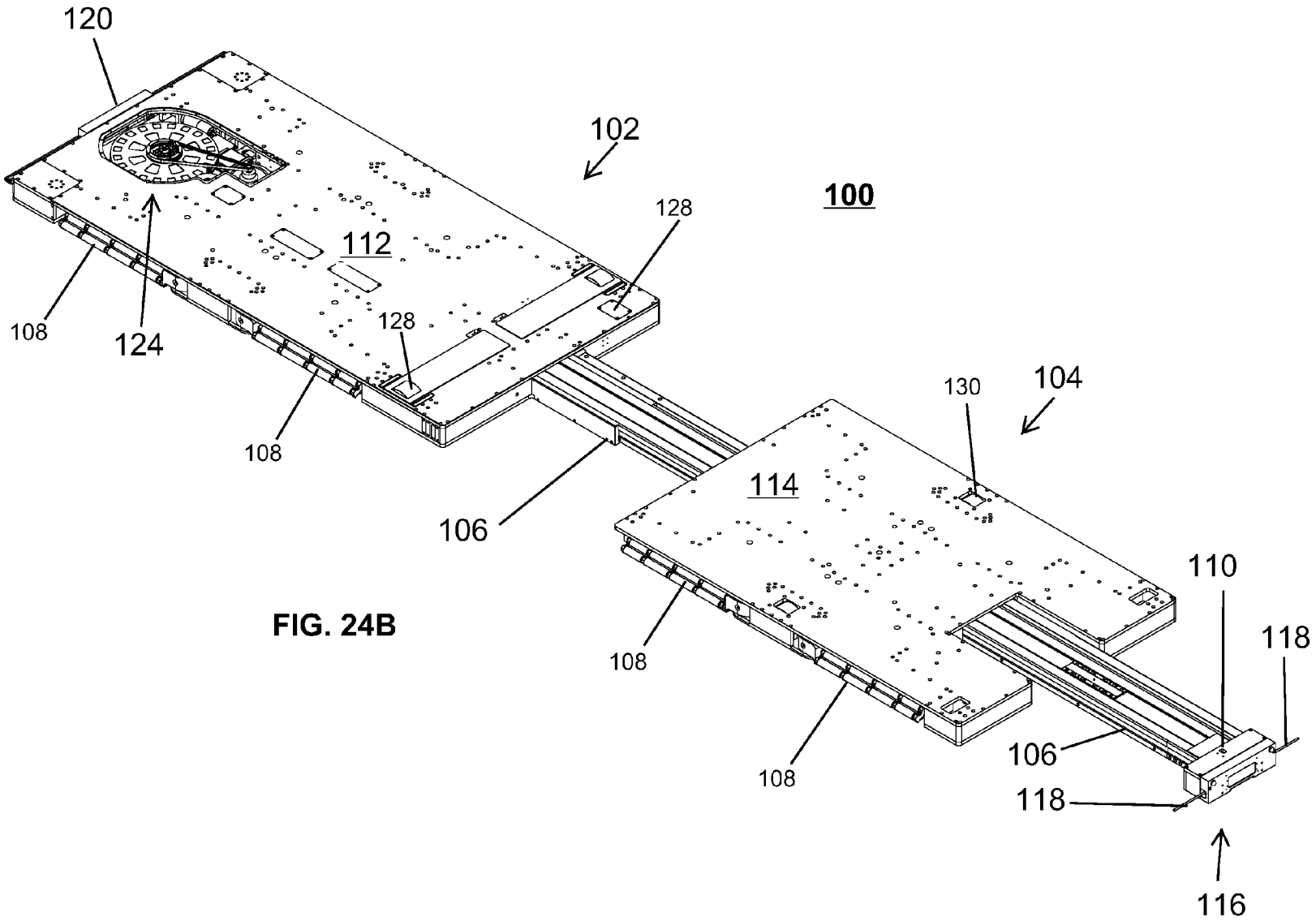
FIG. 24B is a perspective view of the vehicle satellite of FIG. 19.
Figure 25:
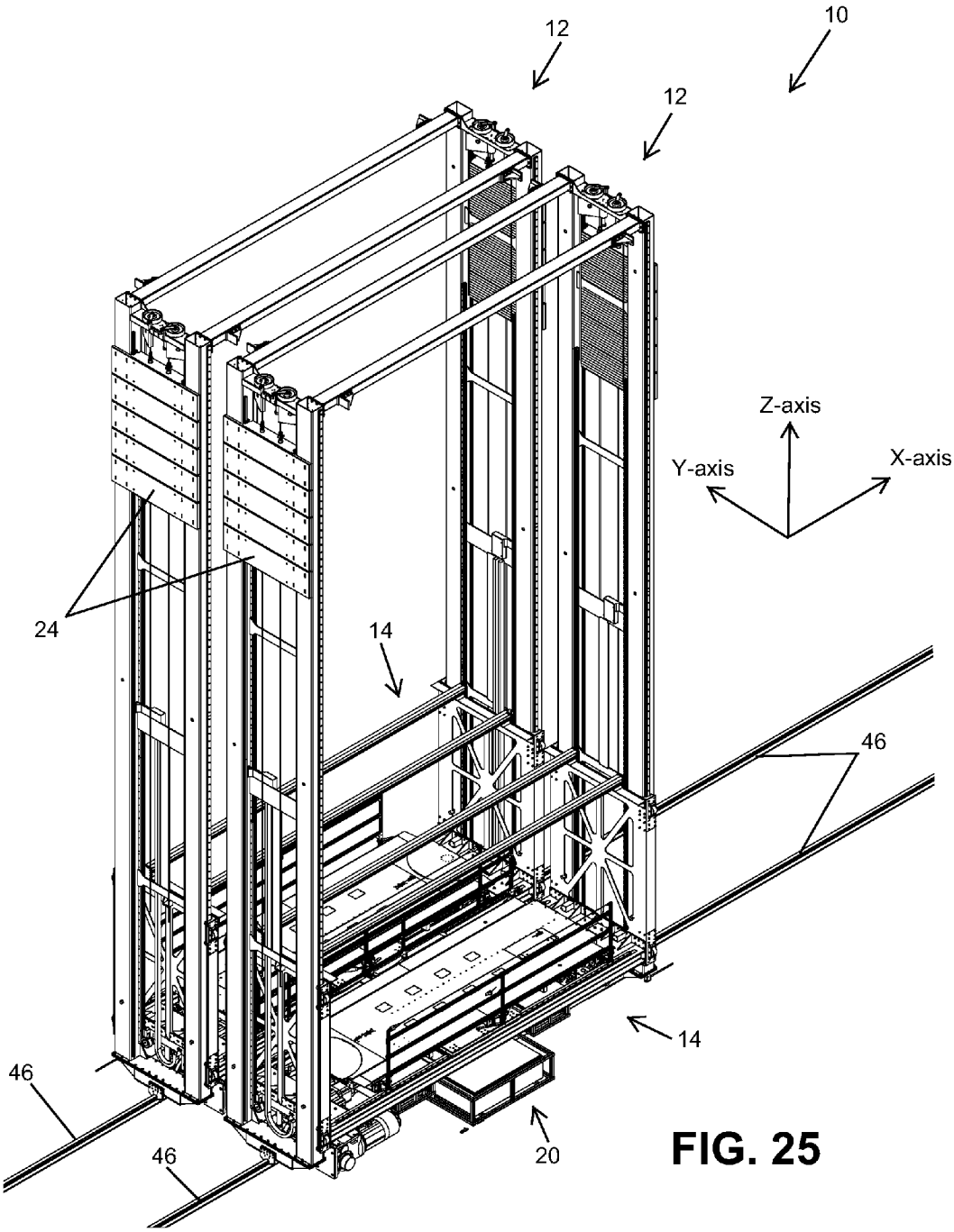
FIG. 25 is a perspective view of a pair of vehicle cranes and respective vehicle carriage assemblies in side-by-side arrangement.
Figure 26:
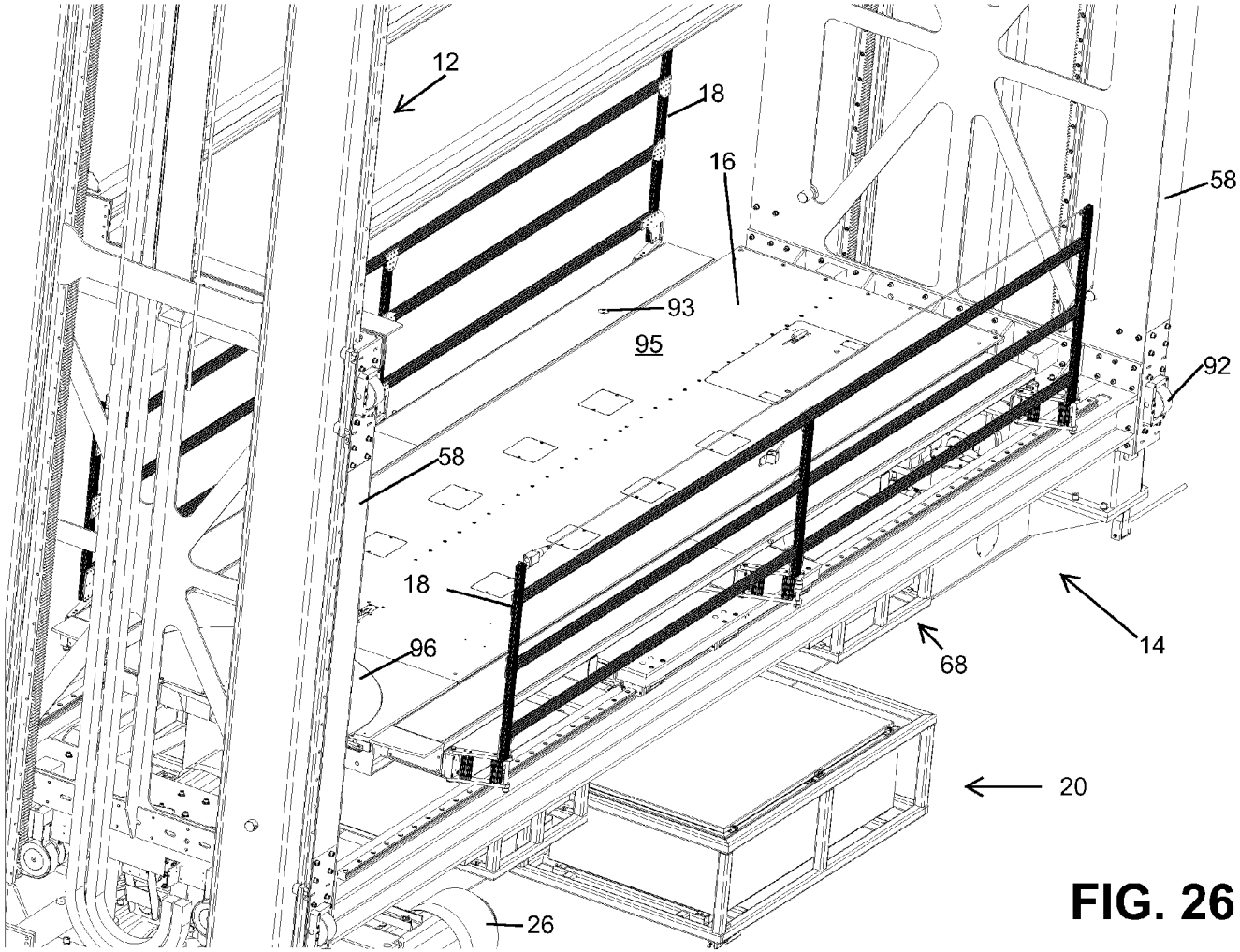
FIG. 26 is an enlarged perspective view of a portion of a vehicle carriage assembly shown positioned on a vehicle crane.
Figure 27:
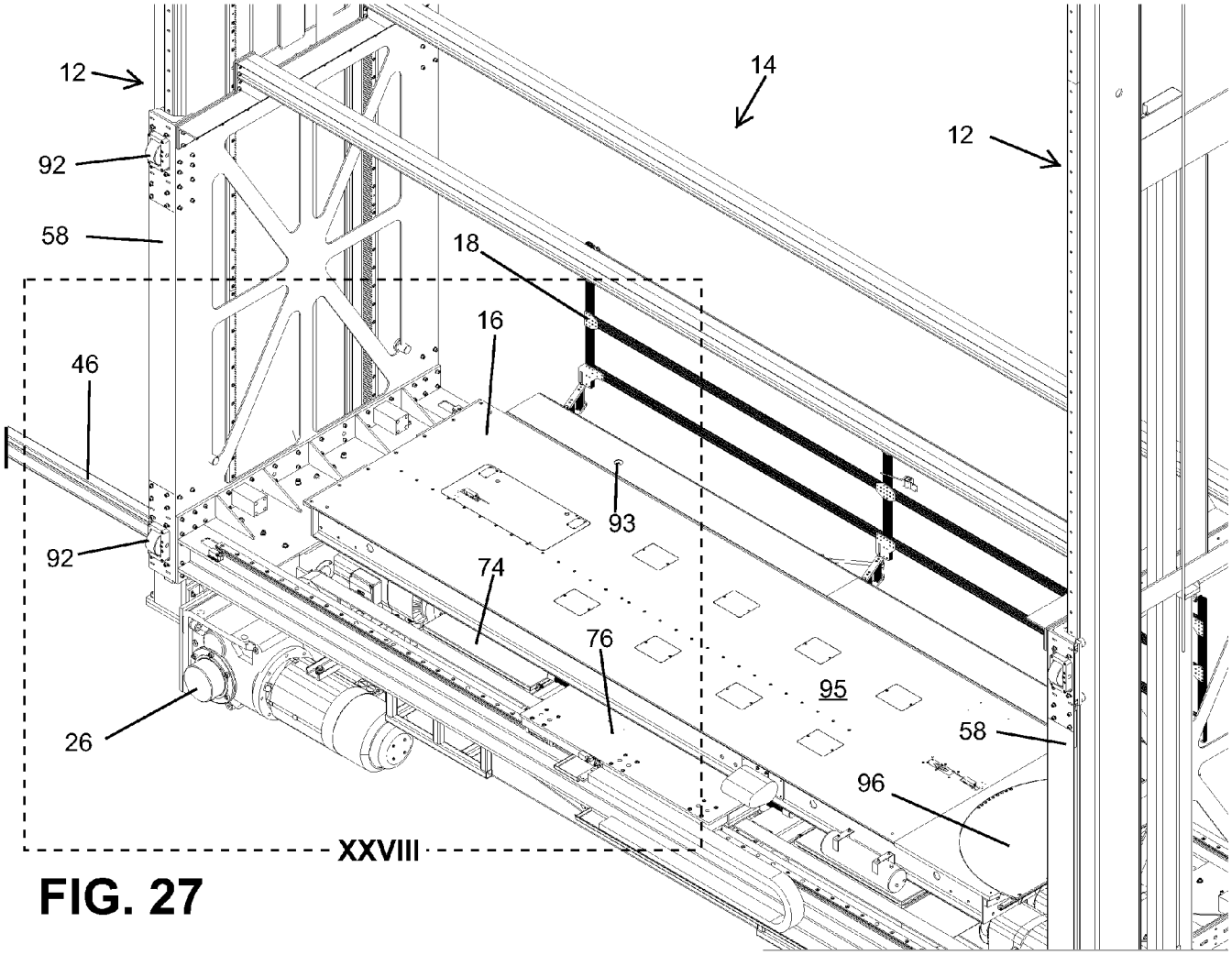
FIG. 27 is another enlarged perspective view of the vehicle carriage assembly shown positioned on the vehicle crane.
Figure 28:
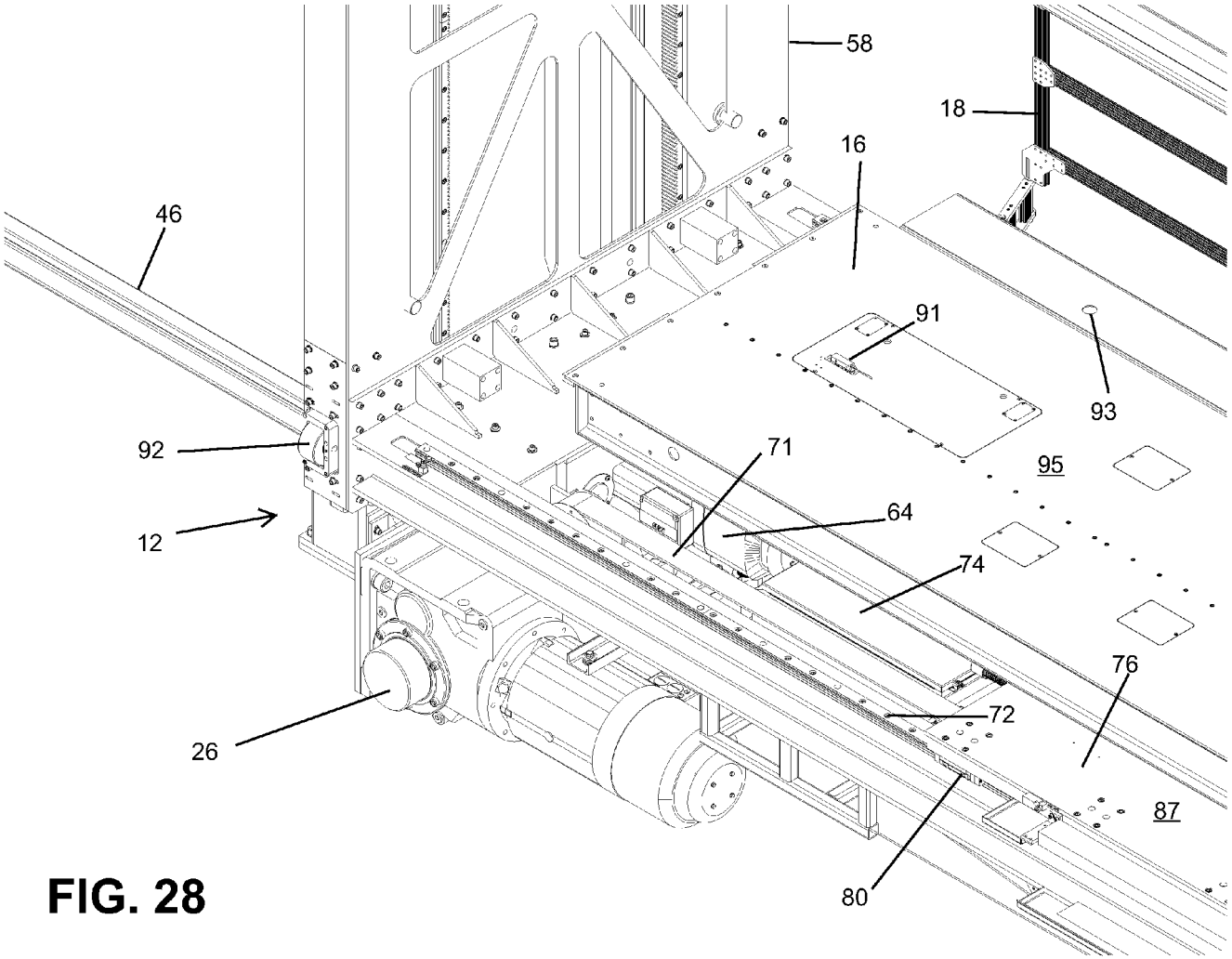
FIG. 28 is an enlarged view of the region designated XXVIII in FIG. 27.
Figure 29:
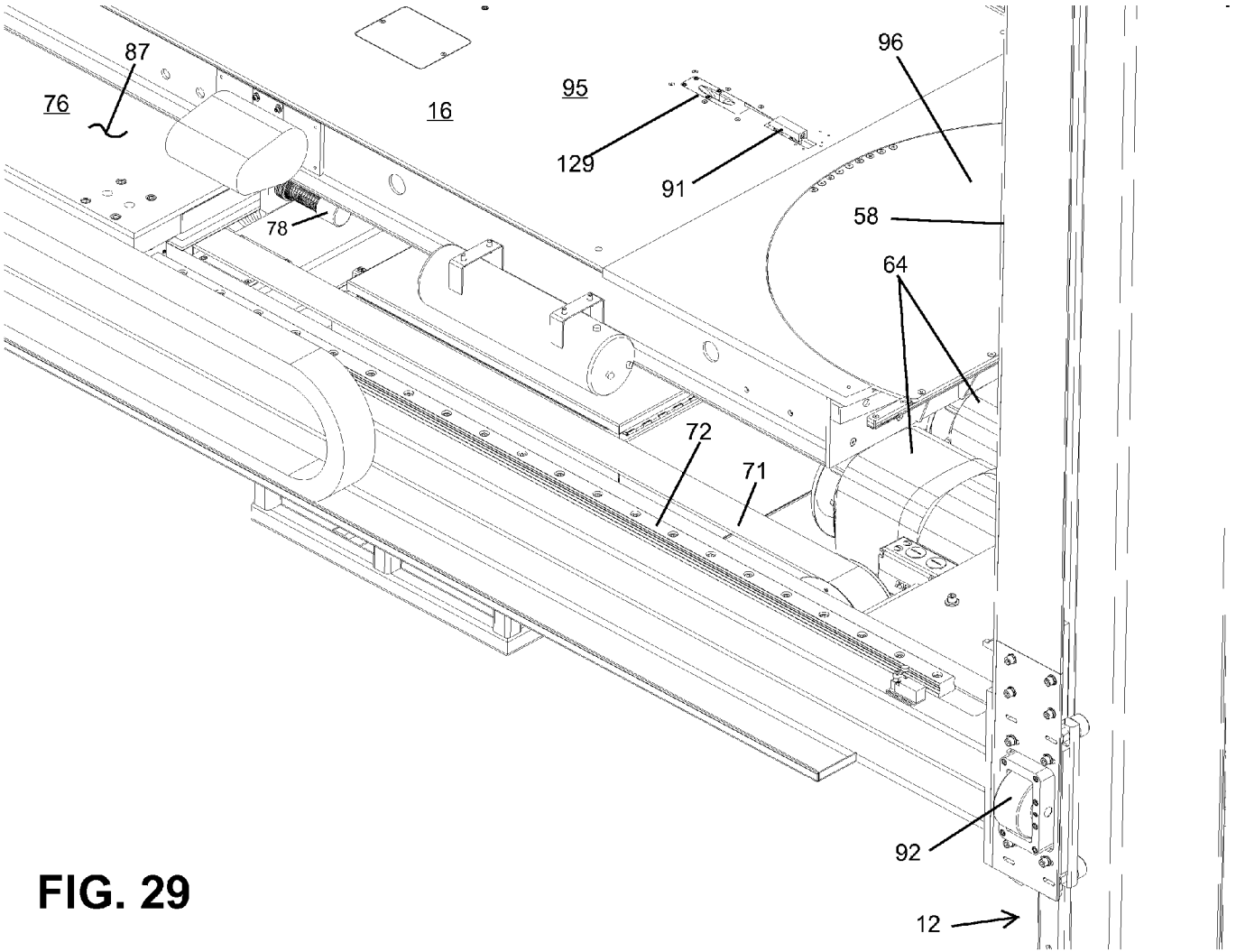
FIG. 29 is an enlarged perspective view of another portion of the vehicle carriage assembly, opposite the region of FIG. 28.

Referring now to FIG. 23, each pair of tire-engaging grippers 108 is actuatable via a respective lift grip motor 126 that is within the sections 102, 104, Each lift grip motor 126 is operable to rotatably drive a double-threaded drive shaft 107, as in an electric servo/ball screw assembly, with opposite end portions having opposed threads (i.e. one end portion having a right-hand thread and the other having a left-hand thread). Each end portion of the drive shaft 107 receives a respective correspondingly-threaded actuator collar 109 for actuating one of the. grippers 108. In this manner, when drive shaft 107 is rotated in a first direction, both actuator collars 109 on that shaft will move apart to extend the grippers 108 (FIG. 23), and when drive shaft 107 is rotating in a second direction, both actuator collars 109 on that shaft will move together, thus pivoting grippers 108 about ninety degrees so that they are hidden under panels 112 or 114 (FIG. 24B). Typically, all four lift grip motors 126 are operated simultaneously to lift or lower all four tires of a vehicle at the same time.

Primary section 102 includes drive wheels 128 (FIG. 23) that are located at a forward end of the primary section for drive the longitudinal movement of the primary section 102 and the secondary section 104 in a manner that will be further described below. The location of drive wheels 128 near the center of gravity of satellite 100, and of a vehicle positioned on satellite 100, helps ensure that wheels 128 will have sufficient traction to move the satellite and vehicle substantially without slipping. The secondary section 104 includes idler wheels 130 that are disposed between grippers 108, which help to disperse the weight of a vehicle when lifted by the grippers 108. Primary section 102 further includes steering wheels 132 that are disposed on the rearmost side of primary section 102, as shown in FIG. 20. Steering wheels 132 are used to guide the satellite assembly 100 as moved along the Z-axis.

Referring now to FIGS. 25 and 37A-37C, a pair of vehicle storage assemblies 10 are operable in a single vehicle storage facility, and each vehicle storage assembly is capable of storing and retrieving vehicles between substantially any P&D Bay and substantially any storage bay of the facility. Each vehicle storage assembly 10 includes a crane 12 movably supported on a respective rail 46, with the rails of the respective vehicle storage assemblies shown in substantially parallel arrangement for movement of the cranes along their X-axes. However, it will be appreciated that when two or more rails are used in a given parking facility, the rails need not necessarily be arranged parallel to one. another, and that the operation of multiple cranes 12 and respective vehicle carriage assemblies 14 can be coordinated for other configurations. For example, it is envisioned that two rails could be arranged in a Y-pattern, in which case some storage bays could be serviced by both vehicle storage assemblies (e.g., in a parallel-track region), while other storage bays could be serviced by only one or the other vehicle storage assembly (e.g., in a divergent-track region). In addition, it is envisioned that three or more vehicle storage assemblies could be operated together in a coordinated manner, so long as the vehicle support platforms are sufficiently long and/or extendable a sufficient distance in the Y-axis direction, without departing from the spirit and scope of the present invention.

Accordingly, it will be appreciated from the above descriptions that the vehicle storage assembly 10 is capable of moving the satellite and vehicle in a multitude of directions during operation. Vehicle storage assembly 10 includes a software system, operable by controller 20 and/or a "crane master control", which monitors the parking storage facility as well as the movements of the one or more vehicle storage assemblies that are operating within the facility. The software system stores data indicative of the current status (i.e., empty or full, or partly-full) of each vehicle storage bay to determine the availability of open storage bays that are suitable for different types of vehicles.

The vehicle storage assembly also includes a messaging system to communicate with the vehicle operator. As the vehicle operator approaches the vehicle storage assembly, the message system (which may be an LED sign, video display, or the like) will appropriately display any one of a plurality of messages indicating the present availability of storage locations. Such messages may include "parking available", "no oversized vehicles", "no parking available", etc. If parking is available, the vehicle user (or operator) will pull into a parking ramp wherein the operator is directed to a series of park and delivery bays (P&D Bays). Optionally, a first message system is used to provide vehicle operators with this initial information, and to direct a vehicle operator to a specific P&D Bay, for example, while a secondary message system 111 at each P&D Bay (FIG. 38E) is used to provide instructions for use of the system.

Once the operator is directed to a specific P&D Bay, the operator positions the vehicle into the P&D Bay (or any available P&D Bay), and a control signal is sent to controller 20 (or to a crane master control in communication with controller 20) indicating that a safety curtain or net 101 (FIG. 38B) has been activated. The controller 20 (or crane master control) communicates with the operator via a P&D Bay message system 111, to indicate whether the operator should "pull forward", "back up", "stop", "turn off the vehicle and exit the bay", "do not enter the bay", or "straighten vehicle" (such as if the vehicle's longitudinal axis is skewed or misaligned more than the adjustable range of the satellite, such as more than about six degrees from the Y-axis, for example).

After the operator has properly followed the controller instructions and pulled into the P&D Bay, the operator leaves the vehicle and approaches a vehicle storage assembly kiosk. The operator may be asked to verify that the vehicle is empty and locked. Once verified, the operator communicates with the kiosk either by receiving a ticket, swiping a credit card, driver's license or building ID, or other type of vehicle or owner identification method or device to indicate that the operator would like to store the vehicle.

Once the operator has indicated that the vehicle is to be stored, the software system queries the controller 20 to acquire initial vehicle dimensions and tire patch (tire-to-floor contact) locations. This initial vehicle assessment takes place in the P&D Bay by P&D Bay sensors 103 (FIG. 38B) and, once the data shows that only one vehicle and four wheels are in the P&D Bay, the software system operated by controller 20 generates a storage command, which is then associated with the card or other vehicle or owner identifier that was used by the operator. Once the storage command is sent, the operator is directed by the kiosk to exit the parking garage. P&D Bay sensors 103, which may comprise laser sensors or the like, continue to monitor the area around the vehicle to ensure that no persons or objects are in an unsafe location or zone 115 (FIG. 38B) when opening bay door 99 and moving satellite 100 into the bay.

Once a crane is available, the storage command is sent to the controller 20 to move the crane to the P&D Bay where the vehicle is located. The crane assembly 12 moves on the X-axis and the vehicle support platform 16 rotates about the Z-axis and moves toward the P&D Bay (or toward a storage bay) along the Y-axis to engage the edge 97 of the P&D Bay (or the edge 97 of a storage bay, as in FIG. 32), as described above. Once the carriage is located adjacent the P&D Bay, the crane control prepares to retrieve the vehicle.

Once positioned in front of the P&D Bay, the platform assembly 16 moves along the X-axis (FIG. 15) and, if necessary, pivots about the Z-axis (FIGS. 11G and 11H) to properly align the platform 16 with the vehicle. The platform 16 moves along the X-axis via the belt drive motor 70 (FIG. 12) which, in the illustrated embodiment, uses a belt drive system 71 (FIG. 33) to move the platform 16 along X-rails 72 (via X-skate 76) in a longitudinal direction (i.e., lateral to the platform orientation when the platform is perpendicular to carriage base 68) in order to align the platform 16 with the vehicle in the P&D Bay. Slew drive 82 is used to pivot platform 16 about the Z-axis as necessary to align the longitudinal axis of the platform with the longitudinal axis of the vehicle, such as shown in FIGS. 11G and 11H. Once the platform 16 is fully aligned with vehicle, Y-skate 84 operates to extend platform 16 generally in the Y-axis toward the edge 97 of P&D Bay until the edge is engaged by platform nose 96. As described above, when the longitudinal axis of platform 16 is not perpendicular to the edge 97 of P&D Bay, platform nose 96 will pivot as it is urged into contact with the edge 97 to provide flush engagement of platform 16 with the edge of the P&D Bay.

Optionally, a small ramp or resilient flap (not shown) covers the forward edge of platform nose 96, and smoothes the transition from platform nose 96 to edge 97 to facilitate the operation of satellite 100. To ensure proper engagement of this small ramp or flap atop an upper horizontal surface at edge 97, any one or more of X-skate 76, slew drive 82, and Y-skate 84 may include a powered actuator for raising and lowering platform at least a small vertical distance during this operation. For example, platform 16 may be raised so that its upper surface 95 is higher than the upper horizontal surface near the edge 97 of P&D Bay as the platform 16 approaches and engages edge 97, and then once platform nose 96 is substantially fully engaged with edge 97, platform 16 is lowered so that its upper surface 95 is substantially flush with the upper horizontal surface near the edge 97 of the P&D Bay.

As briefly noted above, the crane control will only move the platform 16 once it has verification from the software system that the P&D Bay is clear and that the vehicle is ready for pick up. Once verification is received, a P&D Bay door 99 and net 101 (FIG. 38B), which separate the crane assembly 12 from the P&D Bay, will open to provide satellite 100 with access to the vehicle in the P&D Bay. Optionally, door 99 may initially open only slightly, just enough to provide clearance for satellite 100 to pass underneath it, to reduce the chance that a person or foreign object will be able to pass under the door during the initial stages of the vehicle pick-up process. Sensors 103 will continue to monitor the P&D Bay (FIG. 38B) to ensure that persons and objects maintain a safe margin of distance during the vehicle pick-up process, and can stop the vehicle pick-up process and direct the door 99 (and, optionally, side doors as well) to close rapidly if a person or foreign object enters P&D Bay when it is unsafe to do so, even if a vehicle is positioned under the door 99.

The controller 20 or crane master control directs a satellite control to move the satellite assembly 100 under the vehicle and, while the satellite is moving under the vehicle, the satellite control extends and retracts the satellite spine 106 to match the vehicle wheelbase and sensory information is taken by the front sensory array 116 and rear sensory array 120 to determine the actual location of the wheels of the vehicle and to properly determine the wheelbase of the vehicle for proper positioning of the satellite assembly 100. In the illustrated embodiment, satellite assembly 100 moves under the vehicle and adjusts its geometry as appropriate by first moving the primary section 102, secondary section 104, and spine 106 together under the vehicle (FIG. 38C). Front sensor array 116 passes under the front bumper of the vehicle first, and detects the location of the front bumper with upwardly-directed sensor 110. It will be appreciated that the vehicle could be backed into the P&D Bay and the satellite would work in substantially the same manner, by first recording the location of the rear bumper.

As front sensor array 116 continues to move toward the rear of the vehicle, side-facing sensors 118 detect the locations of the beginnings and ends of each front tire patch (the areas where the front tires contact the floor of the P&D Bay). As front sensor array 116 continues to move toward the rear of the vehicle, the side-facing sensors 118 detect the locations of the beginnings and ends of each rear tire patch. Once primary section 102 has reached the point at which it is centered with the known locations of the vehicle's front tire patches, primary section 102 stops moving along the floor of the P&D Bay, while secondary section 104 continues to move toward the rear of the vehicle by extending the middle portion of its spine 106. Secondary section 104 moves rearwardly, relative to the vehicle, until it is centered with the known locations of the vehicle's rear tire patches. However, if the middle portion of spine 106 is already extended as it passes underneath the vehicle, so that the primary and secondary satellite sections 102, 104 are further apart than necessary for the wheelbase of the vehicle, secondary section 104 will reach the vehicle's rear tire patches before primary section 102 reaches the vehicle's front tire patches, and secondary section 104 will stop first so that primary section 102 moves into position at the vehicle's front tire patches by retracting spine 106.

Typically, rear sensor array 116 will have extended past the rear bumper of the vehicle at this point, and will detect the location of the vehicle's rear bumper (with upwardly-directed sensor 110) relative to the front bumper and the wheel (tire patch) locations. Optionally, upwardly-directed sensor 110 (and/or P&D sensors 103 in the P&D Bay, as shown in FIG. 38B) will detect if the vehicle includes an attachment or projection (such as a hitch-mounted bicycle rack), so that the attachment will be considered as the rear-most portion of the vehicle for spacing calculations. This dimensional information can be used later to ensure that the vehicle is not moved into contact with a rear storage bay wall, or another vehicle, during storage operations. It also serves as confirmation that the vehicle is not over-sized for use with the system, based on dimensional information collected by P&D Bay sensors 103 and by the satellite's sensor array 116, and thus allows the system to consider vehicle height, length, and width in selecting an appropriately-sized targeted destination or storage bay (e.g., the smallest appropriate bay) from all the available storage bays.

At this point, the primary section 102 and secondary section 104 are centered with the vehicle's front and rear tire patches, respectively, and the tire-engaging grippers 108 are in the closed or retracted position of FIGS. 19, 24B, and 38E. Grippers 108 are now extended to engage and lift the vehicle on wedge-shaped surfaces (of each gripper 108) at the vehicle tires (FIG. 38D). The vehicle is lifted a sufficient distance by grippers 108 so that the vehicle tires no longer contact the surfaces over which satellite is moving. Once the vehicle is lifted and secured, the satellite control actuates drive wheels 128 to return the satellite 100 to the platform 16 so that the load (vehicle weight) is supported by the platform. Satellite 100 uses its rear sensor array 120 to home in on laser beams produced by pop-up lasers 91 on vehicle support platform 16, and uses its steerable wheels 132 to adjust its path as necessary to center the satellite 100 on platform 16. The forward pop-up laser 91 drops below upper surface 95 of platform 16 as the satellite 100 approaches that laser, and the rear pop-up laser 91 drops below upper surface 95 as the satellite 100 approaches, so that the satellite ends its travel onto the platform substantially without further guidance.

When the satellite 100 has returned to the platform 16 with the vehicle, the P&D Bay door is closed, and the controller 20 directs the crane 12 to begin moving to a storage bay. The platform 16 settles on the carriage assembly 14 and the platform 16 will typically be moved away from edge 97 of P&D Bay by Y-skate 84, and then rotated on the Z-axis to align the vehicle in a generally parallel relationship with the carriage assembly 14, such as by passing through the position of platform 16 that is depicted in FIG. 11C. Optionally, the platform 16 can remain in a perpendicular orientation relative to the carriage assembly 14, depending on factors regarding the logistics of moving the vehicle to the storage location, such as the presence of another crane assembly 12 that would conflict with a perpendicular carriage assembly. Typically, as the platform settles within the carriage assembly 14, the vehicle is oriented in a straight position with its longitudinal axis substantially parallel to the longitudinal axis of platform 16, such that when the crane assembly 12 brings the carriage 14 to a desired storage location, the satellite 100 and the platform 16 will be in a proper orientation (FIGS. 11E and 11F) to move the vehicle straight forward into the storage location, without the need to rotate the satellite and pivot the rotational platform nose 96, as in FIGS. 11G and 11H.

The satellite 100 is further aided by the downward-facing line-scanning sensor, which is capable of detecting a line 113 (FIG. 32) or other indicia that provides guidance information to the satellite as it moves into the storage bay. Optionally, satellite 100 may move the vehicle to the back of a multi-vehicle storage bay, which allows two or more vehicles to be stored end-to-end. Once satellite 100 and the vehicle are at a desired location in the storage bay (FIG. 38G), the satellite control retracts or closes the satellite grippers 108 to release the vehicle in the storage bay. The satellite control then returns the satellite 100 to the platform 16 (FIG. 38H, and this movement is aided by the rear-facing laser sensor 120, which again homes in on pop-up lasers 91 in platform 16 in substantially the same manner that it did when moving the vehicle from P&D Bay onto platform 16. The crane master control or controller 20 then waits until it receives its next store, retrieve, or move command, or moves to a P&D Bay or the general vicinity of storage bays that are considered likely to contain vehicles that will soon be retrieved, as will be described in more detail below.

When an operator wishes to retrieve their vehicle, the operator swipes a credit card or other vehicle or owner identifier at the kiosk, such that the software system identifies the car and the vehicle is retrieved from the storage location. When retrieving a vehicle from the storage location, the crane control generally needs only to align the platform 16 in front of the storage location, without the need for further movement of platform 16 along the X-axis or the rotation about the Z-axis, since the vehicle has been left in a straight position when stored by the vehicle storage assembly. However, it will be appreciated that to provide increased vehicle storage density, it is desirable to move platform 16 along carriage 14 in the X-axis direction when retrieving a vehicle at the very end or edge of a parking facility, such as shown in FIG. 11E. In order to maximize usage of the available area in the parking facility, handrails 18 are independently retractable (by about twelve inches, in the illustrated embodiment) to reduce the overall width of platform 16, which permits the platform to be moved closely to or against upstanding side members 58 of carriage assembly 14, along crane masts 22 (which may be moved to be in close proximity to an end wall of the storage facility), such as shown in FIG. 11E.

The satellite assembly 100 retrieves the vehicle from the storage bay by lifting the vehicle on the tire-engaging grippers 108 in substantially the same manner as during pick-up of the vehicle from the P&D Bay. However, it is not necessary to use storage location sensors for scanning the vehicle in the storage location to determine the vehicle's orientation, since the vehicle will have been left in storage bay in proper alignment (i.e., substantially parallel to the Y-axis). The vehicle is then delivered to the P&D Bay, desirably in a forward or outwardly-facing orientation, so that when the vehicle operator returns to the vehicle, the operator can pull the vehicle forward out of P&D Bay. The operator generally waits in a "safe" zone while the vehicle is delivered to the P&D Bay and the satellite assembly 100 has returned to the platform 16 and has settled on the carriage 14. Once the P&D Bay door closes, the vehicle operator is free to retrieve the vehicle. The system then waits for its next command to store, retrieve, or to move vehicles already in storage.

It will be appreciated that the automatic parking system of the present invention is able to pick up and deliver vehicles along substantially any conventional flat ground surface, without need for a subfloor or elevator shaft compartment or the like. This allows the automatic parking system of the present invention to be installed in a wide variety of locations, or even as a retro-fit in an existing parking facility. In addition, the automatic parking system is capable of storing , vehicles two or three (or more) deep, if desired, and can park vehicles in close side-by-side arrangement, such as with only about three inches separating the vehicles in their parking bays.

The present invention also contemplates collecting data regarding the vehicles, and typical storage demand by a particular vehicle or vehicle operator, to facilitate efficient storage of vehicles. This data can then be analyzed to improve efficiencies within the system, such as determining periods of high traffic, determining which vehicle operators use the storage facility and how long they generally store their vehicle, and also to determine other vehicle storage patterns for analysis as to the most efficient manner in which to run the vehicle storage assembly. For example, the data may indicate that vehicle parking demands during night hours and on certain days of the week are particularly low (e.g., weekends and holidays in a business district), so that it would be advantageous to park all vehicles in relatively close proximity to P&D Bays during the low-usage times or days, even if this leads to storing very small vehicles in storage bays that are sufficiently large to receive much larger vehicles.

In another example of adapting the parking system to achieve improved efficiency, the system may track or monitor vehicle traffic/parking data, and may identify or recognize return visitors, whereby the data may show that one particular vehicle is typically parked for a relatively long period of time, such as from 7:00 am to 8:00 pm daily, and that a second vehicle is typically parked a shorter period of time, such as from 8:30 am to 5:30 pm daily. In this example, the system can recognize the first vehicle (such as by the owner's identifying information) when it arrives in the morning and will place the first vehicle in the rear portion of a vehicle storage bay that is located relatively far away from the P&D Bay. The system may similarly recognize when the second vehicle arrives in the morning and will place the second vehicle in the front portion of the same vehicle storage bay, in a manner that obstructs access to the first vehicle. Since the data indicates that the second vehicle will mostly likely be retrieved before the first vehicle, neither of the first or second vehicles will typically need to be moved during their respective storage periods, since the second vehicle will remain accessible during its storage period, and the first vehicle will likely be unobstructed and thus readily accessible by the time its owner arrives to retrieve the first vehicle, thus reducing the vehicle-retrieval wait time for each vehicle's owner. In addition, by selecting vehicle storage bays that are located relatively far away from the P&D Bay, for vehicles that are known to be typically stored for longer periods, the system may reserve the vehicle storage bays that are closer to the P&D Bay for vehicles that are typically stored for shorter periods of time, or for vehicles that are unknown to the system, which may further reduce the vehicle storage and retrieval times for vehicles that are stored for shorter periods, so that the vehicle storage bays that are accessed most frequently are those located closest to the P&D Bay.

Further efficiencies may be realized, for example, by programming the system to store vehicles in storage bays that are as close as possible to the P&D Bay during peak periods of vehicle parking, such as during morning "rush hour". In this example, the elapsed time required to store each vehicle and return the crane and vehicle carriage to the P&D Bay for the next vehicle is minimized, thus reducing wait times for vehicle operators during peak periods. The system can be programmed to reorganize the vehicles in a more space-efficient manner during known periods of reduced vehicle parking demand, thus freeing up space in the parking facility by later increasing the efficiency of space usage when the frequency of incoming vehicles is low.

In addition, the system may be programmed to anticipate parking demands by positioning the cranes and vehicle carriages at optimal locations within the parking facility according to typical demands. For example, during periods in which the frequency of incoming vehicles is relatively high, the cranes and vehicle carriages can be positioned at a respective P&D Bay after storing a vehicle in a storage bay, even if there is not yet another vehicle positioned in the P&D Bay. Similarly, during periods in which the frequency of outgoing vehicles is relatively high, the cranes and vehicle carriages may be positioned near vehicle storage bays containing vehicles that are normally returned to the P&D Bay at that time of day, so that there will be a good chance that the crane and vehicle carriage will require little travel distance to reach the next vehicle that is requested for return to the P&D Bay.

The efficiencies realized and created by the data collected helps to make the present invention a more efficient and environmentally friendly alternative to prior art systems. Further regarding the environmentally friendly aspects of the present invention, it will be appreciated that the present invention does not require as much space as a conventional parking facility to store the same number of cars. The automatic parking system of the present invention is typically able to store two to three times as many vehicles as a conventional parking garage having the same volume, and is more efficient than many prior art systems, in part, because its vehicle support platform can store vehicles very close to the end walls of a parking facility. Further space efficiency is realized through the use of storage bays that are tailored for specific types or sizes of vehicles, which the system recognizes and stores the vehicles accordingly. The overall facility reduction translates into less building material, less surface space needed, the ability to retro-fit existing facilities with the automatic parking system of the present invention, and reduced storm-water runoff. Also, because the automatic parking system of the present invention moves the vehicles from the P&D Bay to a storage bay, the present invention can reduce the amount of time vehicles drive or idle in conventional parking structures. This potential savings realized by the present invention is estimated to be the equivalent exhaust emissions reduction of upwards of 10,000 vehicle-miles per year.

Further, the automatic vehicle storage system of the present invention is very efficient in storing and retrieving vehicles. The average retrieval wait time of the present invention may be approximately 100 seconds, for example. The maximum average retrieval wait time may be approximately 300 seconds (5 minutes). The average wait time for P&D Bay availability may be approximately 25 seconds. The maximum wait time in a P&D Bay may be approximately 150 seconds. This is achieved by moving crane assembly 12 and vehicle carriage assembly 14 smoothly, quickly, and precisely. Thus, due to the ability the various components of the vehicle parking system to move and change directions rather quickly, a significant degree of coordination and precision are used in operating the system safely and with high efficiency, particularly when two or more crane and carriage assemblies are operated simultaneously.

Changes and modifications in the specifically described embodiments can be carried out without departing from the principles of the present invention which is intended to be limited only by the scope of the appended claims, as interpreted according the principles of patent law, including the doctrine of equivalents.

The embodiments of the invention in which an exclusive property is claimed are defined as follows:

1. An automatic vehicle storage system comprising:

a crane assembly capable of moving longitudinally within a vehicle storage facility;

a carriage assembly capable of moving vertically along said crane assembly;

a platform movably supported at said carriage assembly;

a self-driven vehicle retrieval satellite associated with said carriage assembly, wherein said satellite is operable to selectively raise and lower a vehicle, and is movable onto and off of said platform, said satellite comprising a plurality of sensors for guiding said satellite under the vehicle;

wherein said plurality of sensors comprises an upwardly-directed sensor for detecting at least the locations of front and rear ends of the vehicle, and two side-facing sensors for detecting the locations of tires of the vehicle; and wherein said satellite further comprises adjustable sections for adjusting the dimensions of said satellite according to the dimensions of the vehicle.

2. The vehicle storage system of claim 1, wherein said satellite comprises a primary section and a secondary section for selectively engaging front and rear tires of the vehicle, respectively, and wherein said satellite further comprises an extendable and retractable spine disposed between said primary and secondary sections, wherein said spine is operable to change a spacing between said primary and secondary sections according to the vehicle wheelbase.

3. The vehicle storage system of claim 1, wherein said vehicle retrieval satellite comprises a wire reel that is operable to wind and unwind a power cable, which is coupled to said platform, as said satellite moves onto and off of said platform.

4. The vehicle storage system of claim 1, wherein said vehicle retrieval satellite is operable to retrieve and store the vehicle along substantially flat continuous floor surfaces in the vehicle storage facility.

5. The vehicle storage system of claim 1, further comprising:

a pair of substantially parallel rails;

an additional carriage assembly, said additional carriage assembly supporting an additional one of said platforms and an additional one of said vehicle retrieval satellites;

an additional crane assembly, said additional crane assembly supported on a respective one of said rails and capable of moving longitudinally within the vehicle storage facility, and each of said crane assemblies supporting a respective one of said carriage assemblies; and wherein said crane assemblies, said carriage assemblies, said platforms, and said satellites are simultaneously operable to move vehicles within the vehicle storage facility.

6. An automatic vehicle storage system comprising:

a crane assembly capable of moving longitudinally within a vehicle storage facility;

a carriage assembly capable of moving vertically along said crane assembly, wherein said carriage assembly comprises:

a carriage base frame;

a first translatable skate that is movable relative to said carriage base frame; and a rotatable slewing drive coupled to said first translatable skate;

a platform movably supported at said carriage assembly, wherein said platform is translatably and rotatably coupled to said base frame via said first translatable skate and said rotatable slewing drive;

a self-driven vehicle retrieval satellite associated with said carriage assembly, wherein said satellite is operable to selectively raise and lower a vehicle, and is movable onto and off of said platform, said satellite comprising a plurality of sensors for guiding said satellite under the vehicle; and wherein said satellite further comprises adjustable sections for adjusting the dimensions of said satellite according to the dimensions of the vehicle.

7. The vehicle storage system of claim 6, wherein said plurality of said sensors of said satellite comprises an upwardly-directed sensor for detecting at least the locations of front and rear ends of the vehicle, and two side-facing sensors for detecting the locations of tires of the vehicle.

8. The vehicle storage system of claim 6, wherein said carriage assembly further comprises a second translatable skate coupled between said platform and said carriage base frame, and wherein said first translatable skate is operable to move said platform substantially horizontally along a first axis, said second translatable skate is operable to move said platform substantially horizontally along a second axis that is substantially perpendicular to the first axis, and said rotatably slewing drive is operable to rotate said platform about a substantially vertical third axis that is substantially perpendicular to said first and second axes.

9. The vehicle storage system of claim 8, wherein said first translatable skate is operable to move said platform between opposite ends of said carriage assembly in substantially the same longitudinal direction as the crane movement.

10. The vehicle storage system of claim 8, wherein said second translatable skate is operable to extend a front end portion of said platform out from said carriage assembly in a cantilever manner in a lateral direction, substantially perpendicular to the longitudinal direction of said first translatable skate, for contacting an edge portion of a vehicle pick-up and drop-off bay or a storage bay of the vehicle storage facility with said front end portion of said platform.

11. The vehicle storage system of claim 10, wherein said front end portion of said platform comprises a pivotable nose configured to engage the edge portion of the vehicle pick-up and drop-off bay or the storage bay of the vehicle storage facility, wherein said pivotable nose is operable to pivot as it contacts the edge portion when said platform is urged toward the edge portion with a longitudinal axis of said platform misaligned with the second axis.

12. The vehicle storage system of claim 6, further comprising:

a steerable wheel and a rear sensor at said vehicle retrieval satellite;

a laser emitter at said platform, said laser emitter for selectively generating a laser beam substantially along a longitudinal axis of said platform; and wherein said rear sensor of said satellite is operable to detect the laser beam generated by said laser emitter, and wherein said steerable wheel is operable to steer said satellite as said satellite returns onto said platform in response to the detected location of the laser beam by said rear sensor.

13. The vehicle storage system of claim 6, wherein said vehicle retrieval satellite comprises a wire reel that is operable to wind and unwind a power cable, which is coupled to said platform, as said satellite moves onto and off of said platform.

14. An automatic vehicle storage system comprising:

a crane assembly capable of moving longitudinally within a vehicle storage facility;

a carriage assembly capable of moving vertically along said crane assembly;

a platform movably supported at said carriage assembly;

a self-driven vehicle retrieval satellite associated with said carriage assembly, wherein said satellite is operable to selectively raise and lower a vehicle, and is movable onto and off of said platform, said satellite comprising a plurality of sensors for guiding said satellite under the vehicle:

wherein said satellite further comprises:

a steerable wheel and a rear sensor at said vehicle retrieval satellite;

a laser emitter at said platform, said laser emitter for selectively generating a laser beam substantially along a longitudinal axis of said platform;

adjustable sections for adjusting the dimensions of said satellite according to the dimensions of the vehicle; and wherein said rear sensor of said satellite is operable to detect the laser beam generated by said laser emitter, and wherein said steerable wheel is operable to steer said satellite as said satellite returns onto said platform in response to the detected location of the laser beam by said rear sensor.

15. The vehicle storage system of claim 14, wherein said laser emitter comprises a pop-up laser that retracts into an upper surface of said platform as said satellite moves along said upper surface.

16. The vehicle storage system of claim 14, wherein said plurality of said sensors of said satellite comprises an upwardly-directed sensor for detecting at least the locations of front and rear ends of the vehicle, and two side-facing sensors for detecting the locations of tires of the vehicle.

17. The vehicle storage system of claim 14, wherein said carriage assembly comprises:

a carriage base frame;

a first translatable skate that is movable relative to said carriage base frame;

a rotatable slewing drive coupled to said first translatable skate; and wherein said platform is translatably and rotatably coupled to said base frame via said first translatable skate and said rotatable slewing drive.

18. A vehicle retrieval satellite for use in an automatic parking system at a vehicle storage facility, said vehicle retrieval satellite comprising:

a primary satellite section;

a secondary satellite section spaced longitudinally from said primary satellite section;

an extendable and retractable spine coupling said primary and secondary satellite sections;

a power drive system for moving said satellite in opposite directions along a floor surface;

a front sensor array coupled to said secondary satellite section, said front sensor array operable to detect the locations of a front end of a vehicle, of a rear end of the vehicle, and of tires of the vehicle;

at least one of (i) a rear sensor coupled to said primary satellite section, said rear sensor configured to detect a homing signal generated by a signal unit that is remote from said satellite, and (ii) a downwardly-directed sensor for detecting guidance indicia on the floor surface;

a steering system for steering said satellite in response to at least one of (i) detection of the homing signal by said rear sensor, and (ii) detection of the guidance indicia on the floor surface by the downwardly-directed sensor, as said satellite moves in at least one of the opposite directions along the floor surface; and tire-engaging grippers at each of said primary and secondary satellite sections, wherein said tire-engaging grippers are extendable to engage and lift the tires of the vehicle, and are retractable to disengage and lower the tires of the vehicle.

19. The vehicle retrieval satellite of claim 18, wherein said satellite comprises both of said rear sensor and said downwardly-directed sensor, and wherein said steering system is operable to steer said satellite by following either or both of the homing signal or guidance indicia on the floor surface.

20. The vehicle retrieval satellite of claim 18, wherein said vehicle retrieval satellite is operable to retrieve and store the vehicle along substantially flat continuous floor surfaces in the vehicle storage facility.

21. The vehicle retrieval satellite of claim 18, further comprising:

a power cable for supplying power to at least said power drive system and said steering system;

a wire reel for storing a portion of said power cable;

a motorized hub disposed at said wire reel, said motorized hub for winding and unwinding said power cable at said wire reel; and wherein said wire reel is operable to wind and unwind said power cable as said satellite moves in the opposite directions.

22. The vehicle storage system of claim 18, wherein said front sensor array comprises an upwardly-directed sensor for detecting at least the locations of the front and rear ends of the vehicle, and two side-facing sensors for detecting the locations of the tires of the vehicle.

* * * * *